US005994671A

United States Patent [19]

Suzuki et al.

[11] Patent Number: 5,994,671

[45] **Date of Patent: *Nov. 30, 1999**

[54] IMAGE HEATING APPARATUS

[75] Inventors: Hideki Suzuki, Toride; Kenjiro Hori, Tokorozawa; Michihito Yamazaki; Koichi Okuda, both of Tokyo, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/821,718

[22] Filed: Mar. 20, 1997

[30] Foreign Application Priority Data

| | | | |
|---|---|---|---|
| Mar. 21, 1996 | [JP] | Japan | 8-064983 |
| Mar. 21, 1996 | [JP] | Japan | 8-064984 |
| Sep. 12, 1996 | [JP] | Japan | 8-241928 |

[51] Int. Cl.[6] ..... G03G 15/20

[52] U.S. Cl. ..... 219/216; 399/69; 399/329

[58] Field of Search ..... 219/216, 486, 219/494; 399/329, 328, 69

[56] References Cited

U.S. PATENT DOCUMENTS

| | | | |
|---|---|---|---|
| 4,566,783 | 1/1986 | Schwierz et al. | 219/216 |
| 5,114,337 | 5/1992 | Yamazaki . | |
| 5,365,314 | 11/1994 | Okuda et al. . | |
| 5,376,773 | 12/1994 | Masuda et al. . | |
| 5,444,521 | 8/1995 | Tomoyuki et al. . | |
| 5,464,964 | 11/1995 | Okuna et al. . | |
| 5,534,987 | 7/1996 | Ohtsuka et al. . | |
| 5,592,276 | 1/1997 | Ohtsuka et al. . | |
| 5,621,510 | 4/1997 | Okuda et al. . | |

FOREIGN PATENT DOCUMENTS

| | | |
|---|---|---|
| 0 668 548 | 8/1995 | European Pat. Off. . |
| 58-134655 | 8/1983 | Japan . |
| 63-313182 | 12/1988 | Japan . |
| 2-157878 | 6/1990 | Japan . |
| 5-341692 | 12/1993 | Japan . |

OTHER PUBLICATIONS

Patent Abstracts of Japan, vol. 018, No. 414 (E–1587), Aug. 3, 1994 & JP 06–121523 (Fuji Xerox Co. Ltd.), Apr. 28, 1994.

*Primary Examiner*—Joseph Pelham

*Attorney, Agent, or Firm*—Fitzpatrick, Cella, Harper & Scinto

[57] ABSTRACT

The present invention provides an image heating apparatus comprising a heating member having a first heating resistor and a second heating resistor, a temperature detecting element for detecting a temperature of the heating member, and a power supply control means for controlling power supply to the first and second heating resistors so that detected temperature of the temperature detecting element is maintained a set temperature. The power supply control means sends the power supply to the first heating resistor in a first power supply pattern, and sends the power supply to the second heating resistor in a second power supply pattern different from the first power supply pattern.

13 Claims, 44 Drawing Sheets

INPUT VOLTAGE WAVEFORM OF EACH HEAT GENERATE MEMBER

100%
ONE CYCLE

90%

80%

70%

60%

50%

40%

30%

20%

10%

100%
90%
ONE CYCLE

80%
70%

60%
50%

40%
30%

20%
10%

100%
ONE CYCLE

90%

80%

70%

60%

50%

40%

30%

20%

10%

FIG. 14A 100%
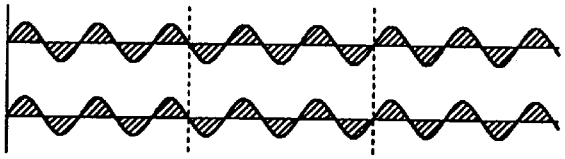
FIG. 14B 90%
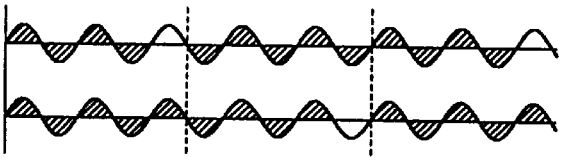
FIG. 14C 80%
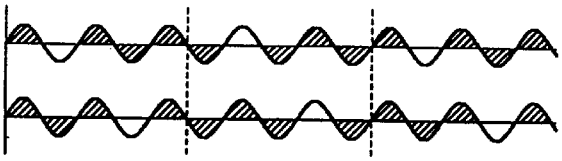
FIG. 14D 70%
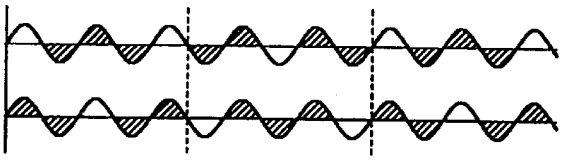
FIG. 14E 60%
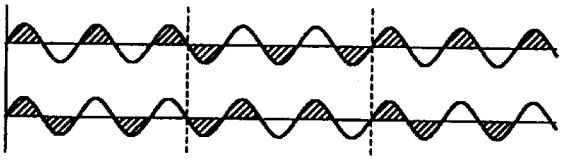
FIG. 14F 50%
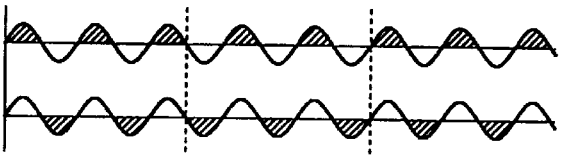
FIG. 14G 40%
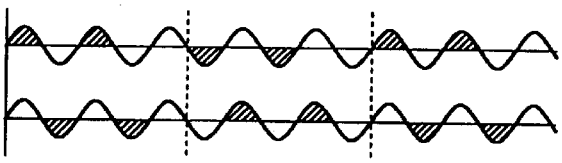
FIG. 14H 30%
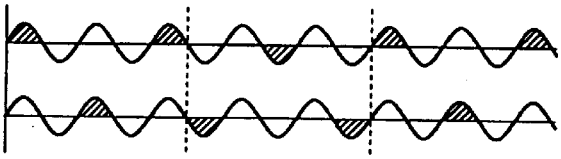
FIG. 14I 20%
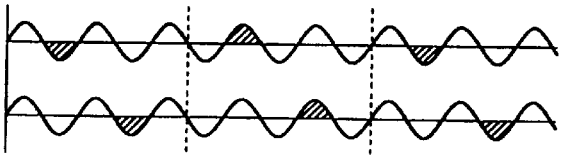
FIG. 14J 10%
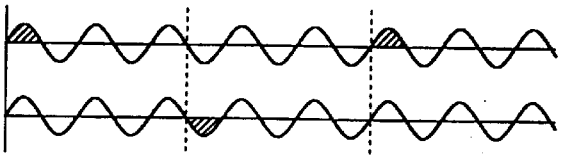

[TOTAL CURRENT WAVEFORM]

100%
90%

80%
70%

60%
50%

40%
30%

20%
10%

[EACH INPUT VOLTAGE WAVEFORM]

ENGINE PORTION
102
POWER SOURCE SW
1
NOISE FILTER
2
FUSER CON-TROLLER
3
FIX HEATER
119
TEMP. SENSOR
5
FAN MOTOR DRIVER
7
6
BD CIRCUIT
9
LIGHT RECEIVE ELEMENT
8
111
112
113
114
HIGH VOLTAGE POWER SOURCE
10
ZERO-CROSS DETECT POR-TION
23
LOW VOLTAGE POWER SOURCE UNIT
4
PICKUP SOLENOID
22
LASER DRIVER
106
LASER DIODE
107
SCANNER MOTOR DRIVER
12
SCANNER MOTOR
11
MAIN MOTOR DRIVER
14
MAIN MOTOR
13
TO FIG. 20B

MAX. HARMONIC WAVE CURRENT AND MAX. ALLOWABLE HARMONIC WAVE CURRENT CLASS A WHEN FIXING HEATERS OF 20Ω ARE CONNECTED IN PARALLEL TO PHASE-CONTROL ONE OF THEM

MAX. HARMONIC WAVE CURRENT AND MAX. ALLOWABLE HARMONIC WAVE CURRENT CLASSES A AND B IN RANGE OF 120 TO 180 DEGREE WHEN FIXING HEATER OF 20Ω IS PHASE-CONTROLLED

MAX. HARMONIC WAVE CURRENT AND MAX. ALLOWABLE HARMONIC WAVE CURRENT
CLASS A WHEN FIXING HEATER OF 10Ω IS PHASE-CONTROLLED

IMAGE HEATING APPARATUS

BACKGROUND OF THE INVENTION

1. Field of the Invention

The present invention relates to an image heating apparatus such as a fixing device used in a copying machine, a printer and the like.

1. Related Background Art

In conventional electrophotographic image forming apparatuses, a toner image visualized on a recording sheet is generally fixed to the recording sheet by means of a heat roller a temperature of which is controlled and a pressure roller having an elastic layer therearound and urged against the heat roller in such a manner that the recording sheet is subjected to heat and pressure while being conveyed between the heat roller and the pressure roller.

However, recently, in order to save electric power and to decrease a time from the power ON to the image output, as disclosed in the Japanese Patent Application Laid-open Nos. 63-313182-and 2-157878, there has been proposed a fixing apparatus (of film-heating fixing type) comprising a heater unit including a fixedly supported heating body (heater) and a heat-resistive film (fixing film) conveyed while being urged against the heater, and a pressurizing member for closely contacting a recording sheet against the heater unit. Wherein a toner image formed on the recording sheet is fixed to the recording sheet by applying heat from the heater to the recording sheet through the film.

In FIG. 19 showing an example of such a film-heating fixing apparatus, the apparatus comprises a heater unit 60 including a cylindrical heat-resistive film 65 which is constituted by a base layer formed from a polyimide film having a thickness of 40 to 60 $\mu$m and, a mold releasing layer made of PFA including PTFE dispersed therein and having a thickness of 5 to 10 $\mu$m and providing an outer peripheral surface (contacting with a recording sheet and a toner image). A heater (heating body) 61 is constituted by an insulation ceramic base plate having low heat capacity and also having a longitudinal direction perpendicular to a conveying direction of the recording sheet 20, a heating resistor 62 printed on a surface of the base plate along the longitudinal direction thereof, and a temperature detecting elements (such as a thermistor) 63 contacted with a surface of the base plate opposite to the heating resistor. The heater 61 is heat-insulated and fixedly supported by a film guide (heater stay) 66 having a semi-circular U-shaped cross-section in such a manner that the heating resistor 62 is exposed outside. Further, temperature control of the heater 61 is effected by controlling electric power supplied from a power source 35 to the heating resistor 62 by driving a Triac 55 by means of a CPU 101 in response to output of the temperature detecting element 63.

An inverted U-shaped reinforcing plate member 67 serves to prevent deformation of the heater unit 60 (including the heater 61, thermistor 63, heater stay 66 and the like) when the heater unit is pressurized by a pressure roller 7. Incidentally, an inner diameter of the fixing film 65 is selected to become greater than an outer peripheral length of the heater unit including the reinforcing plate member 67. The pressure roller 7 is urged against the heater 61 by means of a pressurizing means (not shown) with total pressure of 9 to 11 Kgf. Further, the pressure roller 7 is rotated in the conveying direction (anti-clockwise direction) of the recording sheet 20 by means of a drive system (not shown). As a result, the cylindrical fixing film 65 is rotated around the film guide 66 while slidingly contacting with the heating resistor of the heater 61. In this case, in order to reduce sliding friction between the heater and an inner peripheral surface of the film, heat-resistive grease is disposed between the heater and the film.

With this arrangement, when the recording sheet 20 is guided between the film 65 and the pressure roller 7, since the recording sheet passes through a fixing nip, the toner image formed on the recording sheet is fixed to the recording sheet. In the film-heating fixing apparatus, since the heat capacity of the heater can be reduced to 1/10 of those of conventional fixing devices of heat roller type and any heating body having higher temperature increasing ability can be used, a time period for permitting the heater to fix the toner image to the recording sheet can be reduced to several seconds. Thus, unlike to the conventional fixing devices of heat roller type, so-called on demand fixing can be realized.

Since the film-heating fixing has low heat capacity, temperature ripple is increased in ON/OFF control which is commonly used in the roller type fixing devices. In consideration of this fact, accuracy of the temperature control is improved by changing electric power in accordance with a difference between a target temperature and an actual temperature by using a means for continuously or steppingly changing the electric power by phase control or wave number control. However, the following problems occur.

(Harmonic Wave Distortion)

When AC voltage is applied to a non-linear circuit having a switching element(s), harmonic wave current is generated. When commercial voltage of 50, 60 Hz is switched by the phase control, harmonic wave current is generated due to non-linearity of the circuit. In general, transformers of the commercial power source (normally arranged on electric poles) can transform frequency voltage of 50, 60 Hz efficiently (without heat loss); however, regarding the harmonic wave current, the transforming efficiency is worsened, thereby generating heat. In consideration of this fact, in power plants, since not only electric power required for the apparatus but also electric power corresponding to heat loss in the transformer must supply, energy efficient is worsened. The harmonic wave distortion in the wave number control is less than that in the phase control. The reason is that, in the wave number control, zero-cross control for effecting ON/OFF when the power source voltage reaches to zero or therearound is effected, whereas, in the phase control, ON/OFF is effected at considerably higher voltage.

(Flicker)

Since the heat capacity is small in the on demand fixing, the accuracy of the temperature control is improved by changing the electric power frequently. By doing so, the electric power is fluctuated frequently more than in the conventional roller type fixing devices (for example, in the roller type fixing devices, since the heat capacity is great, the temperature can be kept constant by merely changing the electric power every five seconds; however, in the on demand fixing, the temperature is not kept constant so long as the electric power is changed by several times within a second). The change in the consumption electric power (consumption current) causes the change in the power source voltage. In particular, when a power source having high line impedance is used (for example, when a power source is installed remote from a transformer disposed on an electric pole and resistance of a transmission line between the power source and the transformer is great), the power source voltage is changed frequently and greatly. As a result, illumination and/or TV screens sometimes flicker (such a phenomenon is referred to as "flicker" hereinafter). The flicker due to the wave number control is greater than the flicker due to the phase control. The reason is that, in the phase control, since the frequency of change in current is greater than 100 Hz, the flicker cannot be ascertained by human's eyes; whereas, in the wave number control, when the electric power is controlled by ten steps, for example, by dividing every ten half waves into a respective group and by turning ON several half waves in the former half and turning OFF several half waves in the latter half, since the frequency of change in current becomes about 10 Hz, the flicker can easily be ascertained by the human's eyes.

As the electric power of the heater is increased, the harmonic wave distortion and/or the flicker are worsened, because, upon power ON, the change in current is increased.

SUMMARY OF THE INVENTION

The present invention intends to eliminate the above-mentioned conventional drawbacks, and has an object to provide an image heating apparatus which can prevent harmonic wave distortion and flicker.

Another object of the present invention is to provide an image heating apparatus comprising a heating member including a first heating resistor and a second heating resistor, a temperature detecting element for detecting a temperature of the heating element, and a current communication control means for controlling current communication to the first and second heating resistors so that a detection temperature of the temperature detecting element is maintained to a set temperature. Wherein, the current communication control means permits the current communication to the first heating resistor in a first current communication pattern and to the second heating resistor in a second current communication pattern different from the first current communication pattern.

The other objects and features of the present invention will be apparent from the following detailed explanation referring to the accompanying drawings.

BRIEF DESCRIPTION OF THE DRAWINGS

FIGS. 14A, 14B, 14C, 14D, 14E, 14F, 14G, 14H, 14I and 14J are views showing voltage wave-forms inputted to heating resistors, according to an alteration of the fourth embodiment;

FIG. 36A shows a condition in case of electric power ratio of 100% and FIG. 36B shows a condition in case of electric power ratio of 80 t;

FIG. 37A shows a condition in case of electric power ratio of 66.7% and FIG. 37B shows a condition in case of electric power ratio of 60%;

FIG. 38A shows a condition in case of electric power ratio of 40% and FIG. 38B shows a condition in case of electric power ratio of 33.3%;

FIG. 39A shows a condition in case of electric power ratio of 20% and FIG. 39B shows a condition in case of electric power ratio of 6.7%;

FIG. 40A shows a condition in case of electric power ratio of 100% and FIG. 40B shows a condition in case of electric power ratio of 80%;

FIG. 41A shows a condition in case of electric power ratio of 66.7% and FIG. 41B shows a condition in case of electric power ratio of 60%;

FIG. 42A shows a condition in case of electric power ratio of 40% and FIG. 42B shows a condition in case of electric ipower ratio of 33.3%;

FIG. 43A shows a condition in case of electric power ratio of 20% and FIG. 43B shows a condition in case of electric power ratio of 6.7%.

DETAILED DESCRIPTION OF THE PREFERRED EMBODIMENTS (First Embodiment) Now, a first embodiment of the present invention will be explained with reference to FIGS. 1, 2A, 2B, 3 and 4. FIG. 1 is a front view of a fixing heater of a laser printer to which the present invention is applied and showing a main portion of a circuit for controlling a temperature of the heater, FIGS. 2A and 2B are views showing voltage wave-forms inputted to heating resistors, FIG. 3 is a schematic sectional view showing a main portion of the laser printer using an image heating apparatus according to the present invention, and FIG. 4 is a sectional view showing a main portion of a fixing apparatus including the heater.

In FIG. 1, the reference numeral 600 denotes a ceramic heater; 601 denotes a ceramic substrate; and 610, 620 denote heating resistors. The reference numerals 611, 621 and 631 denote electrodes. A resistance values between the electrodes 631 and 611 and between the electrodes 631 and 621 are selected to 20 Ω, respectively. A broken line block shows a rear surface of the heater which includes a thermistor 640 connected to surface side electrodes 641, 642 through a through hole. A CPU 100 of the printer serves to control Triacs 51, 52 in response to a resistance value of the thermistor inputted to the CPU 100 through the electrodes 641, 642, thereby controlling electric power supplied from a power source 30 to the heating resistors 610, 620.

In FIG. 3, the reference numeral 1 denotes an organic photosensitive drum (image bearing member); 2 denotes a charge roller (charge member); 3 denotes a laser exposure device; 4 denotes a developing device; 5 denotes a transfer roller; 6 denotes a heater unit; and 7 denotes a pressure roller. By these main elements, an image is formed on a recording sheet 20 supplied from a sheet cassette 11 by means of a sheet supply roller 10, in a well-known electrophotographic process.

In FIG. 4, the heater unit 6 comprises the heater (heating body) 600 shown in FIG. 1. The heater includes the heat-resistive insulation ceramic substrate 601 having a longitudinal direction perpendicular to a conveying direction of the recording .sheet 20 and having low heat capacity, the heating resistors 610, 620 and a thermistor 630. There is provided a cylindrical heat-resistive film 650. The heater 600 is fixedly supported by a film guide 660 in such a manner that the heating resistors 610, 620 are exposed outside. The film guide is pressurized by a stay 670. The pressure roller (pressurizing member) 7 is constituted by a metal core 71, an elastic layer 72 made of silicone rubber, and a mold releasing layer 73 made of fluororesin. The heater unit 6 is urged against the pressure roller 7 by a pressurizing means (not shown) with layer pressure of 5 to 20 Kgf. Further, the pressure roller 7 is rotated by a drive means (not shown) in the recording sheet conveying direction. With this arrangement, the cylindrical fixing film 650 is rotated around the film guide 660 while slidingly contacting with the surface of the heater 600. While the recording sheet 20 is being passed through a nip between the temperature-controlled heater unit 6 and the pressure roller 7, a toner image formed on the recording sheet 20 is fixed to the recording sheet.

The following Table 1 shows a relation between output electric power and maximum harmonic wave current under various heater constructions and various control methods. In "TEST No. 1", although output of 1000 W can be obtained, the maximum harmonic wave current becomes great. In "TEST No. 2", the output is insufficient. In "TEST No. 3", the maximum harmonic wave current becomes great. In "TEST No. 4" according to the first embodiment of the present invention, the output of 1000 W can be obtained and the maximum harmonic wave current can be suppressed smaller.

TABLE 1

| TEST No. | Heater Construction | Control Method | Output Power (100 V) | Max. Harmonic Wave Current |
|---|---|---|---|---|
| 1 | one resistor/10 Ω | phase control | 1000 W | 2 |
| 2 | one resistor/20 Ω | phase control | 500 W | 1 |
| 3 | two resistors/20 Ω | phase control same angle | 1000 W | 2 |
| 4 | two resistors/20 Ω | one/phase control one/ON-OFF control | 1000 W | 1 |

(Value of maximum harmonic wave current is shown as 1.0 for one resistor of 20 Ω)

Figure 1:
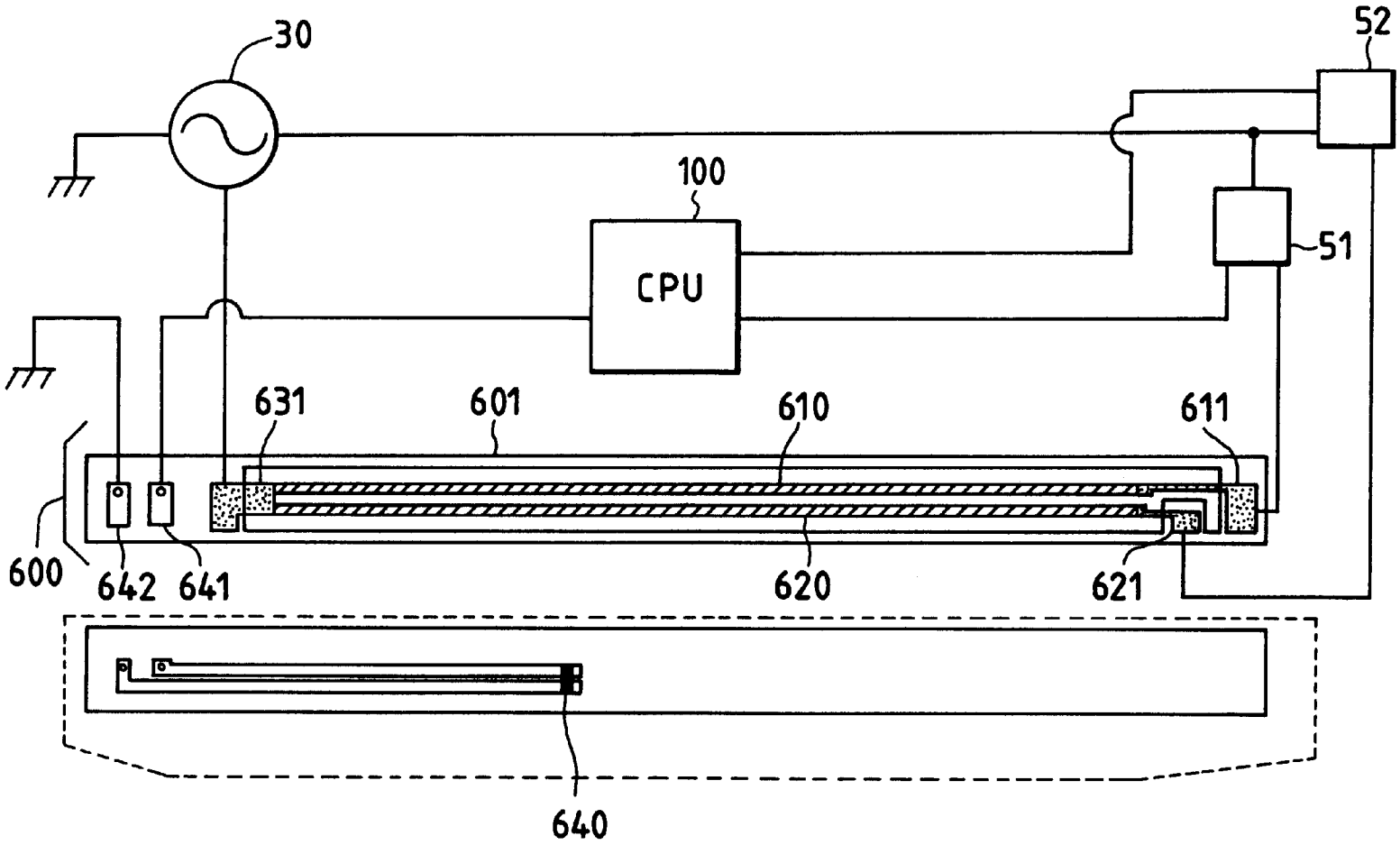
FIG. 1 is a view showing heating bodies and a circuit for controlling temperatures of the heating bodies, according to the present invention.
Figures 2A, 2B:
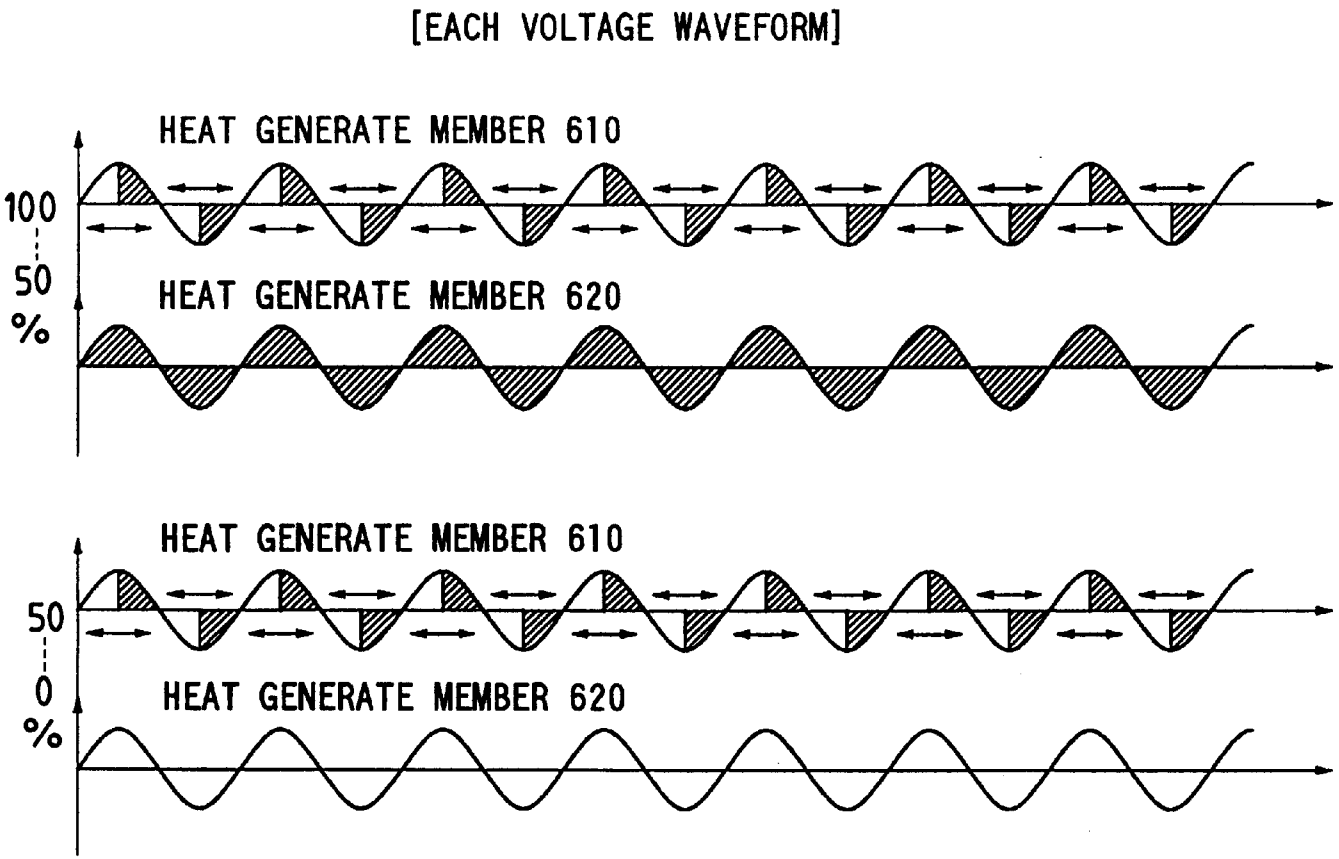
FIGS. 2A and 2B are views showing voltage wave-forms inputted to heating resistors, according to a first embodiment of the present invention.
Figure 3:
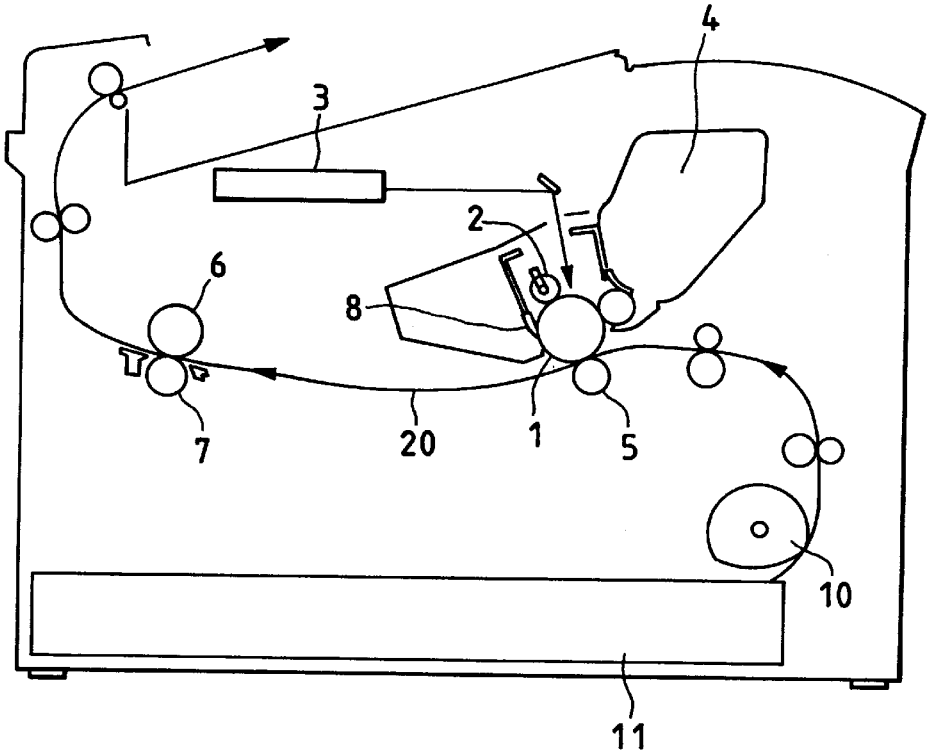
FIG. 3 is a schematic sectional view showing a main portion of a laser printer.

That is to say, in the conventional techniques, if U, 15 it is tried to increase the electric power of the heater, since an amount of current passing through a switching circuit (non-linear circuit) is increased, the harmonic wave current is also increased, with the result that the energy efficiency is worsened. To the contrary, as shown in FIGS. 2A and 2B, in the illustrated embodiment, by always heating the other heating resistor, since the heater electric power can be increased without increasing the current flowing through the switching circuit, the electric power of the heater can be increased without increasing the harmonic wave current. Further, since the change in current during the electric power control can be suppressed lesser, the flicker can be improved in comparison with the single heater of 10 Ω.

In addition, in the illustrated embodiment, since the change in electric power relative to the change in phase angle is small, the accuracy of the electric power becomes great even if the phase angle is not controlled accurately. That is to say, in comparison with a case where a single resistor is phase-controlled, when two resistors are phase-controlled independently, if the phase angle is changed by a predetermined amount, the corresponding change electric power becomes a half of such predetermined amount, with the result that more correct and fine control can be performed, thereby reducing the temperature ripple of the heater.

Figure 4:
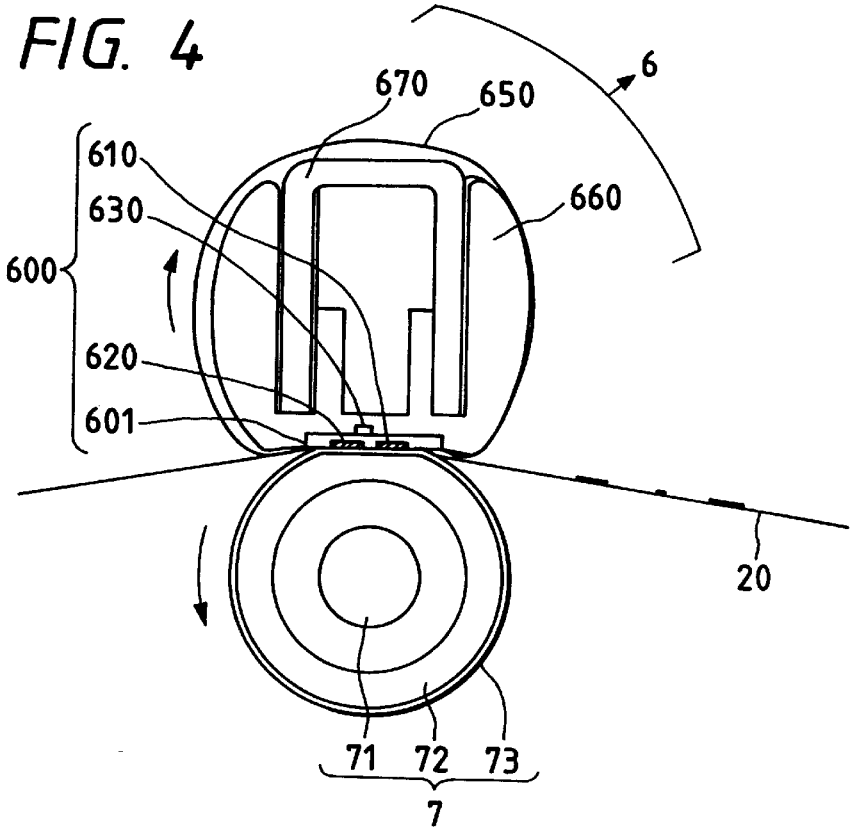
FIG. 4 is a sectional view showing a main portion of a fixing apparatus.
Figure 5A:
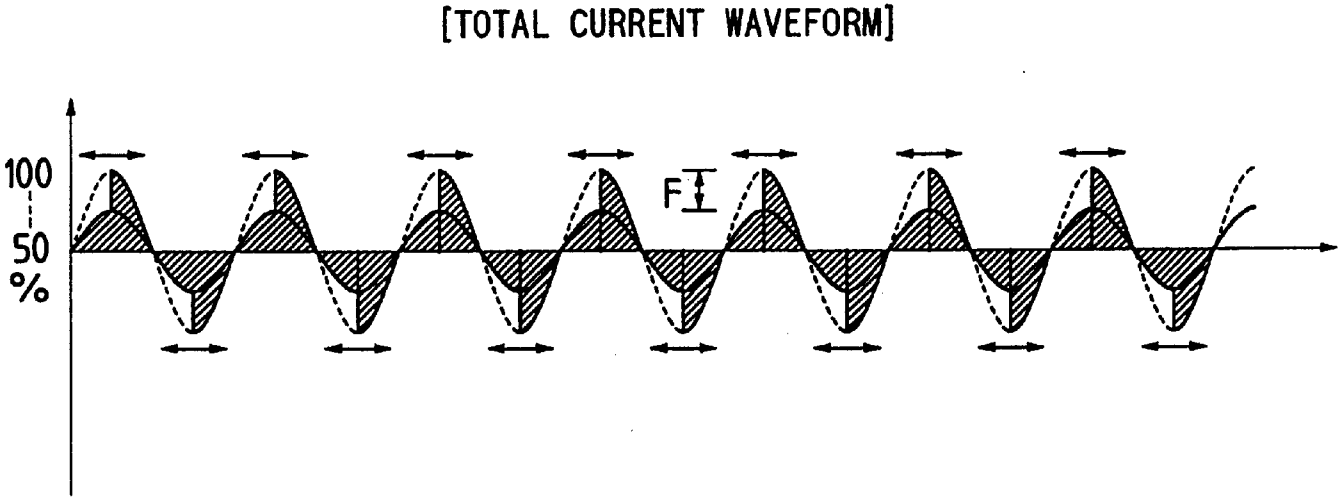
FIGS. 5A and 5B are views showing total current wave forms flowing through the heating resistors, according to first and second embodiments of the present invention.
Figure 5B:
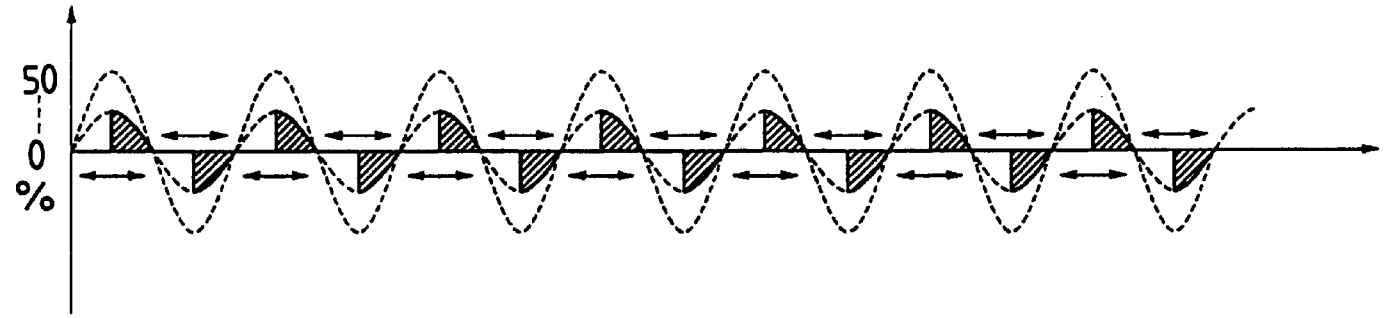

In the illustrated embodiment, as shown in FIG. 4, the resistor 610 is disposed at an upstream side of the resistor 620, and, while an example that the upstream resistor is phase-controlled and the downstream resistor is ON/OFF-controlled (to always maintain to the ON condition or OFF condition) was explained, the downstream resistor 620 may be phase-controlled and the upstream resistor 610 may be ON/OFF-controlled. Further, even when the resistor which is always turned ON is phase-controlled with a small phase angle such as 5° or even when the resistor which is always turned OFF is phase-controlled with a large phase angle such as 175°, the same advantage can be obtained. In addition, it is not necessary that the resistance values of the resistors 610, 620 are the same, but, the upstream or downstream resistor may have a resistance value greater than that of the other resistor.

(Second Embodiment)

Figure 6A:
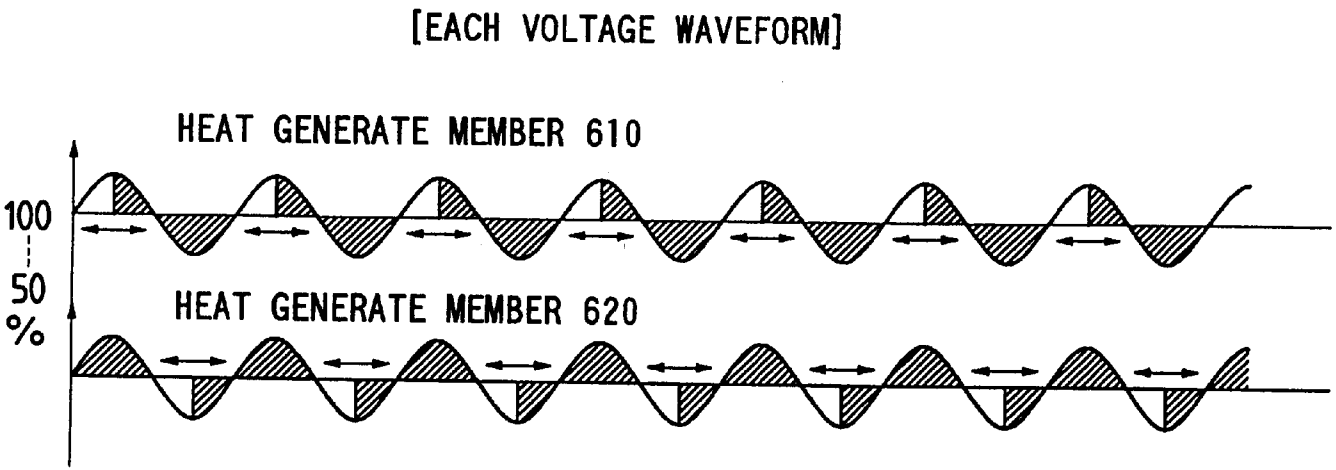
FIGS. 6A and 6B are views showing voltage wave-forms inputted to heating resistors, according to the second embodiment.
Figure 6B:
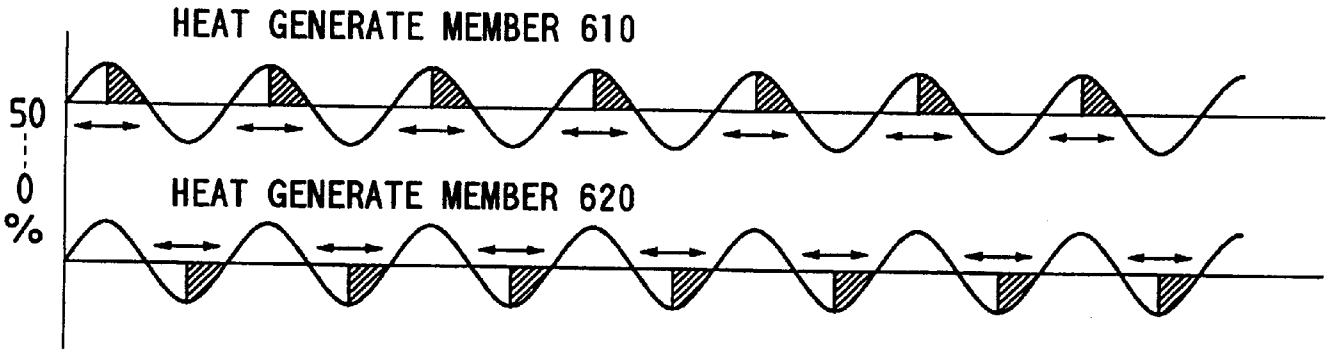

FIGS. 6A and 6B show other voltage wave-forms. In this embodiment, the current wave-form inputted to each of the resistors is switched every half wave so that average currents of AC wave-forms in respective cycles flowing through respective resistors become the same.

That is to say, as is in the first embodiment, when the upstream or downstream resistor is always turned ON or OFF, the amounts of currents flowing through the upstream and downstream resistors are varied with the change in electric power ratio of the heater, with the result that heating distribution along the sheet conveying direction is changed. As a result, for example, even when the heater is controlled by the same temperature to output the same electric power, the current amount flowing through the upstream resistor differs from the current amount flowing through the downstream resistor, with the result that the heating distribution is varied, thereby changing the fixing ability. In the second embodiment shown in FIGS. 6A and 6B, such inconvenience can be eliminated more or less.

TABLE 2

(Control is effected by input voltage shown in FIGS. 2A and 2B)

| Power Voltage | Communication on 846W output: Resistor 610 | Communication on 846W output: Resistor 620 | Heating Distribution | Fixing Ability |
|---|---|---|---|---|
| 130 V | 0 W | 846 W | upstream temp. high downstream temp. low | bad |
| 92 V | 423 W | 423 W | same temp. in up/down | good |

TABLE 3

(Control is effected by input voltage shown in FIGS. 6A and 6B)

| Power Voltage | Communication on 846W output: Resistor 610 | Communication on 846W output: Resistor 620 | Heating Distribution | Fixing Ability |
|---|---|---|---|---|
| 130 V | 423 W | 423 W | same temp. in up/down | good |
| 92 V | 423 W | 423 W | same temp. in up/down | good |

Further, according to the inventors' investigation, it was found that it is preferable that the difference in current between the upstream resistor and the downstream resistor becomes the same on the average until the recording sheet passes by the nip. This can be achieved by exchanging the input voltage wave-forms shown in FIGS. 2A and 2B within a half of the time period when the recording sheet is passed through the nip. If the input voltage wave-forms are exchanged at a longer time period, due to the change in the heating distribution along the sheet conveying direction, fixing unevenness and glaze unevenness will occur on the recording sheet.

TABLE 4

| Input voltage Exchange Time | Glaze Unevenness |
|---|---|
| 0.5 | good |
| 1.0 | good |
| 1.5 | average |
| 2.0 | average |
| 3.0 | bad |

(Input voltage exchange time is shown as 1.0 for a half of a nip passing time period)

As mentioned above, by decreasing the difference in the applied current between the resistors within the nip passing time period, even when the power source voltage is changed, the heating distribution is not changed due to the change in communication ratio of the heater, thereby stabilizing the fixing ability.

Figure 7A:
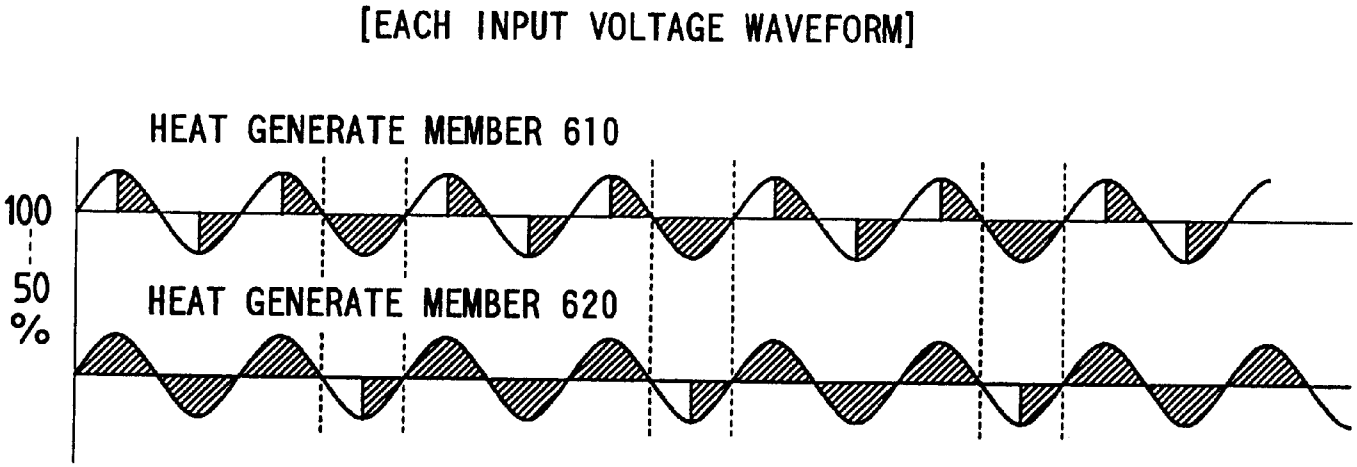
FIGS. 7A and 7B are views showing voltage wave-forms inputted to heating resistors, according to an alteration of the second embodiment.
Figure 7B:
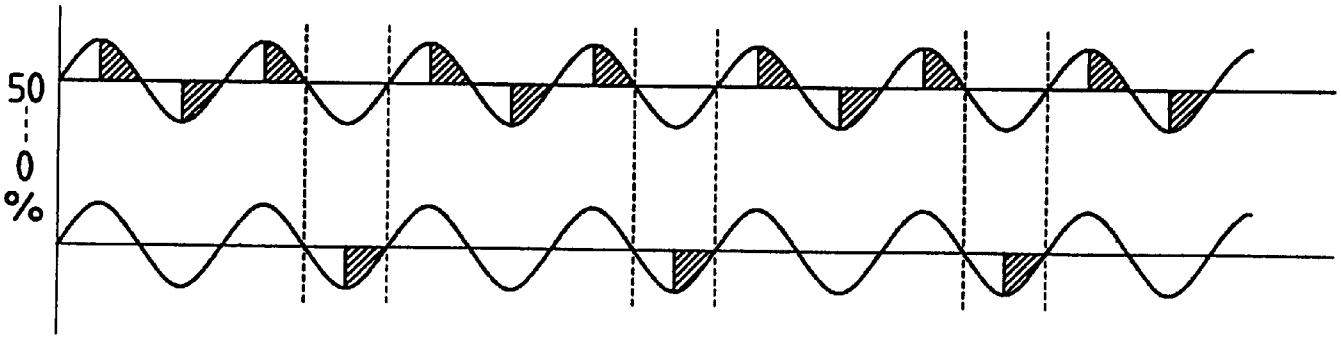
Figures 8A, 8B, 8C, 8D, 8E, 8F, 8G, 8H, 8I, 8J:
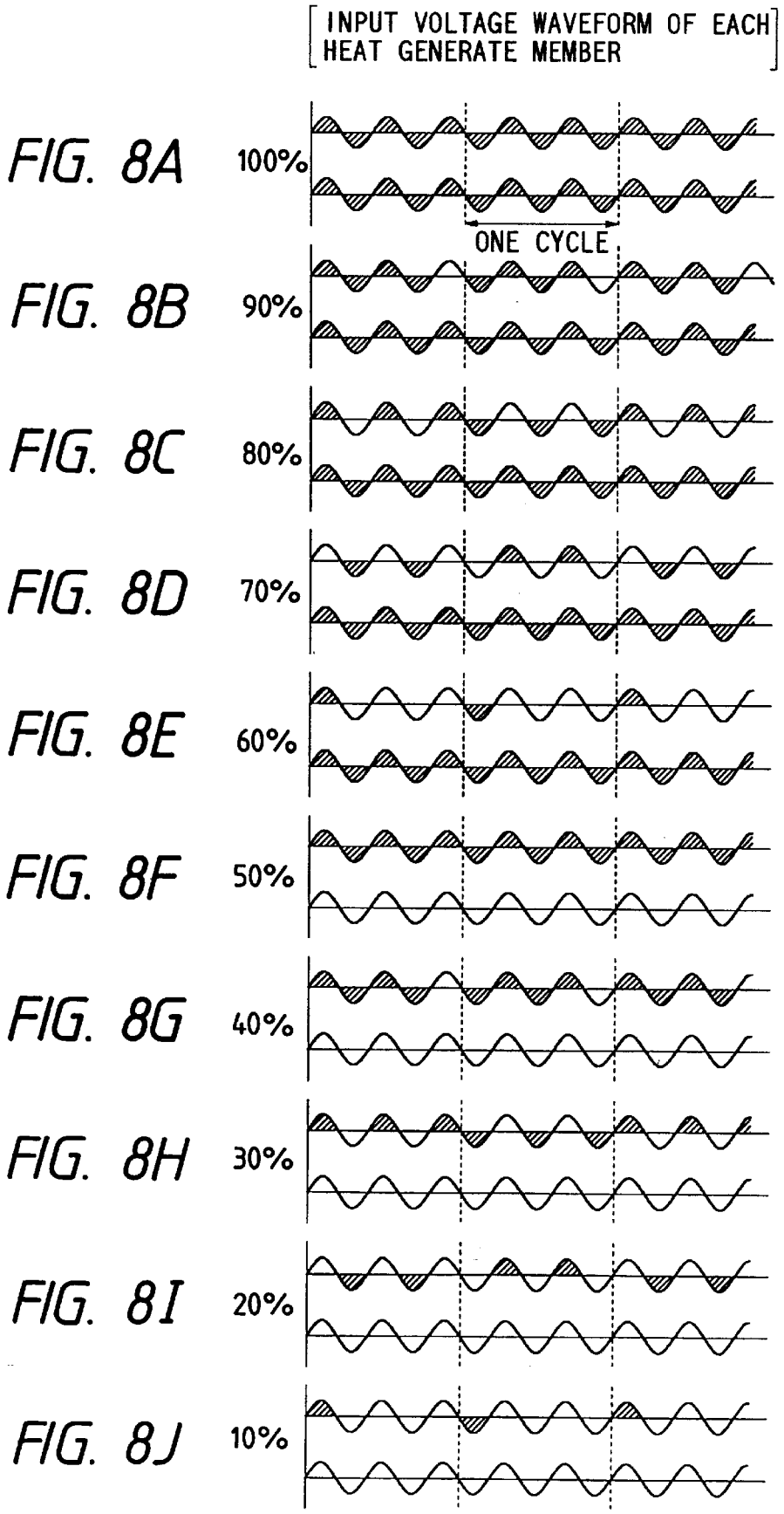
FIGS. 8A, 8B, 8C, 8D, 8E, 8F, 8G, 8H, 8I and 8J are views showing voltage wave-forms inputted to heating resistors, according to a third embodiment of the present invention.
Figures 9A, 9B, 9C, 9D, 9E:
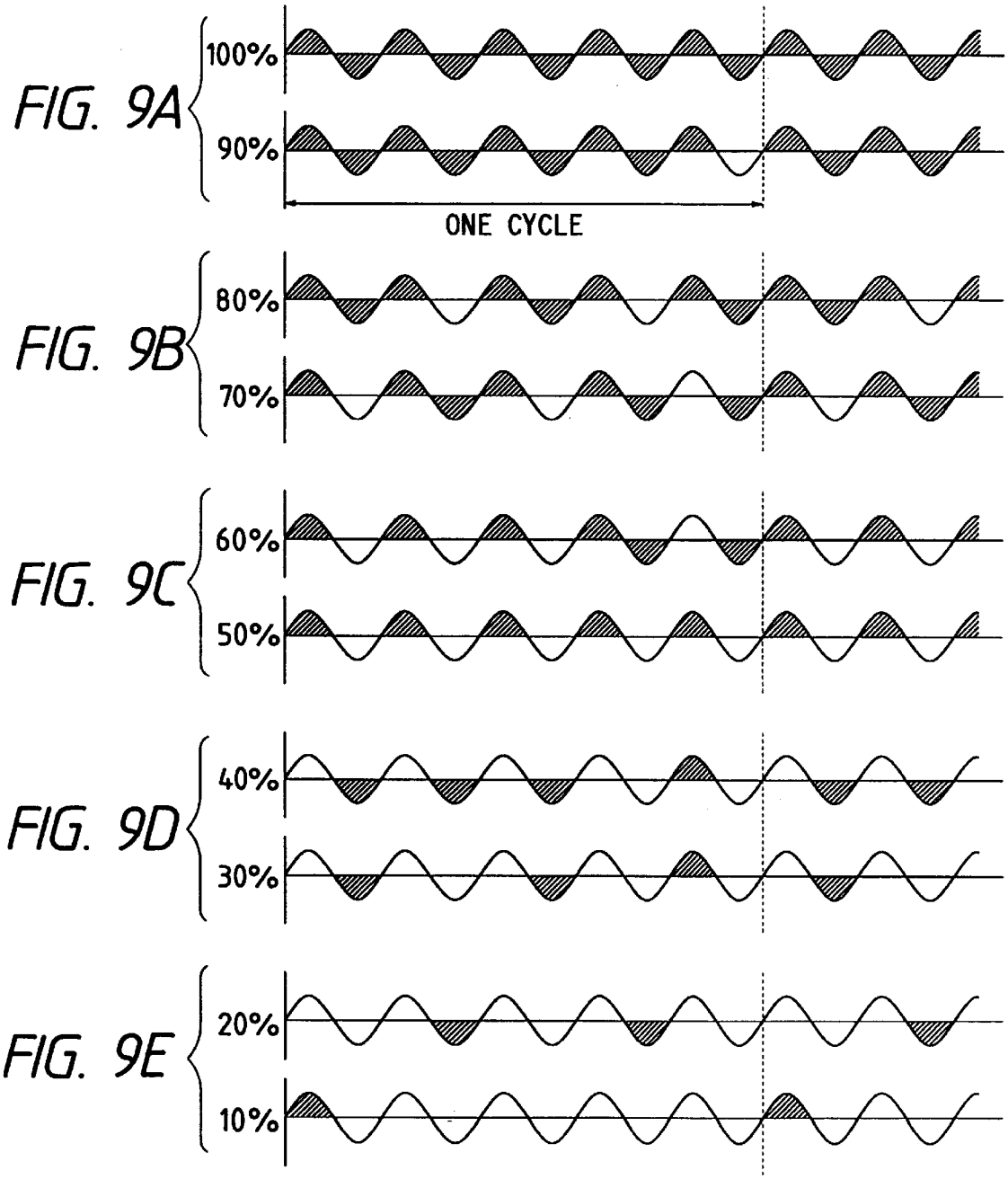
FIGS. 9A, 9B, 9C, 9D, 9E, 10A, 10B and 10C are views showing voltage wave-forms inputted to a heating resistor, according to a comparison example (in which wave number control of a single resistor having resistance value of 10 Ω is effected)

Further, when the input voltage wave-forms shown in FIGS. 2A and 2B are exchanged by one half wave among several half waves, the average currents of the resistors do not become the same. As a result, although the advantage is worsened in comparison with the second embodiment, the fixing ability is enhanced in comparison with the first embodiment. For example, in FIGS. 7A and 7B, the input voltage wave-forms are exchanged by one half wave among four half waves.

FIGS. 5A, 5B, 6A, 6B and 7A, 7B show total current wave-forms in the embodiments shown in FIGS. 2A, 2B, 6A, 6B, 7A and 7B, respectively. In this way, in the embodiments shown in FIGS. 2A, 2B, 6A, 6B, 7A and 7B, the total current wave-forms are the same, and the occurrence of the harmonic wave current can be suppressed as is in the case where the single resistor of 20 Ω is phase-controlled.

(Third Embodiment)

FIGS. 8A to 8J show input voltage wave-forms when the resistors 610, 620 are controlled under wave number control. Both resistors are ON/OFF-controlled every half wave (five half waves constitutes one cycle). When the resistors are used under output of 100 to 60%, the resistor 620 is always turned ON, and, when used under output of 0 to 50%, the resistor 620 is always turned OFF.

In comparison with a case where a single resistor of 10 Ω is controlled under the wave number control as shown in FIGS. 9A to 9E and FIGS. 10A to 10C, or, a case where two resistors of 20 Ω are controlled in the same current communication pattern as shown in FIGS. 11A to 11E, as mentioned above, when two resistors of 20 Ω are arranged in parallel and one of the resistors is always turned ON or OFF, the flicker can be suppressed in the same order as the single heater of 20 Ω while obtaining the output corresponding to the single heater of 10 Ω.

TABLE 5

| Heater Construction | Control Method | Output Power (100 V) | Flicker |
|---|---|---|---|
| one resistor/10 Ω | wave number control | 1000 W | 2 |
| one resistor/20 Ω | wave number control | 500 W | 1 |
| two resistors/20 Ω | wave number control with same pattern | 1000 W | 2 |
| two resistors/20 Ω | one/wave number control one/ON-OFF control | 1000 W | 1 |

(Flicker is shown as 1.0 for one resistor of 20 Ω. Flicker is measured by a flicker meter)

That is to say, in the conventional techniques, if it is tried to increase the electric power of the heater, the change in current upon ON/OFF is increased, thereby worsening the flicker. To the contrary, in the illustrated embodiment, since one of the resistors is always turned ON or OFF, the heater electric power can be increased without increasing the change in current upon ON/OFF, with the result that the electric power of the heater can be increased without increasing the flicker.

Further, in the illustrated embodiment, even when the cycle of the wave number control is small, fine electric power control can be performed, thereby reducing the temperature ripple.

Figures 10A, 10B, 10C:
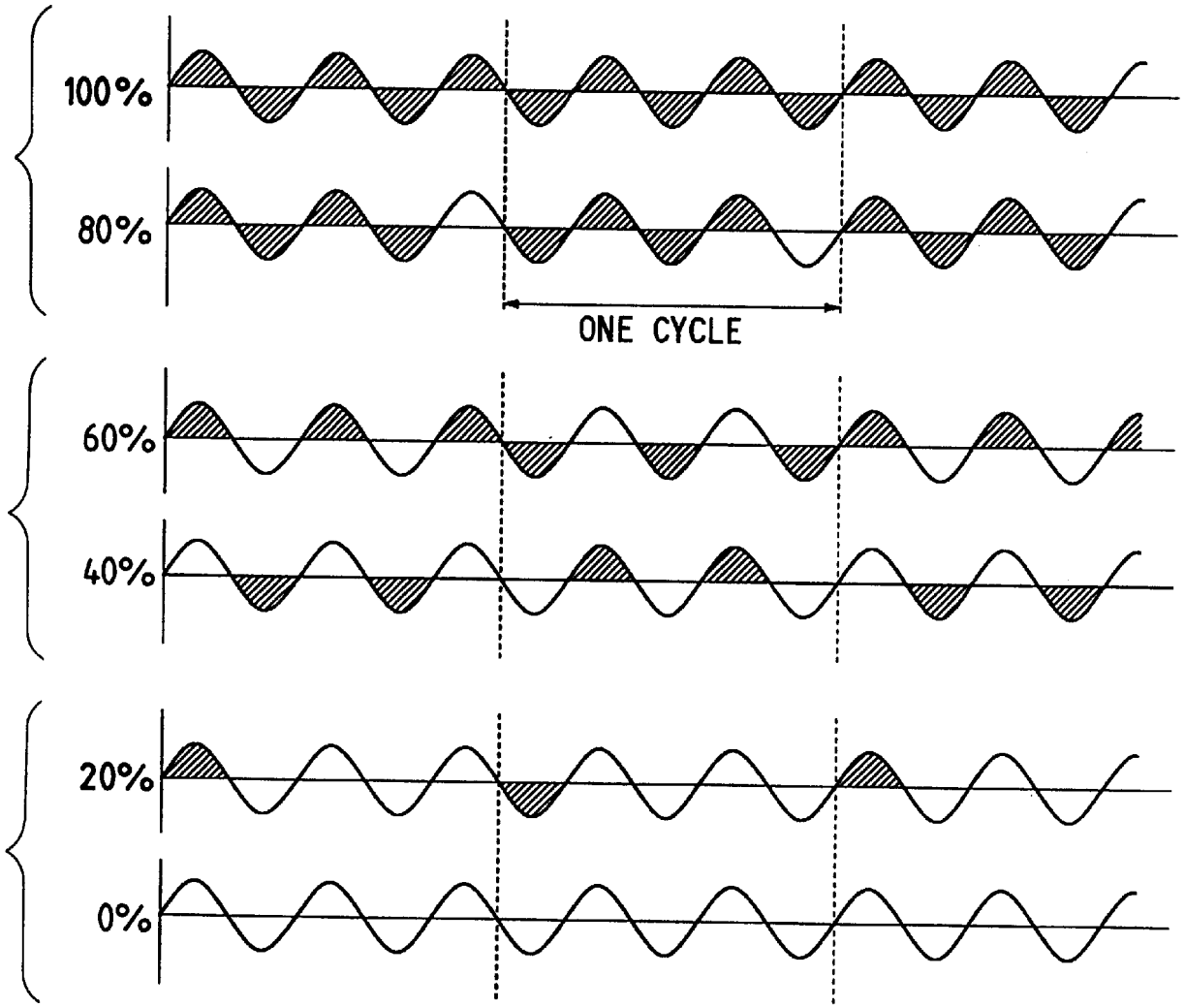
Figure 11A:
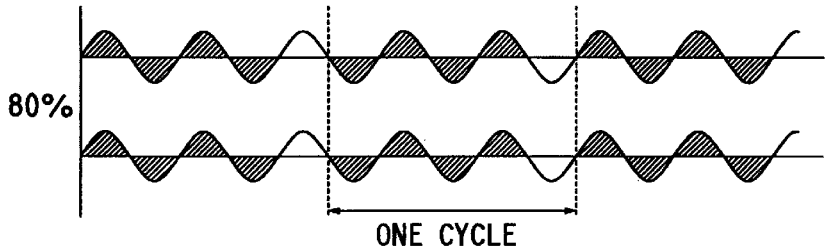
FIGS. 11A, 11B, 11C, 11D and 11E are views showing voltage wave-forms inputted to heating resistors, according to a comparison example (in which wave number controls of two resistor each having resistance value of 20 Ω are effected at the same timing)
Figure 11B:
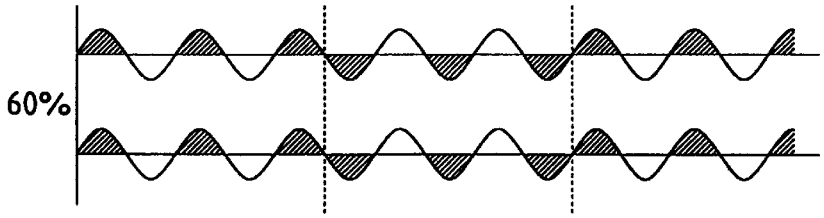
Figure 11C:
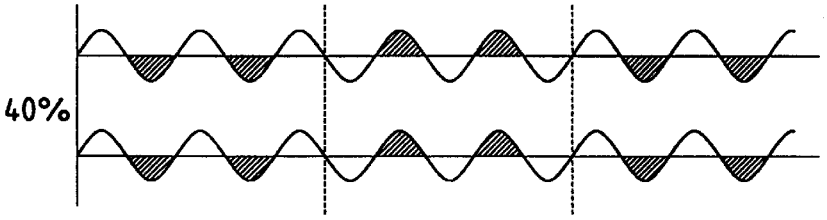
Figure 11D:
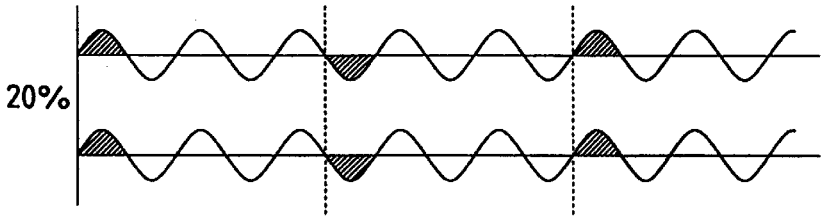
Figure 11E:
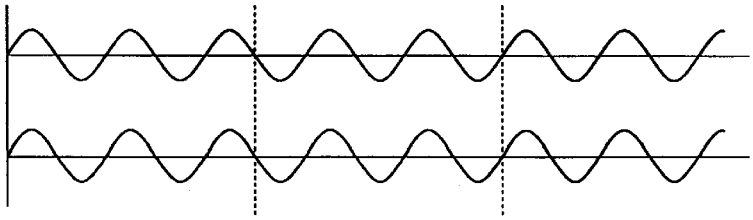
Figure 12:
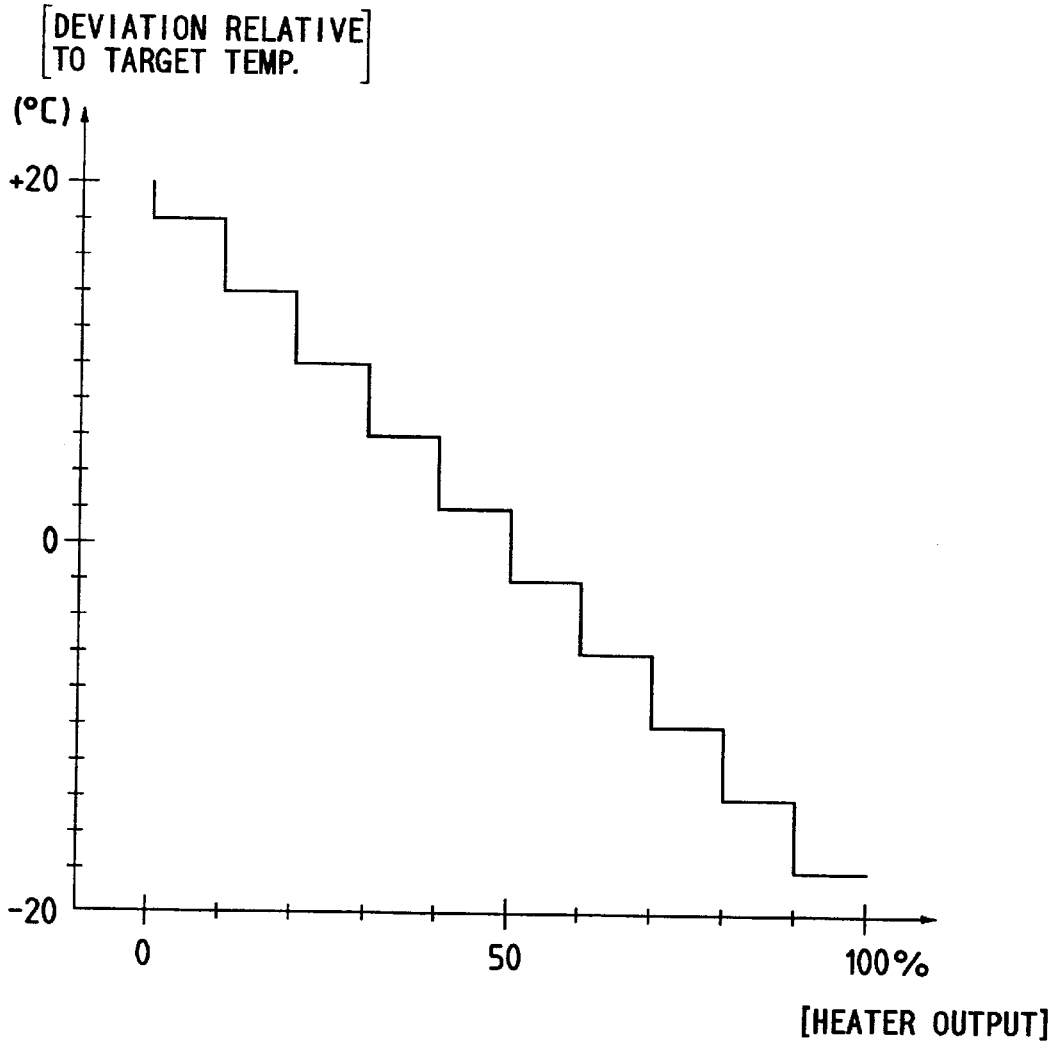
FIG. 12 is a graph showing a relation between a heating temperature deviation and an output of the heating body.
Figures 13A, 13B, 13C, 13D, 13E, 13F, 13G, 13H, 13I, 13J:
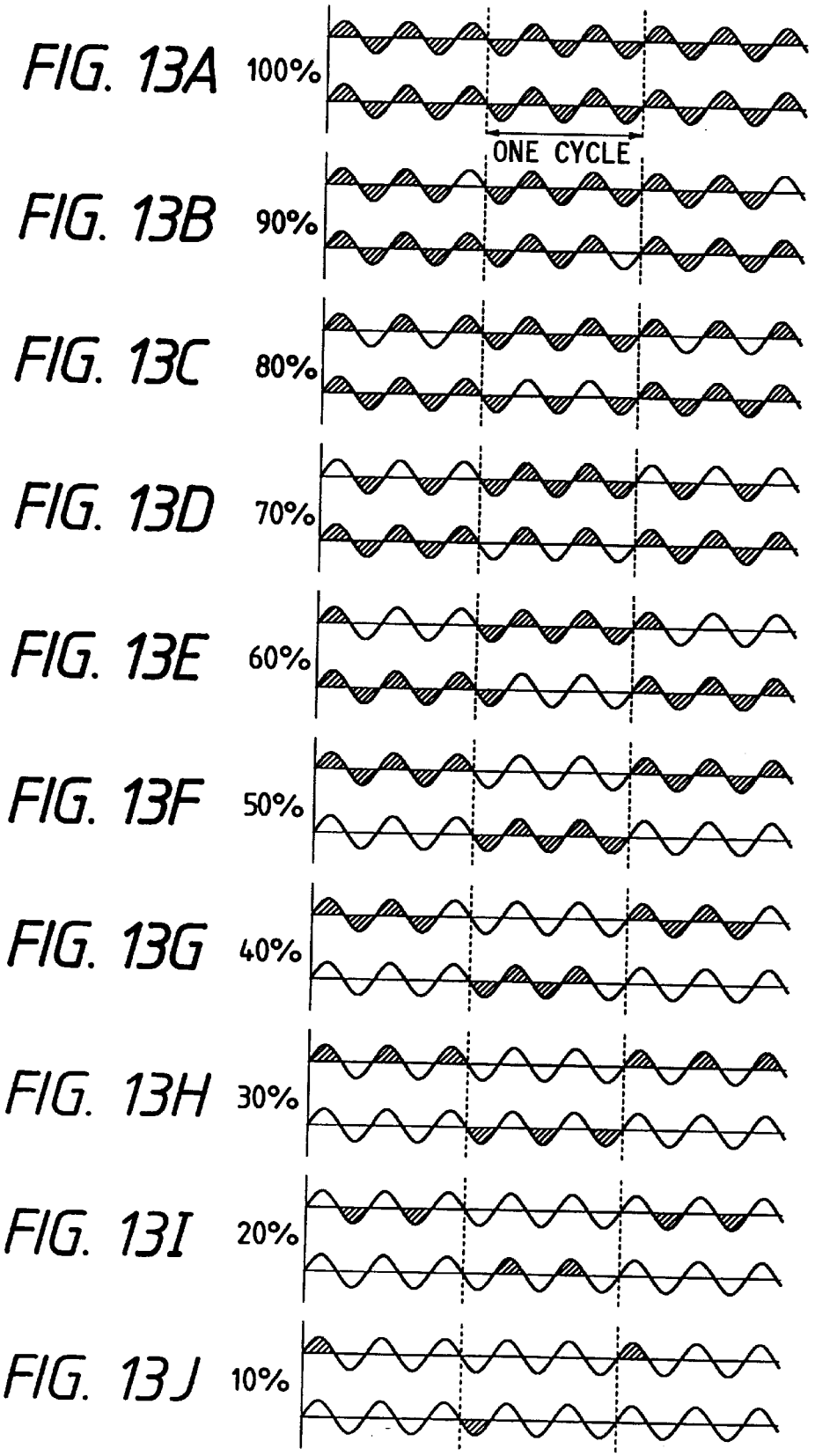
FIGS. 13A, 13B, 13C, 13D, 13E, 13F, 13G, 13H, 13I and 13J are views showing voltage wave-forms inputted to heating resistors, according to a fourth embodiment of the present invention.
Figures 15A, 15B, 15C, 15D, 15E:
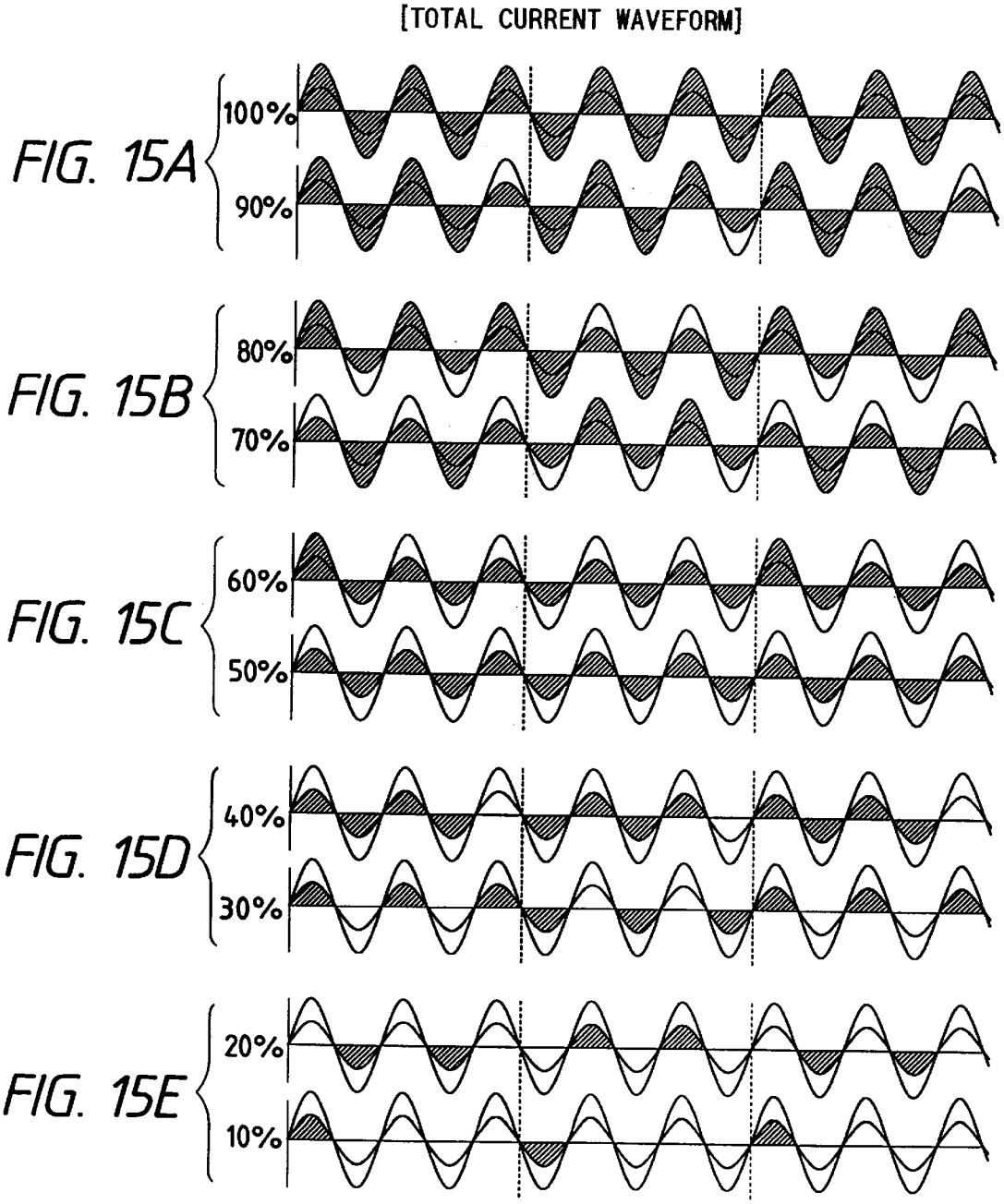
FIGS. 15A, 15B, 15C, 15D and 15E are views showing total current wave forms flowing through the heating resistors, according to the third and fourth embodiments.
Figure 16A:
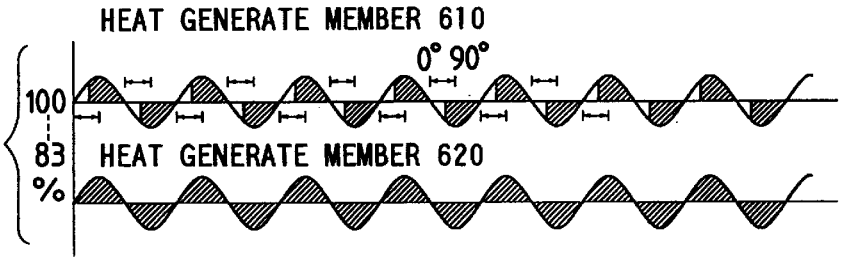
FIGS. 16A, 16B, 16C and 16D are views showing voltage wave-forms inputted to heating resistors, according to a fifth embodiment of the present invention.
Figure 16B:
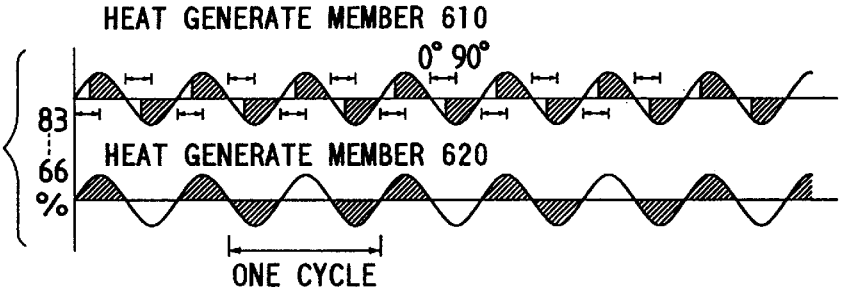
Figure 16C:
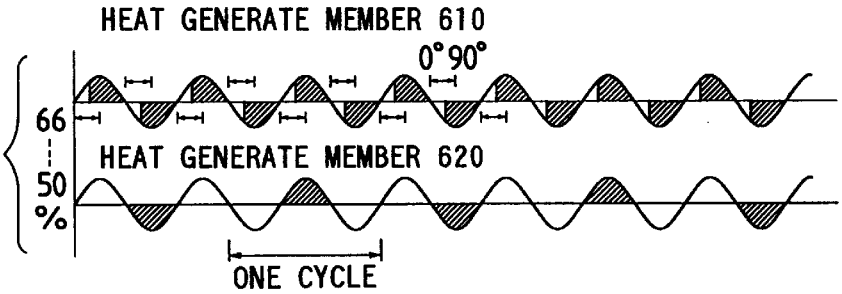
Figure 16D:
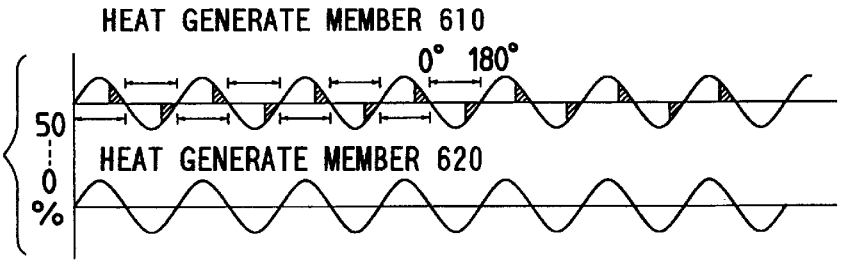
Figure 17A:
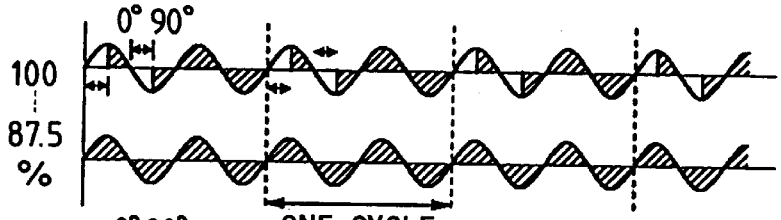
FIGS. 17A, 17B, 17C, 17D, 17E, 17F, 17G and 17H are views showing voltage wave-forms inputted to heating resistors, according to a sixth embodiment of the present invention.
Figure 17B:
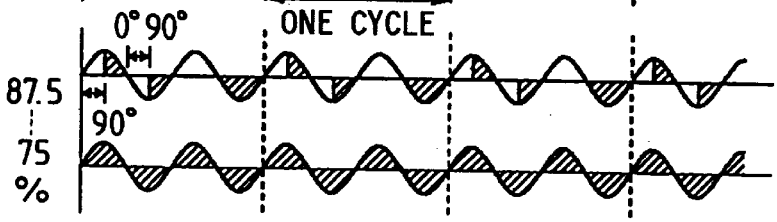
Figure 17C:
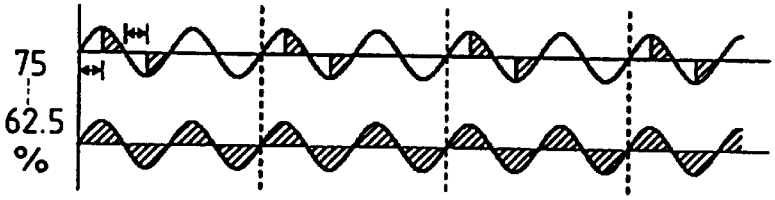
Figure 17D:
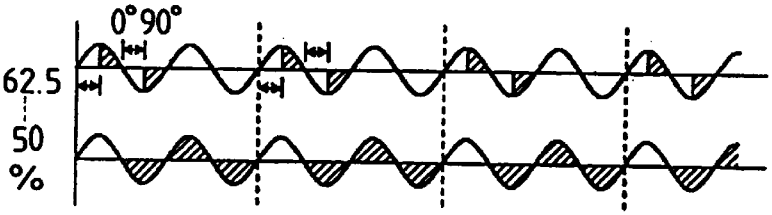
Figure 17E:
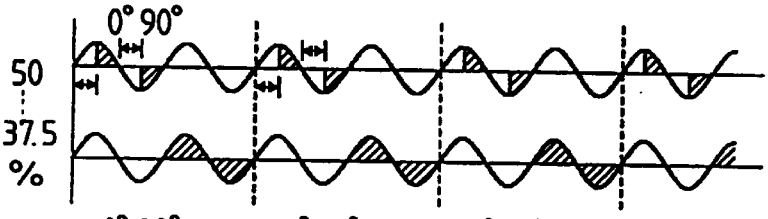
Figure 17F:
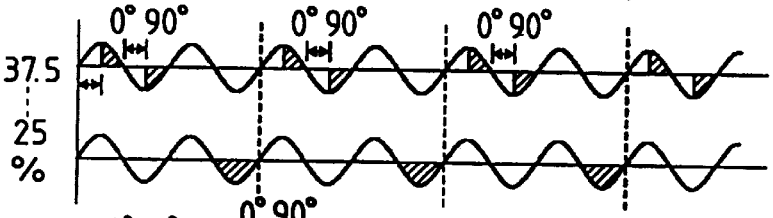
Figure 17G:
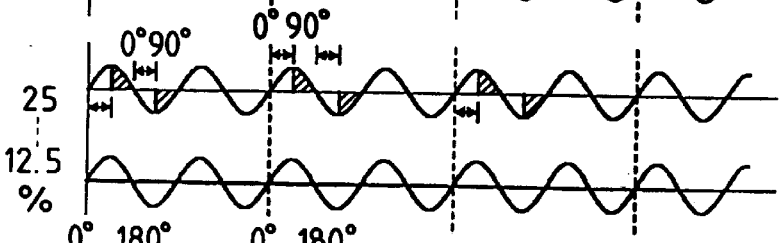
Figure 17H:
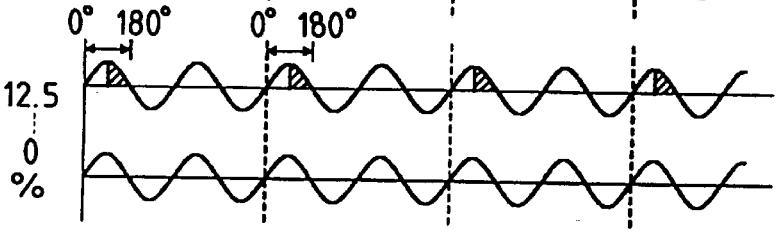
Figure 18A:
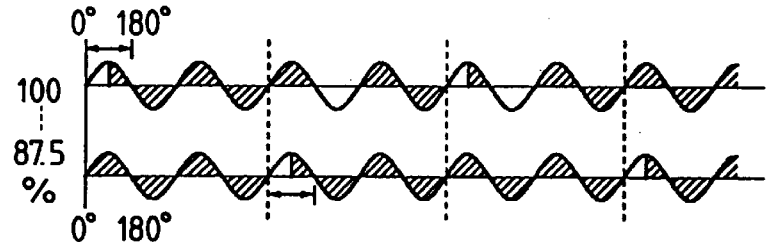
FIGS. 18A, 18B, 18C, 18D, 18E, 18F, 18G and 18H are views showing voltage wave-forms inputted to heating resistors, according to a seventh embodiment of the present invention.
Figure 18B:
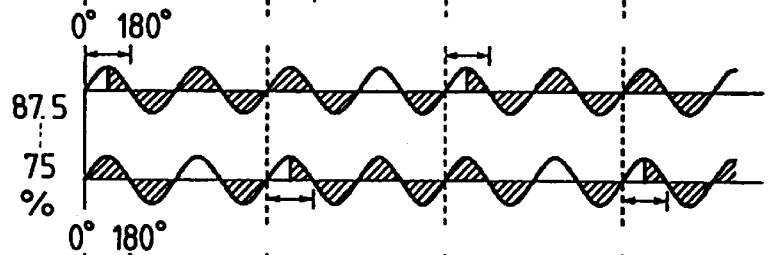
Figure 18C:
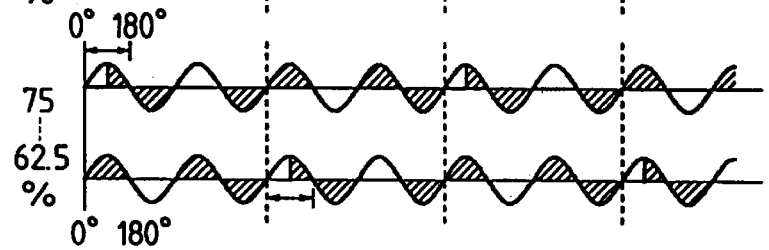
Figure 18D:
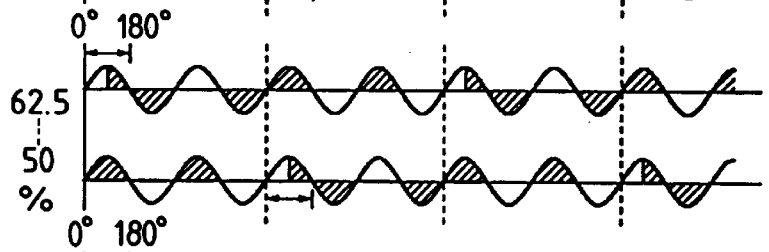
Figure 18E:
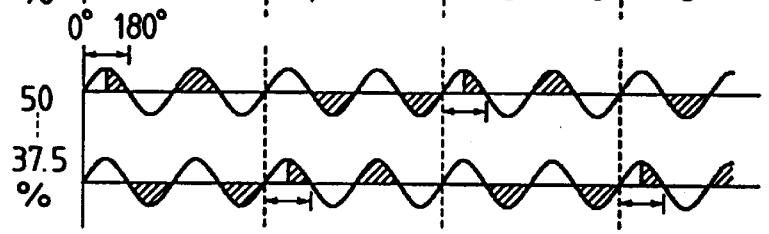
Figure 18F:
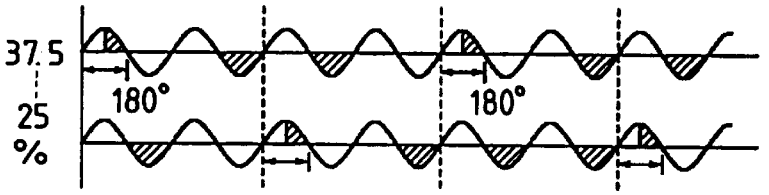
Figure 18G:
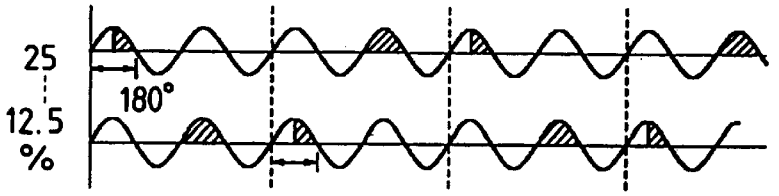
Figure 18H:
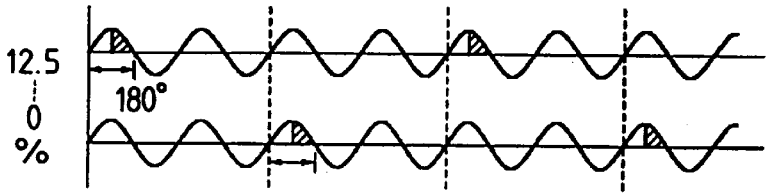
Figure 19:
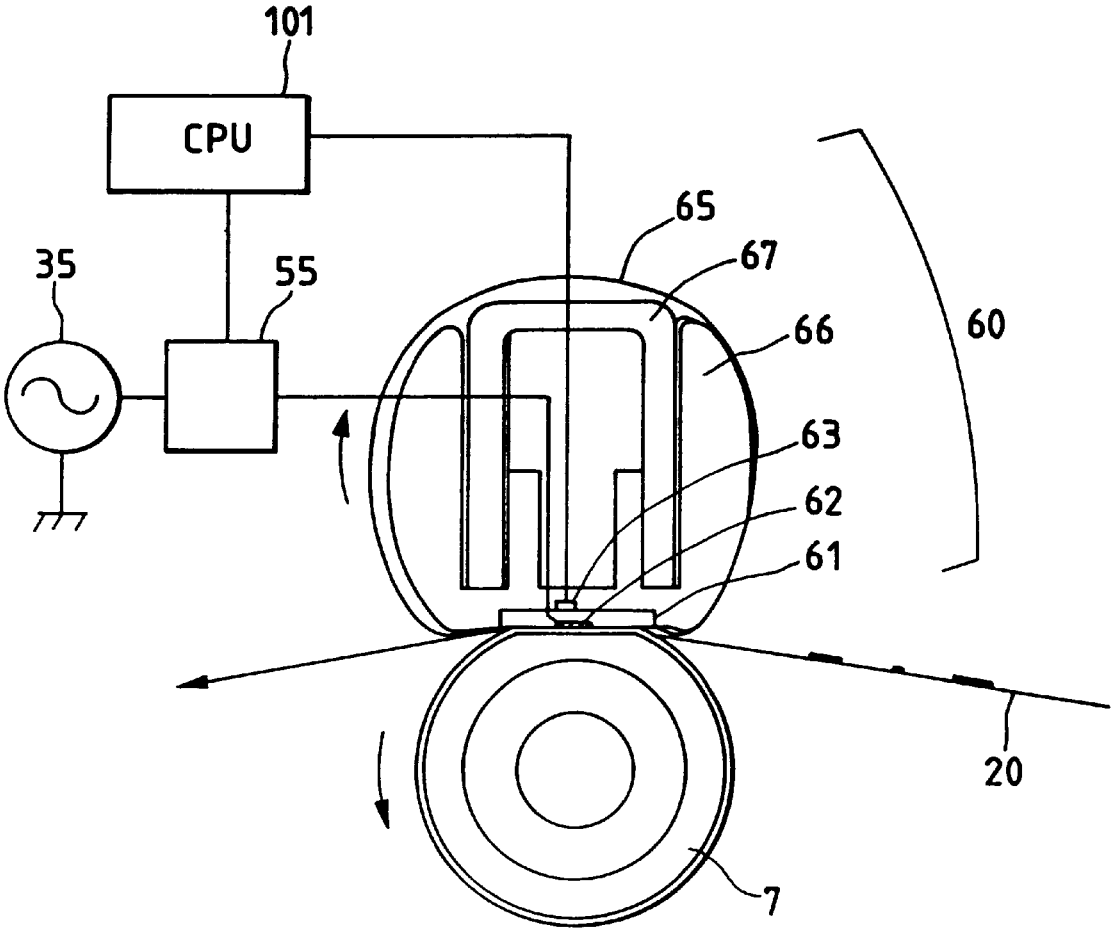
FIG. 19 PRIOR ART
FIG. 19 is a sectional view showing a main portion of a conventional fixing apparatus.

The temperature control of the heater is effected by proportional control in which the output of the heater is changed in accordance with deviation relative to a target temperature, for example as shown in FIG. 12. In general, the shorter a duration of the heater output (for example, 10% duration rather than 20% duration, and 5% duration rather than 10% duration), the easier the temperature ripple can be reduced. However, when the electric power control is effected by the wave number control, if it is tried that the Eelectric power level is set by five steps with 20% duration, as shown in FIGS. 10A to 10C, the cycle of the wave number control will have five half waves; whereas, if it is tried that the electric power level is set by ten steps with 10% duration, as shown in FIGS. 9A to 9E, the cycle of the wave number control will have ten half waves. Thus, the finer the electric power control the longer the cycle of the wave number control, with the result that the response of the control is worsened, thereby increasing the temperature ripple. Conversely, if the cycle of the wave number control is shortened (for example, to have five half waves) to improve the response of the control, the electric power level becomes rough (20% duration), with the result that fine adjustment of the electric power becomes impossible, thereby worsening the temperature ripple.

To the contrary, when two resistors are controlled under the wave number control in different current communication patterns, even if the cycle of the wave number control is short, since there are two resistors, twice electric power level can be set, with the result that the response of the control can be improved and the fine adjustment of the electric power can be realized, thereby reducing the temperature ripple.

TABLE 6

| Heater | Electric Power Level | Control Cycle | Temp. Ripple |
|---|---|---|---|
| one/10 Ω | 10% duration | ten half waves | Δ12° C. |
| one/10 Ω | 20% duration | five half waves | Δ11° C. |
| two/20 Ω | 10% duration | five half waves | Δ 6° C. |

In the third embodiment, as shown in FIG. 4, while an example that the resistor 610 is disposed at the upstream side of the nip and the resistor 620 is disposed at the downstream side of the nip and only the upstream resistor is controlled under the wave number control and the downstream resistor is always turned ON or OFF was explained, the downstream resistor alone may be controlled under the wave number control and the upstream resistor may be always turned ON or OFF.

Further, it is not necessary that the resistance values of two heating resistors are the same, but, these values may differ from each other.

(Fourth Embodiment)

FIGS. 13A to 13J show further input voltage wave-forms. In this embodiment, the input voltage to the resistors as shown in FIGS. 8A to 8J are exchanged every cycle of the wave number control so that total currents flowing through the resistors becomes substantially the same.

That is to say, as shown in FIGS. 8A to 8J, when the upstream or downstream resistor is always turned ON or OFF, the amounts of currents flowing through the upstream and downstream resistors are changed in accordance with the current communication ratio of the heater, with the result that the heating distribution of the heater along the sheet conveying direction is also changed. Thus, even when the heater is controlled at the same temperature to output the same electric power, the current amounts of the upstream and downstream resistors are changed in dependence upon the magnitude of the power source voltage, with the result that the heating distribution is changed, thereby worsening the fixing ability. The embodiment shown in FIGS. 13A to 13J can eliminate such an inconvenience.

TABLE 7

(Control is effected by input voltage shown in FIGS. 8A to 8J)

| Power | Communication on 846 W output | | Heating Distri- | Fixing |
|---|---|---|---|---|
| Voltage | Resistor 610 | Resistor 620 | bution | Ability |
| 130 V | 0 W | 846 W | upstream temp. high downstream temp. low | bad |
| 92 V | 423 W | 423 W | same temp. in up/down | good |

TABLE 8

(Control is effected by input voltage shown in FIGS. 13A to 13J)

| Power | Communication on 846W output | | Heating Distri- | Fixing |
|---|---|---|---|---|
| Voltage | Resistor 610 | Resistor 620 | bution | Ability |
| 130 V | 423 W | 423 W | same temp. in up/down | good |
| 92 V | 423 W | 423 W | same temp. in up/down | good |

Further, according to the inventors' investigation, it was found that it is preferable that the difference in current between the upstream resistor and the downstream resistor becomes the same on the average until the recording sheet passes by the nip. This can be achieved by exchanging the input voltage wave-forms shown in FIGS. 8A to 8J within a half of the time period when the recording sheet is passed through the nip. In the embodiment shown in FIGS. 13A to 13J, the exchange time, i.e., the cycle of the wave number control is selected to become shorter than the nip passing time period. If the input voltage wave-forms are exchanged at a longer time period, due to the change in the heating distribution along the sheet conveying direction, fixing unevenness and glaze unevenness will occur on the recording sheet.

TABLE 9

| Input Voltage Exchange Time | Glaze Unevenness |
|---|---|
| 1.0 | good |
| 2.0 | average |
| 3.0 | bad |

(Input voltage exchange time is shown as 1.0 for a half of a nip passing time period)

Further, in FIGS. 14A to 14J, the input voltages of both resistors are exchanged alternately, unlike to the embodiment shown in FIGS. 8A to 8J in which one of the resistors is turned OFF in some cases. In the case shown in FIGS. 14A to 14J, the glaze unevenness is hard to occur in comparison with the case shown in FIGS. 13A to 13J. That is to say, in FIGS. 13A to 13J, since the average current difference between the resistors for two cycles is made to zero by exchanging the current communication pattern every cycle of the wave number control, the average current difference between the resistors in one cycle of the wave number control is great. For example, during the current communication of 50%, there is the current difference corresponding to five half waves. To the contrary, in FIGS. 14A to 14J, the current difference between the resistors within one cycle of the wave number control is suppressed to one half wave or less. In this way, since the current difference between the resistors for short time is small, even when a recording sheet conveying speed is fast and, thus, even when the nip passing time period is short, the glaze unevenness is hard to occur.

FIGS. 15A to 15E show total current wave-forms in the embodiments shown in FIGS. 8A to 8J, FIGS. 13A to 13J and FIGS. 14A to 14J. In this way, in the embodiments shown in FIGS. 8A to 8J, FIGS. 13A to 13J and FIGS. 14A to 14J, the total current wave-forms are the same, and the flicker level can be suppressed smaller.

(Fifth Embodiment)

In input voltage wave-forms shown in FIGS. 16A to 16D, the resistor 610 is phase-controlled, and the resistor 620 is controlled under the wave number control in which one cycle includes three half waves. During the output of 100 to 50%, the resistor 610 is controlled by the phase angle of 0° to 90°, and, during the output of 0° to 50%, the resistor 610 is controlled by the phase angle of 90° to 180°.

In this embodiment, the current communication phase angle of the resistor 610 can be made smaller in the output of 83 to 50%, and the harmonic wave current can also be made smaller (because, in general, the smaller the current communication phase angle the smaller the harmonic wave current), in comparison with the embodiment shown in FIGS. 2A and 2B. It should be noted that the harmonic wave current is smaller than that generated by the phase control using the single heater of 10 Ω and the flicker is less than that generated by the wave number control using the single heater of 10 Ω. Further, in comparison with the embodiment shown in FIGS. 8A to 8J, since the electric power can be changed continuously and the wave number control cycle of the resistor 620 is short, the control response is improved and the temperature ripple can be made smaller.

In FIGS. 16A to 16D, for example, as mentioned above, when the current communication patterns of the resistors 610, 620 are exchanged at three-half-wave duration corresponding to the wave number control cycle of the resistor 620, the temperature distribution of the heater is not changed in accordance with the output value, and therefore, the fixing ability is not changed due to the change in the power source voltage.

(Sixth Embodiment)

In an embodiment shown in FIGS. 17A to 17H, the wave number control at a cycle constituted by four half waves is effected, and only two half waves are phase-controlled with a phase angle of 0° to 90°. As the electric power is decreased, when the phase angle of the phase-controlled portion reaches 90°, one half wave which is not phase-controlled is turned OFF, thereby returning the phase angle of the phase-controlled portion to zero.

In comparison with the embodiment shown in FIGS. 16A to 16D, since the phase-controlled portion is smaller, the harmonic wave current is small. Further, in FIGS. 16A to 16D, the harmonic wave current is improved only within the output of 100 to 50% in comparison with FIGS. 2A and 2B. To the contrary, in the embodiment shown in FIGS. 17A to 17H, since the phase-controlled portion is smaller within a wide output range between 100% and 12.5%, the harmonic wave current becomes small.

(Seventh Embodiment)

In an embodiment shown in FIGS. 18A to 18H, the wave number control at a cycle constituted by four half waves is effected, and only one half wave is phase-controlled with a phase angle of 0° to 180°. Further, the current difference between the resistors is smaller than one half wave within the cycle of four half waves. As the electric power is decreased, when the phase angle of the phase-controlled portion reaches 180°, one half wave which is not phase-controlled is turned OFF, thereby returning the phase angle of the phase-controlled portion to zero.

In comparison with the embodiment shown in FIGS. 16A to 16D, since the phase-controlled portion is smaller, the harmonic wave current is small. Further, in FIGS. 16A to 16D, the harmonic wave current is improved only within the output of 100 to 50% in comparison with FIGS. 2A and 2B. To the contrary, in the embodiment shown in FIGS. 17A to 17H, since the phase-controlled portion is smaller within a wide output range between 100% and 12.5%, the harmonic wave current becomes small.

While an example that two resistors are used was explained, it should be noted that, even when three or more resistors are used in accordance with the present invention, the same advantage as the usage of two resistors can be achieved.

Next, the other embodiments of the present invention which can suppress the harmonic wave distortion will be explained.

(Eighth Embodiment)

Figures 20, 20A, 20B:
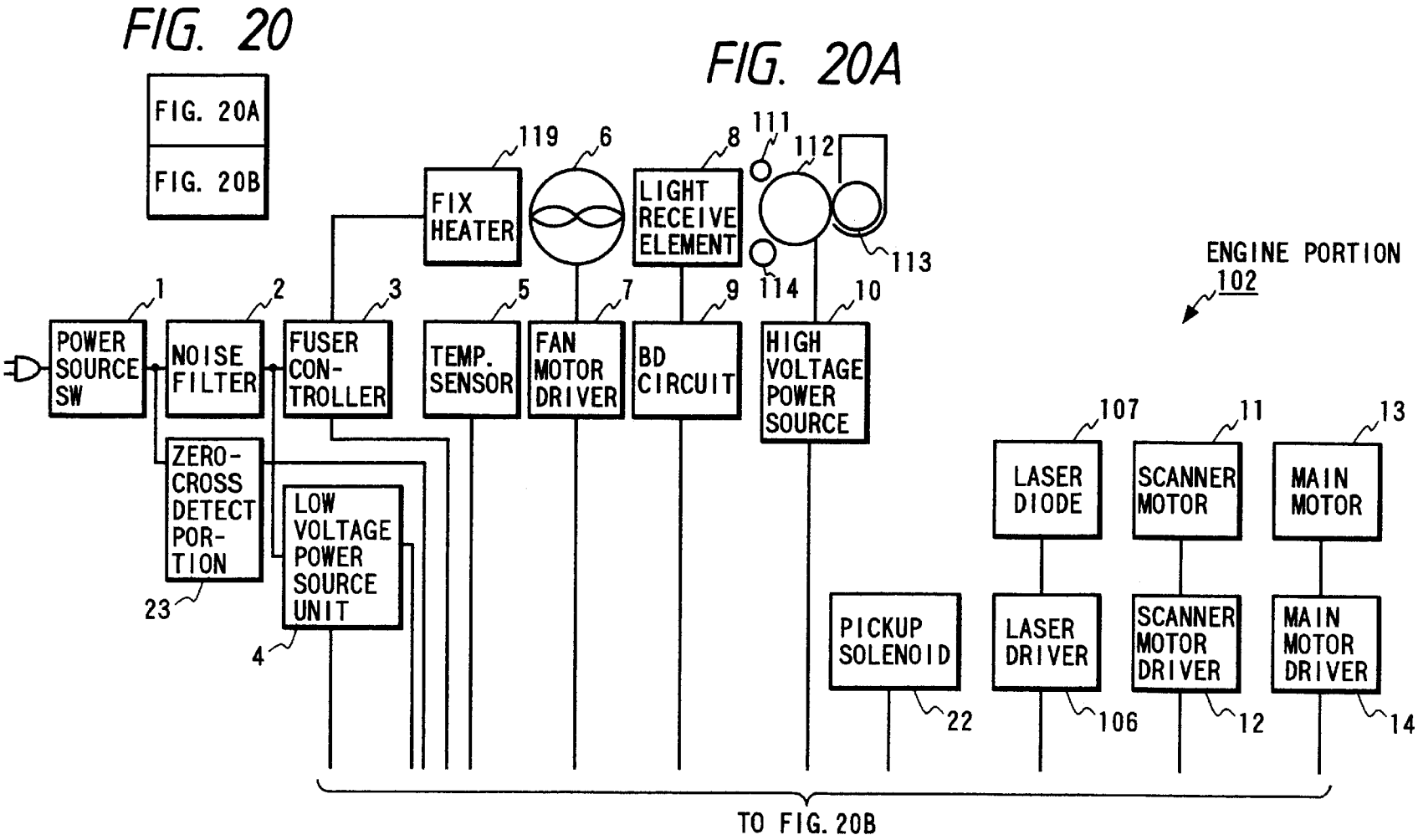
FIG. 20 is comprised of FIGS. 20A and 20B illustrating block diagrams showing electrical elements of a laser beam printer as an example of an image forming apparatus.
Figure 20B:
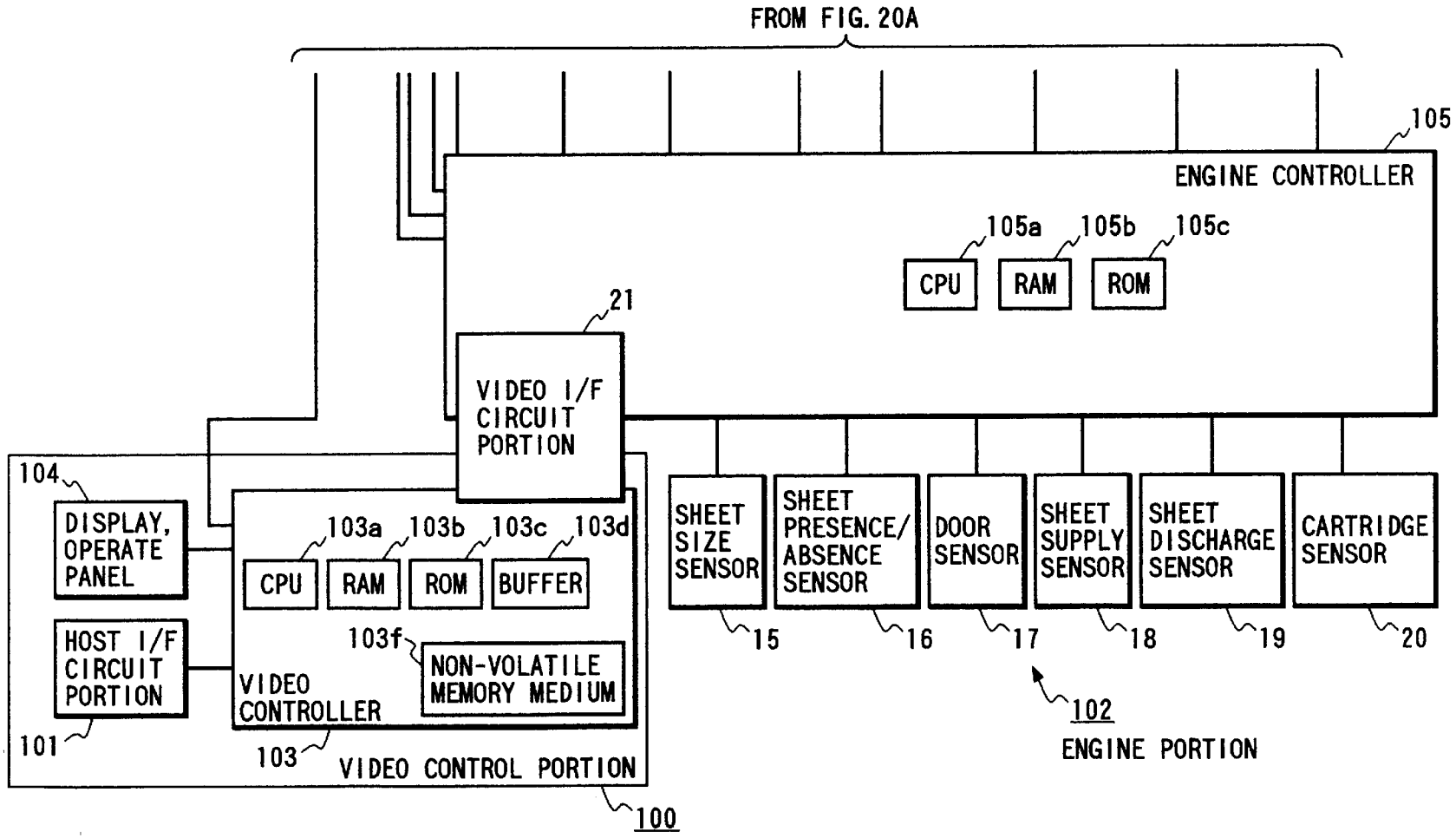
Figure 21:
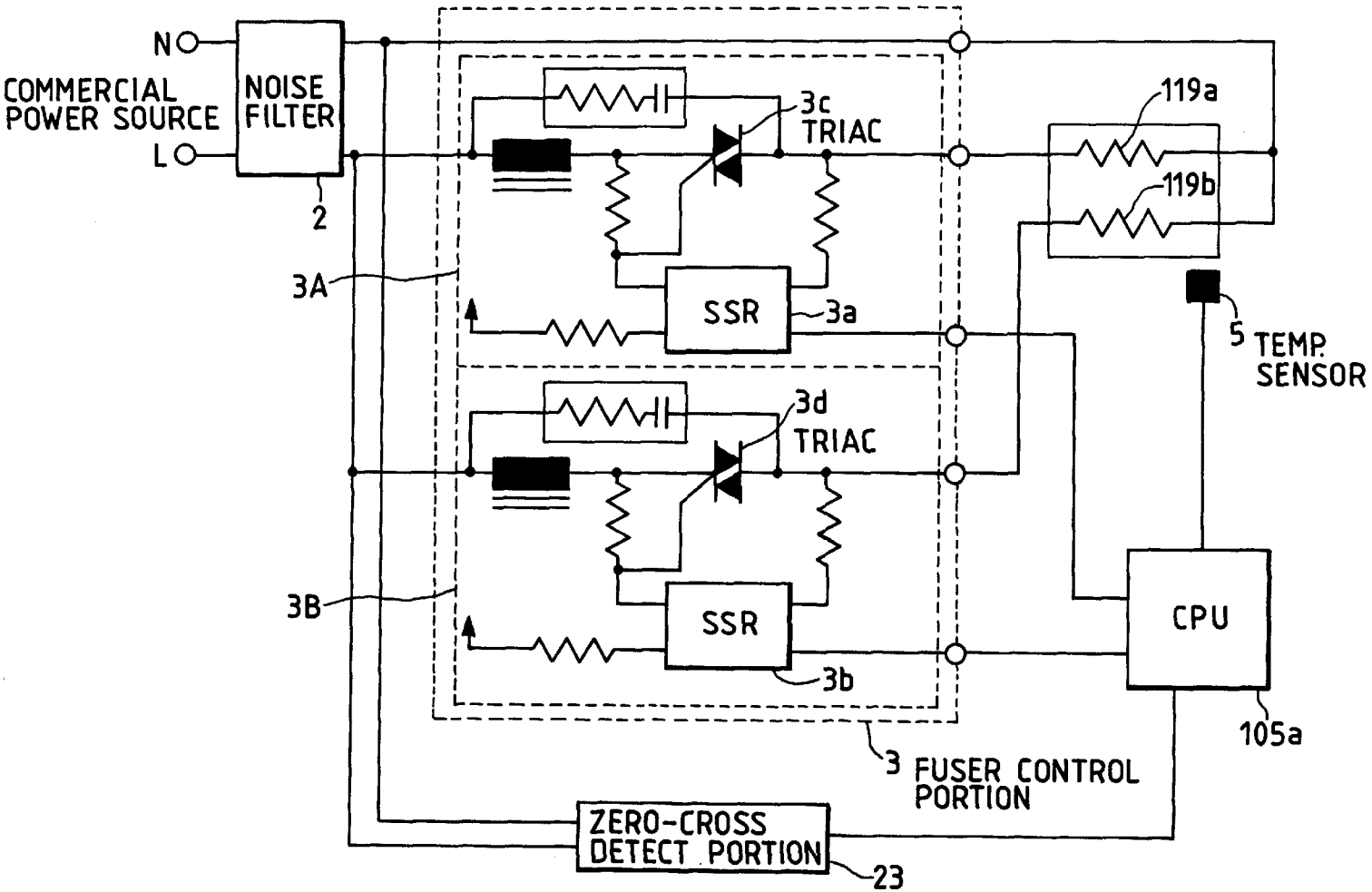
FIG. 21 is an electrical block diagram of a heater control portion, according to an eighth embodiment of the present invention.

FIGS. 20A and 20B are block diagrams showing electrical elements of a laser beam printer as an example of an image forming apparatus on which an image heating apparatus (fixing apparatus) is mounted, and FIG. 21 is an electrical circuit diagram of a heater control portion of the laser beam printer.

In FIGS. 20A and 20B, the reference numeral 1 denotes a power source switch for turning ON/OFF a power source of the image forming apparatus; 2 denotes a noise filter for reducing noise (generated by the image forming apparatus) so that the noise is not transferred to an AC line; and 3 denotes a fuser controller controlled by an engine controller 105. The fuser controller serves to detect a temperature of a fixing device for effecting thermal fixing via a temperature sensor 5 and to control current to a heating means (fix heater) 119 so that the temperature of the fixing device is kept constant. The engine controller 105 serves to control the entire image forming apparatus and includes a CPU 105 as a control means, a RAM 105*b* and a ROM 105*c*. A low voltage power source unit 4 for supplying low voltage is connected to the engine controller 105 and a video control portion 100. The fuser controller 3 and the CPU 105*a* constitute a current control means.

Incidentally, in FIGS. 20A and 20B, the reference numeral 7 denotes a fan motor driver (controlled by the engine controller 105) which serves to drive a fan motor 6; 9 denotes a BD circuit for emitting a horizontal synchronous signal in response to a signal from a light receiving element 8 (which receives laser light); 10 denotes a high voltage power source for supplying high voltage to a first charger 111 (for charging a photosensitive drum 112), a developing device 113 and a transfer roller 114; 22 denotes a pick-up solenoid; and 23 denotes a zero-cross detect portion for detecting a zero-cross detection range (from several volts above the zero-cross point of the power source voltage to several volts below the zero-cross point) and for outputting a zero-cross signal in accordance with the zero-cross detection range. The reference numeral 106 denotes a laser driver for driving a laser diode 107; 12 denotes a scanner motor driver for driving a scanner motor 11; 14 denotes a main motor driver for driving a main motor 13 to rotate the photosensitive drum (drum-shaped electrophotographic photosensitive image bearing member) 112; 15 denotes a sheet size sensor; 16 denotes a sheet presence/absence sensor; 17 denotes a door sensor; 18 denotes a sheet supply sensor; 19 denotes a sheet discharge sensor; 20 denotes a cartridge sensor; 21 denotes a video interface circuit portion for feeding a video signal from the control portion 100 to the laser driver 106 through the engine controller 105; and 23 denotes a zero-cross detect portion for detecting the zero-cross point of the power source voltage. A video controller 103 includes a CPU 103*a*, a RAM 103*b*, a ROM 103*c*, a buffer 103*d* and a non-volatile memory medium 103*e*.

Figure 22:
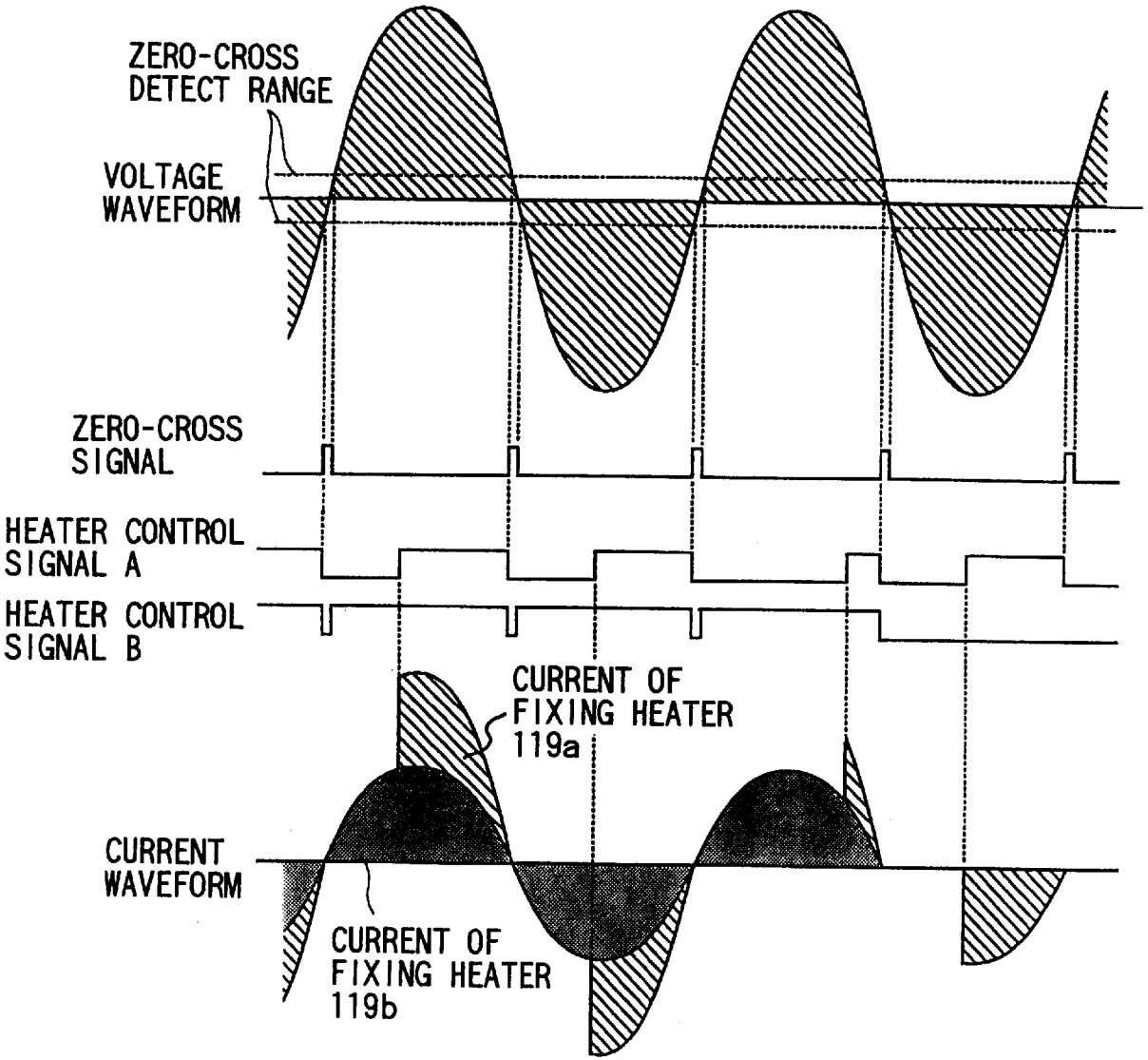
FIG. 22 is a timing chart in which current communication of a fixing heater is phase-controlled, according to the eighth embodiment.

Further, as shown in FIG. 21, the heater control portion includes the temperature sensor (temperature detecting means) for detecting temperatures of fixing heaters (heating resistors) 119*a*, 119*b* obtained by dividing the heating means. Currents supplied to the fixing heaters 119*a*, 119*b* are controlled by controlling timing for turning ON Triacs 3*c*, 3*d* (by means of the CPU 105*a*) via solid state relays (SSR) 3*a*, 3*b* on the basis of the temperatures detected by the temperature sensor 5. The fixing heaters 119*a*, 119*b* are interconnected in parallel, and the Triacs 3*c*, 3*d* for controlling the supplied current are connected to the fixing heaters 119*a*, 119*b*, respectively. In this case, resistance values of the fixing heaters 119*a*, 119*b* are both selected to 20 Ω. Further, the CPU 105*a* outputs heater control signals A, B as shown in FIG. 22 as signals for controlling the Triacs 3*c*, 3*d*. The fuser control controller 3 includes the solid state relays 3*a*, 3*b* and the Triacs 3*a*, 3*d*.

Figure 23A:
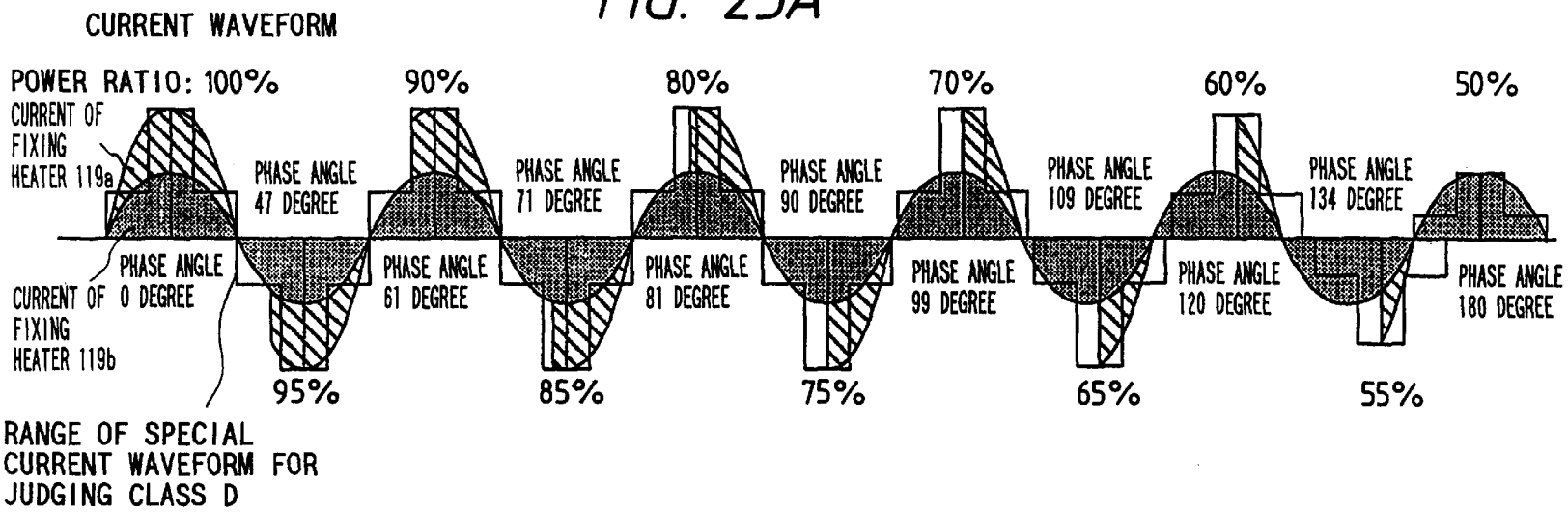
FIGS. 23A and 23B are views showing a relation between a current wave-form and an electric power ratio and a relation between a phase angle upon start of current communication and a special current wave-form range for Judging a class D of harmonic wave current, when phase control according to the present invention is effected.
Figure 23B:
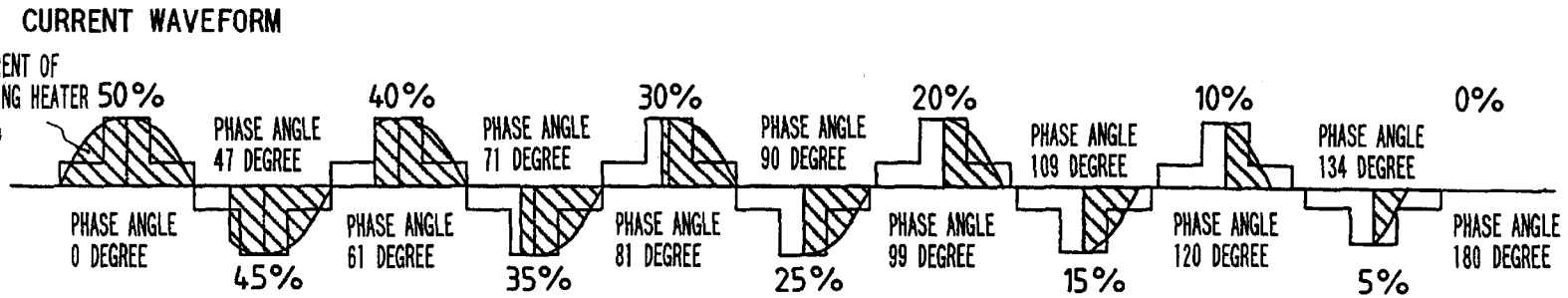

FIG. 22 shows a relation between a voltage wave-form of a commercial power source and a current wave-form of the heater. The zero-cross detect portion 23 detects the zero-cross detection range (from several volts above the zero-cross point of the power source voltage to several volts below the zero-cross point) and outputs the zero-cross signal in accordance with the zero-cross detection range. The CPU 105*a* calculates current amounts supplied to the fixing heaters 119*a*, 119*b* to set a fixing roller 117 to a predetermined surface temperature on the basis of temperature information detected by the temperature sensor 5 and outputs the heater control signals A, B on the basis of the calculated current amounts and the zero-cross signal. The Triacs 3*c*, 3*d* are triggered so that, when the heater control signals A, B are in H (high) level, the solid state relays 3*a*, 3*b* are operated to supply the current to the fixing heaters 119*a*, 119*b*. That is to say, the heater control signal A controls the Triac 3*c* via the solid state relay 3*a* to control the current supplied to the fixing heater 119*a*, and heater control signal B controls the Triac 3*d* via the solid state relay 3*b* to control the current supplied to the fixing heater 119*b*. As shown in FIGS. 23A and 23B, the current supplied to both fixing heaters 119*a*, 119*b* has a wave-form corresponding to the sum of the current supplied to the fixing heater 119*a* (phase control wave-form supplied from a certain phase angle in a sign wave) and the current supplied to the fixing heater 119*b*. Accordingly, the current supplied from the commercial power source to the image forming apparatus becomes the current wave-form supplied to both fixing heaters 119*a*, 119*b*. The current supplied to the fixing heater 119*a* is phase-controlled and the current supplied to the fixing heater 119*b* is controlled under ON/OFF-control in which it is determined whether the current is supplied or not every half wave.

FIGS. 23A and 23B are views showing a relation between the current wave-forms supplied to the fixing heaters and consumption electric power of the fixing heaters. In FIGS. 23A and 23B, there are shown relations between the current wave-forms and the phase angle and the special current wave-form range for judging class D when the consumption electric power of the fixing heater 119*a* is varied by every 5% (In order to explain the harmonic wave current and a rated value of the harmonic wave current generated by effecting the phase control, for the simplicity's sake, the fixing heater(s) of 20 Ω will be described).

Figure 24:
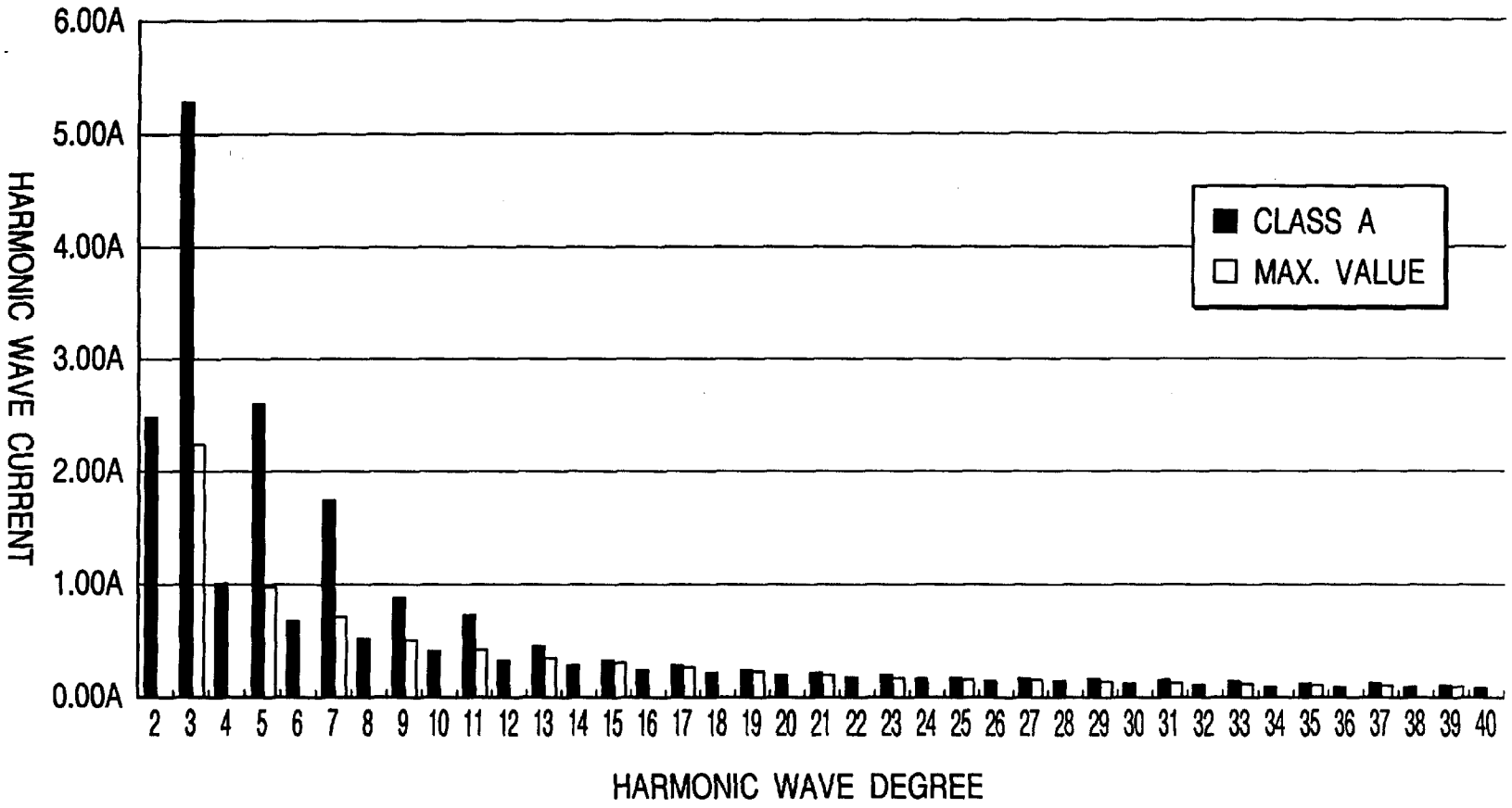
FIG. 24 is a view showing, for each harmonic wave degree, maximum allowable harmonic wave current class A in case of power source voltage of 100 V and maximum harmonic wave current when fixing heaters of 20 Ω are connected in parallel with phase control one of them.
Figure 34:
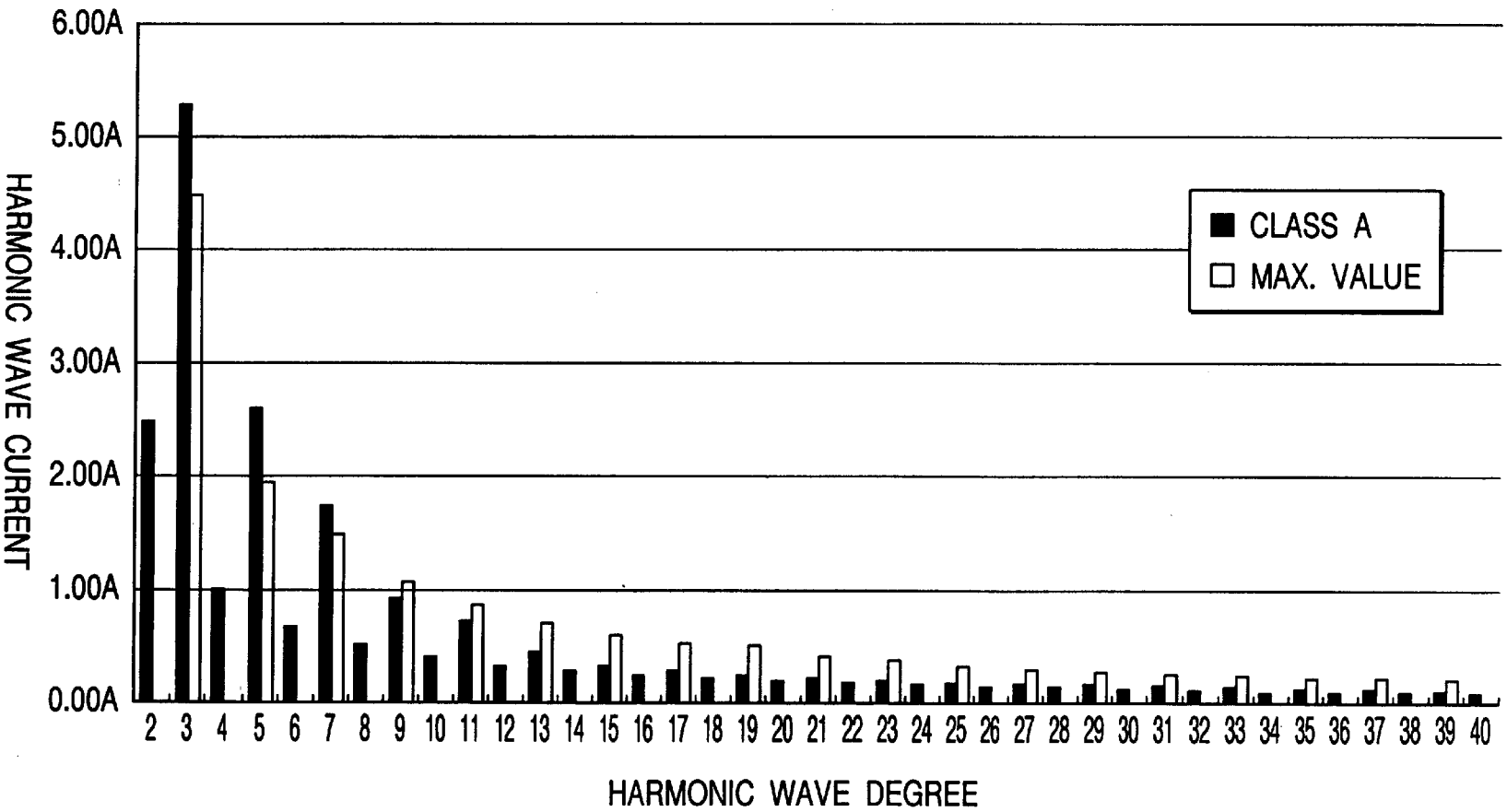
FIG. 34 is a view showing, for each harmonic wave degree, maximum allowable harmonic wave current class A in case of power source voltage of 100 V and maximum harmonic wave current when a fixing heater of 10 Ω are phase-controlled.

FIG. 24 is a graph showing a relation between a maximum value of the harmonic wave current and a maximum allowable harmonic wave current class A when the fixing heaters of 20 Ω are connected in parallel and one of the heaters is phase-controlled as shown in FIGS. 23A and 23B. Harmonic wave degrees indicate degrees of Fourier progression regarding a cycle amount of current, and, at the rating of the harmonic wave current, the class A is defined from 2 degree to 40 degree. As a reference, FIG. 34 shows a relation between the maximum harmonic wave current and the class A when a single heater of 10 Ω is phase-controlled. As shown in FIG. 34, the harmonic current having odd number degrees from 9 to 39 among the harmonic wave current flowing through the heater exceeds the class A.

Figure 25:
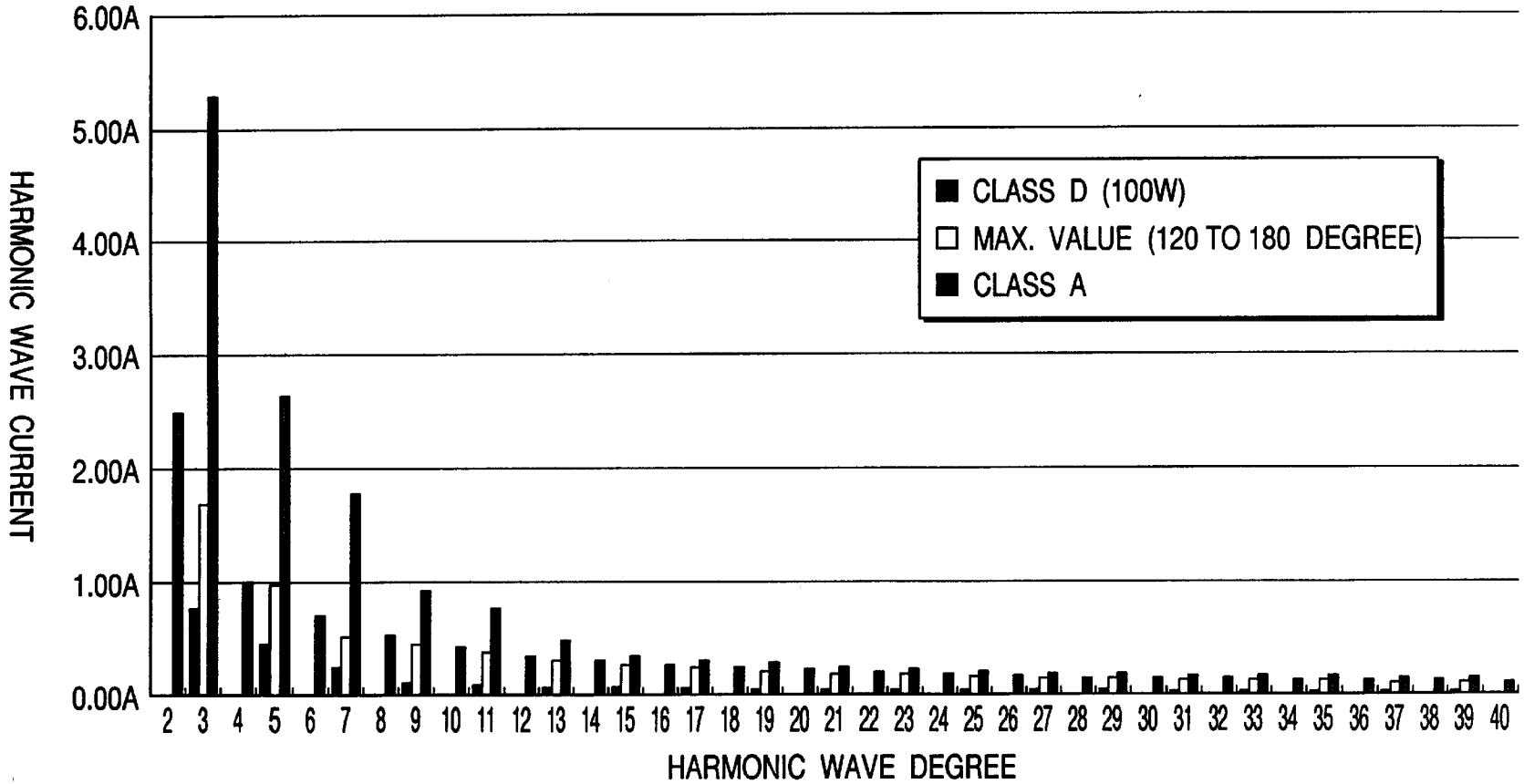
FIG. 25 is a view showing, for each harmonic wave degree, maximum allowable harmonic wave current class A in case of power source voltage of 100 V, and maximum harmonic wave current when a fixing heater of 20 Ω is phase-controlled at a temperature of 120° C. to 180° C, maximum allowable harmonic wave current class D in case of electric power of 100 W.

FIG. 25 is a graph showing a relation between the maximum allowable harmonic wave current class A and a class D below the electric power of 100 W when the currents of the fixing heaters are controlled as shown in FIGS. 23A and 23B. Regarding the class D, since the rated value thereof is changed in accordance with the consumption electric power in connection with the odd degrees from 3 to 39, the value at the electric power of 100 W is shown. When the fixing heaters are phase-controlled, since the magnitude of the harmonic wave current is varied with the phase, maximum values thereof at the phase angle (120° to 180°) below the electric power of 100 W are shown.

The phase angle of 120° when the current is supplied to only one of the fixing heaters of 20 a corresponds to 10% electric power at AC voltage of 100 V, as shown in FIGS. 23A and 23B. Accordingly, the electric power P(120) at the phase angle of 120° can be represented as follows:

$$P=(100\ V\times 100\ V)/\{20\ \Omega\times 20\ \Omega/(20\ \Omega+20\ \Omega)\}$$

$$=100\ V\times 100\ V/10\ \Omega$$

$$=1000\ (W)$$

$$P(120)=P\times 10\%=100\ (W)$$

Thus, this corresponds to the harmonic wave current flowing through the fixing heater at 100 W.

Figures 26A, 26B, 26C, 26D:
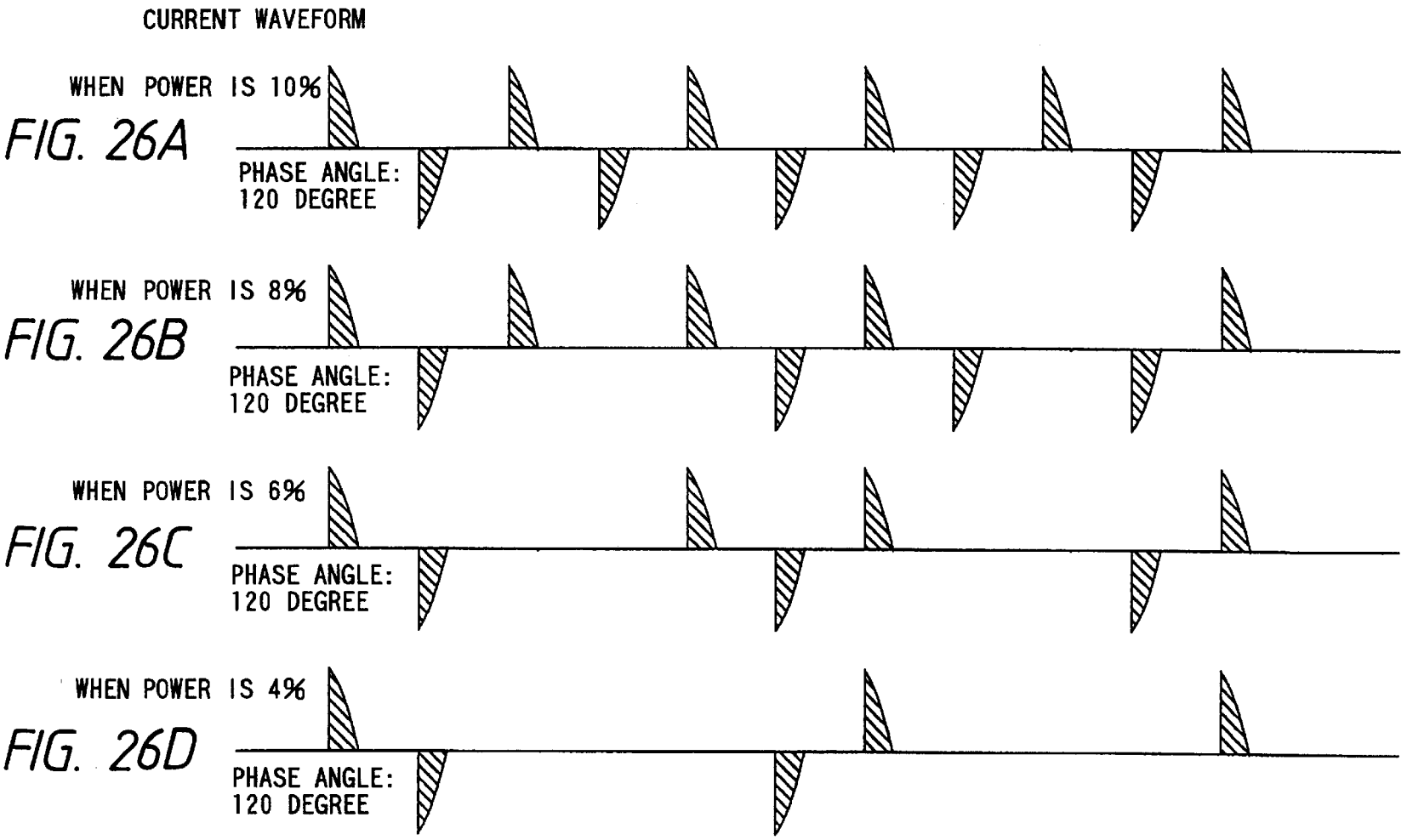
FIGS. 26A, 26B, 26C and 26D are timing charts of current waves supplied to a fixing heater having electric power of 10% or less, when the present invention is carried out.

As shown in FIGS. 23A and 23B, in comparison with the maximum allowable harmonic wave current class A and the maximum values of the harmonic wave current at all of the phase angles when one of the fixing heaters of 20 Ω connected in parallel is phase-controlled, since the harmonic wave current flowing through the fixing heater 119*a* is smaller than the maximum allowable harmonic wave current class A, the harmonic wave current flowing through the fixing heater 119*a* can clear the rated class A of the maximum allowable harmonic wave current. However, as shown in FIGS. 23A and 23B, among the harmonic wave current flowing through the fixing heater 119*a*, regarding the harmonic wave current at the phase angle greater than 120°, since the current wave-form of the fixing heater 119*a* is included within the special current wave-form range for judging the class D, in order to satisfy the rating of the class D, the current wave-form of the fixing heater 119*a* must be matched with the rating of the maximum allowable harmonic wave current class D. Accordingly, when the maximum allowable harmonic wave current class D at the consumption electric power of 100 W is compared with the harmonic wave current at the phase angle of 120°, since the harmonic wave current at the phase angle of 120° exceeds the maximum allowable harmonic wave current class D, the fixing heater cannot be controlled at the phase angle greater than 12°. Thus, in the illustrated embodiment, as shown in FIG. 26A, 26B, the fixing heater is temperature-controlled by flowing the current through the heater.

FIGS. 26A to 26D show methods for controlling the fixing heaters when the phase angle is smaller than 120° at the electric power of 100 W. In FIGS. 26A to 26D, at 10% electric power (100 W), the current at the phase angle of 12° in the 10% electric power is supplied to the fixing heaters. At 8% electric power (80 W), the current at the phase angle of 120° in the 10% electric power is supplied to the fixing heaters, and ⅕ of the current is not supplied to the fixing heaters. As a result, when considered as the electric power in the cycle of five half waves, the electric power of 8% is regarded as being supplied to the heaters. Similarly, at 6% electric power (60 W), ⅖ of the current is not supplied to the fixing heaters, and at 4% electric power (40 W), ⅗ of the current is not supplied to the fixing heaters (However, nowadays, the electric power lower than 75 W is not regulated). Further, in order to prevent inclination or offset of the current flowing direction, current flow in a normal direction and current flow in a reverse direction are balanced.

(Ninth Embodiment)

Figure 27:
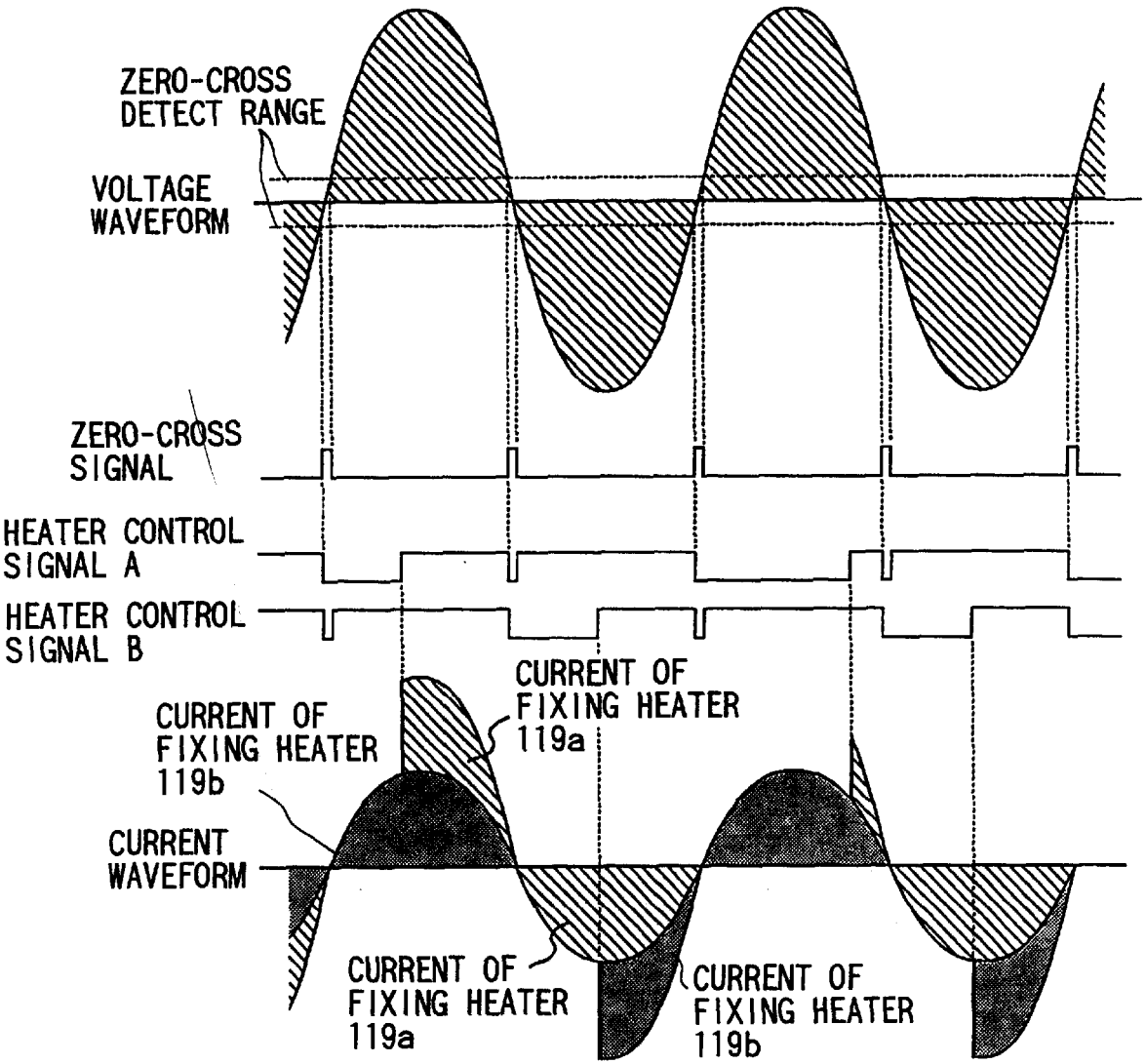
FIG. 27 is a timing chart in which current communication of a fixing heater is phase-controlled and the current supplied to the fixing heater is inverted every half cycle, according to a ninth embodiment of the present invention.

In the eighth embodiment, while an example that the phase control is effected by the heater control circuit (current control means) 3A having the solid state relay 3*a* and the Triac 3*c* and the ON/OFF control is effected by the heater control circuit (current control means) 3B having the solid state relay 3*b* and the Triac 3*d* was explained. To the contrary, in a ninth embodiment of the present invention, as shown in FIG. 27, the currents supplied to the fixing heater 119*a* and the fixing heater 119*b* are controlled by switching the current every half wave by means of the CPU 105*a* by using the heater control portion shown in FIG. 21. As a result, heating amounts of the fixing heaters 119*a*, 119*b* can be averaged or uniformed.

Incidentally, in order to prevent inclination or offset of the current flowing through the Triacs 3*c*, 3*d*, the currents supplied to the fixing heaters 119*a*, 119*b* may be switched every cycle.

(Tenth Embodiment)

Figure 28:
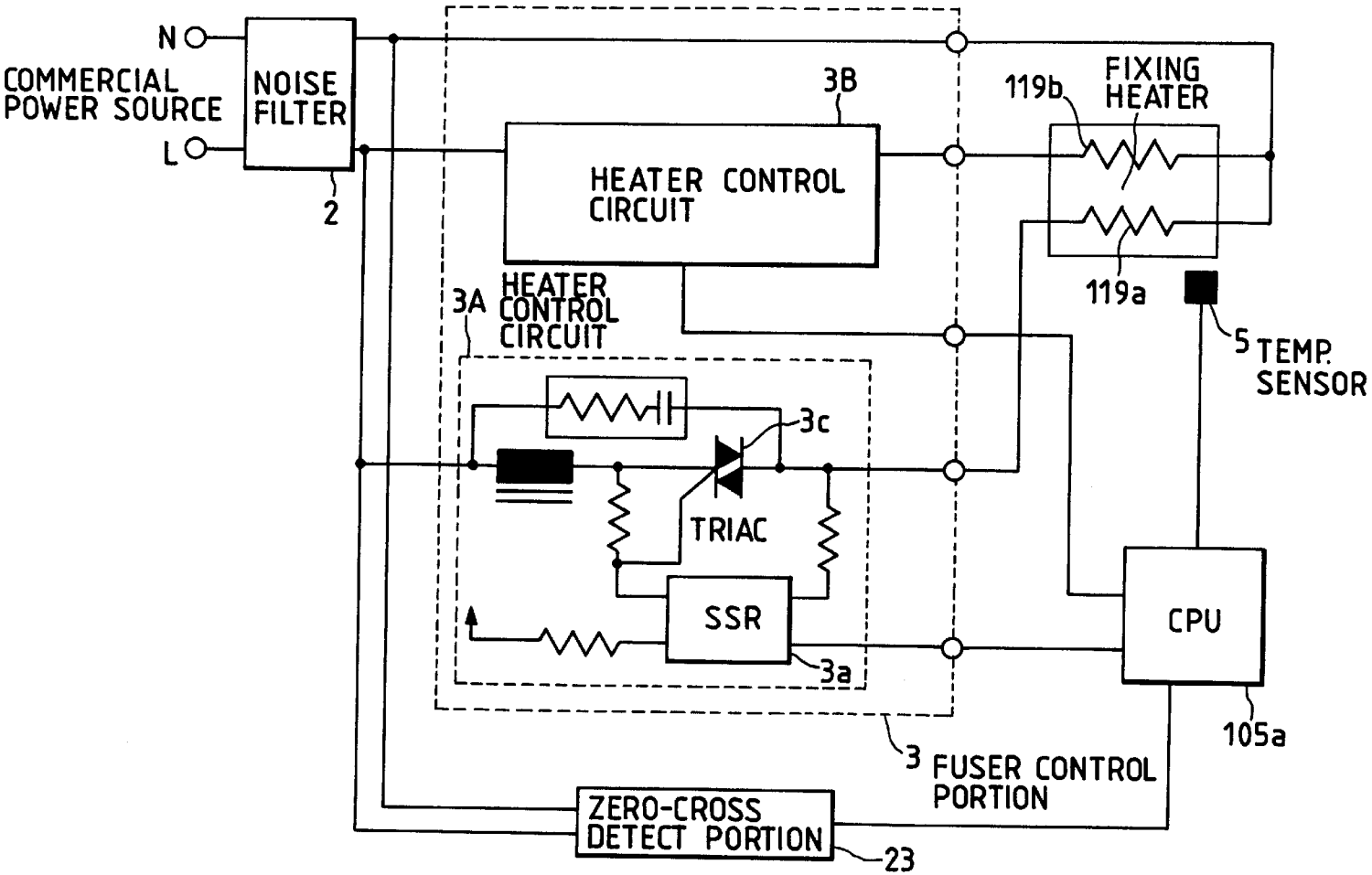
FIG. 28 is an electrical block diagram of a heater control portion, according to a tenth embodiment of the present invention.

FIG. 28 is a circuit diagram of a fuser controller according to a tenth embodiment of the present invention. In order to simplify explanation, the resistance value of the fixing heater 119*a* and the resistance value of the fixing heater 119*b* are set to become 1:2. For example, the resistance value of the fixing heater 119*a* is selected to 10 Ω and the resistance value of the fixing heater 119*b* is selected to 20 Ω. In the heater control circuit 3B, for example, a transistor or a MOSFET is used as a switching element, and, in the heater control circuit 3A, the Triac is used as a switching element. With this arrangement, since the heater control circuit 3B utilizes the transistor or the MOSFET, the current can be turned OFF below the zero-cross point of the voltage, and, since the heater control circuit 3A utilizes the Triac, the current cannot be turned OFF at the zero-cross point of the voltage.

Figure 29:
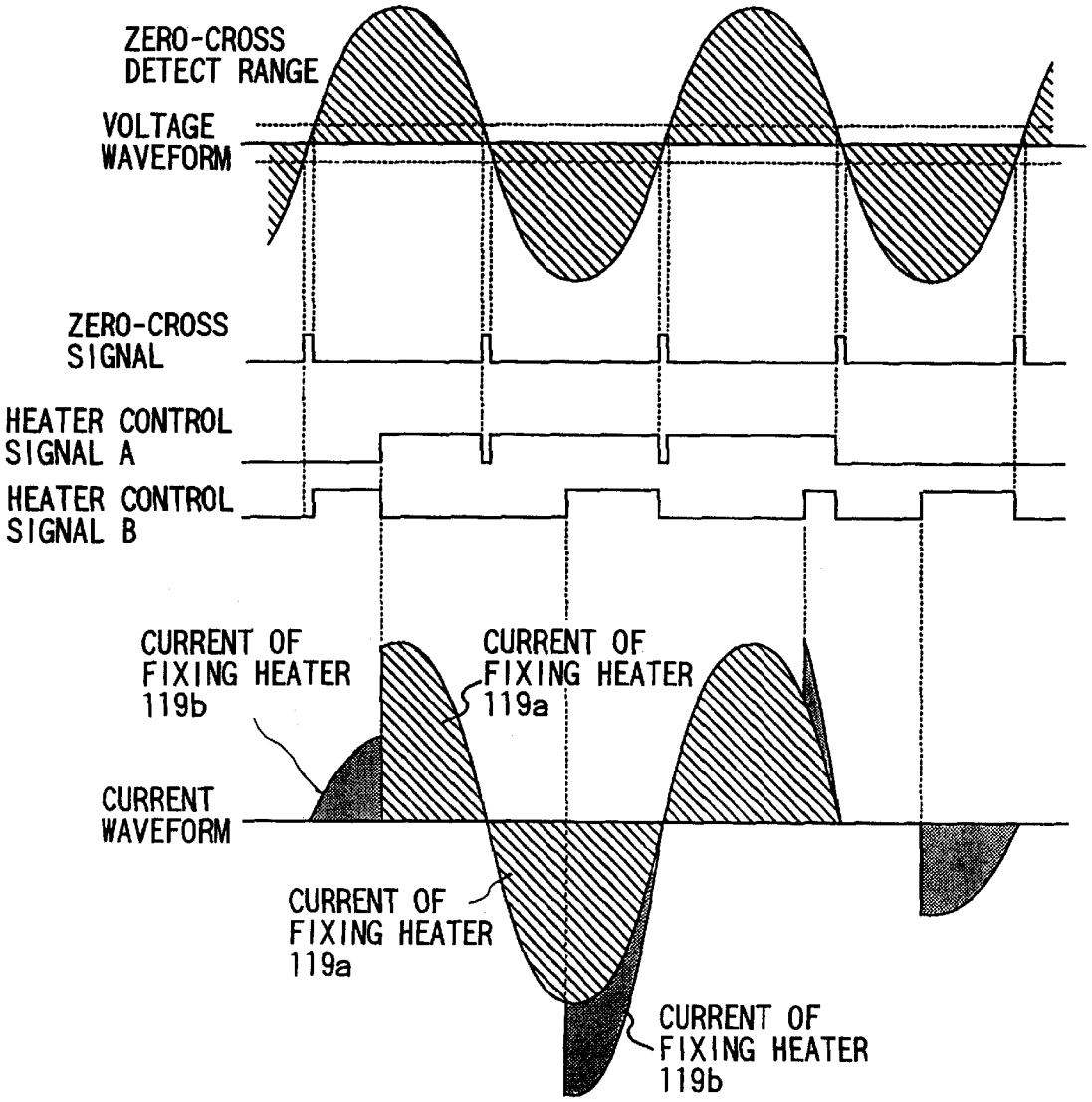
FIG. 29 is a timing chart in which current communication of a fixing heater is phase-controlled, according to the tenth embodiment.

FIG. 29 shows voltage, heater control signals A, B, current wave-form and zero-cross signal when the circuit shown in FIG. 28 is used. Explaining the current control according to the tenth embodiment with reference to FIG. 29, after the zero-cross signal becomes H (high) level, the heater control signal B is turned ON, thereby supplying the current to the fixing heater 119*b*. Then, at the same time when the heater control signal A is turned ON, the heater control signal is turned OFF. The heater control signal A continues to be maintained to an ON condition until the zero-cross signal becomes the H level. In the next half wave, at the same time when the zero-cross signal becomes the H level, the heater control signal A is turned ON, thereby supplying the current to the fixing heater 119*a* too. Thereafter, when the zero-cross signal becomes the H level, both current control signals A, B are turned OFF. In the next half wave, the same sequence is repeated, but, the timing for turning ON the current control signal (B) differs from the former half wave. That is to say, in the latter half wave, when the zero-cross signal becomes the H level, the heater control signals A, B start from the OFF condition, and, the heater control signal B is turned ON on the way, and, then, when the next zero-cross signal becomes the H level, the heater control signal B is turned OFF.

Summarizing the control methods in the eighth to tenth embodiments, the current supply sequences to the fixing heaters 119*a*, 119*b* can be divided into three patterns, i.e., a pattern in which the fixing heater 119*b* alone is phase-controlled, a pattern in which the fixing heater 119*b* is phase-controlled while turning ON the fixing heater 119*a* from a zero-cross point to a next zero-cross point, and a pattern in which the fixing heater 119*b* is turned ON from the zero-cross point and, at the same time when the fixing heater 119*b* is turned OFF on the way, the fixing heater is turned ON, thereby effecting the phase control.

Figure 30:
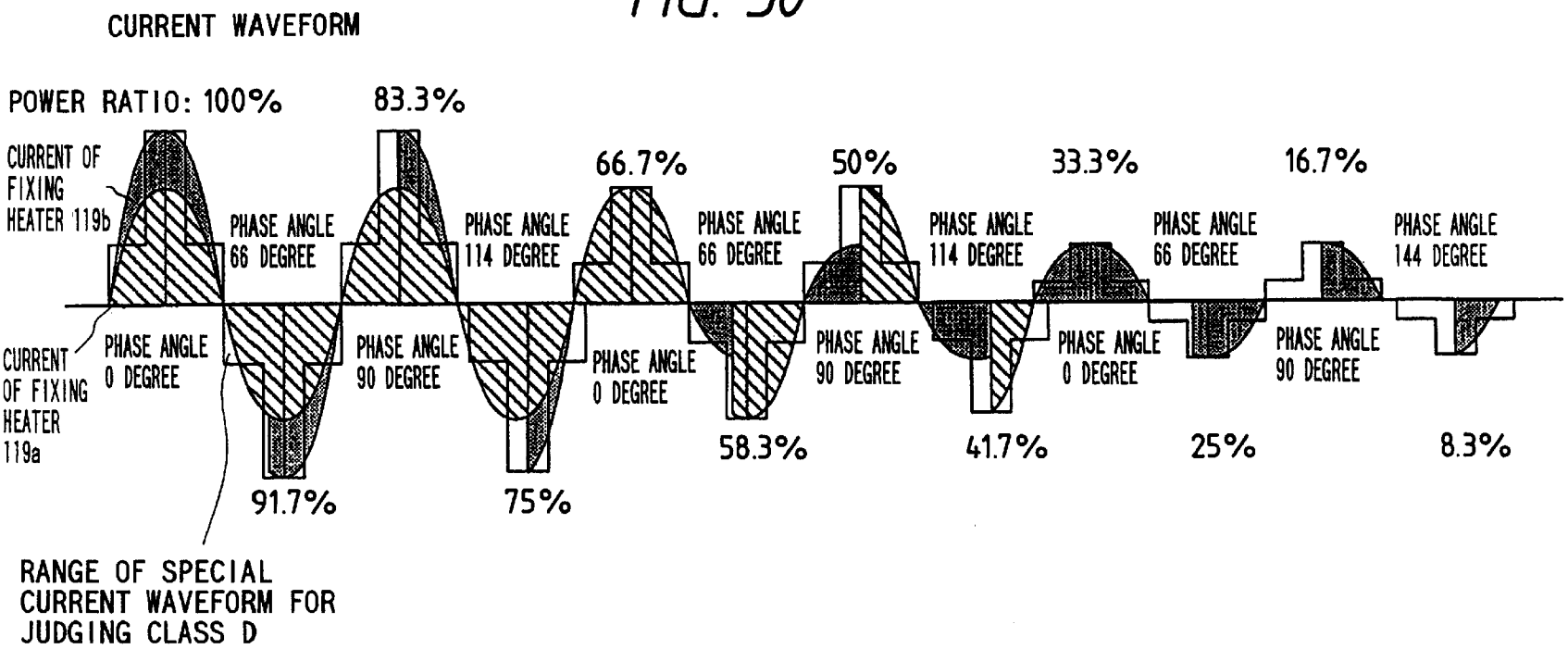
FIG. 30 is a view showing a relation between a current wave-form and an electric power ratio and a relation between a phase angle upon start of current communication and a special current wave-form range for judging a class D of harmonic wave current, when phase control according to the present invention is effected, according to the tenth embodiment.

FIG. 30 shows a relation between wave-forms of the fixing heaters, power ratios of respective current waves and special current wave-form ranges for judging the harmonic wave current class D.

As mentioned above, by controlling the currents supplied to the fixing heaters, the change in current generated when the current is turned ON in the phase control can be reduced to ⅓ of the current change generated when the single fixing heater is phase-controlled. Accordingly, when the resistance value of the fixing heater 119*a* is set to 10 Ω and the resistance value of the fixing heater 119*b* is set to 20 Ω, since the harmonic wave current becomes the same as the harmonic wave current in the eighth embodiment wherein the fixing heaters 119*a*, 119*b* of 20 Ω are connected in parallel, the value of the harmonic wave current can be suppressed within the rating of the maximum allowable harmonic wave current class A as shown in FIGS. 23A and 23B. In the eighth embodiment, since two fixing heaters of 20 Ω are connected in parallel, while an example that the electric power of 1000 W is controlled when the input voltage is 100 V was explained, in the illustrated embodiment, since the resistance values of the fixing heaters connected in parallel are 10 Ω and 20 Ω, respectively, the electric power of 1500 W can be controlled by the same harmonic wave current.

When the fixing heater 119*b* is phase-controlled in a condition that the fixing heater 119*a* is turned OFF, as is in the eighth embodiment, at the phase angle of 102° to 180°, since the current is included within the rating of the class D, the current at the phase angle of 12° is ON/OFF-controlled every half wave. In the illustrated embodiment, since the power ratio when the fixing heater 119*b* alone is turned ON at the phase angle of 12° becomes 6.7%, the phase angle of 12° to 180° may be unused.

Incidentally, in the illustrated embodiment, while an example that the ratio between the resistance values of the fixing heaters is set to 1:2 was explained, the present invention is not limited to such a ratio 1:2, but, other ratio can be used. Further, in the tenth embodiment, while an example that two fixing heaters are used was explained, by increasing the number of fixing heaters connected in parallel and the number of heater control circuits, the harmonic wave current can be decreased.

(Eleventh Embodiment)

Figure 31:
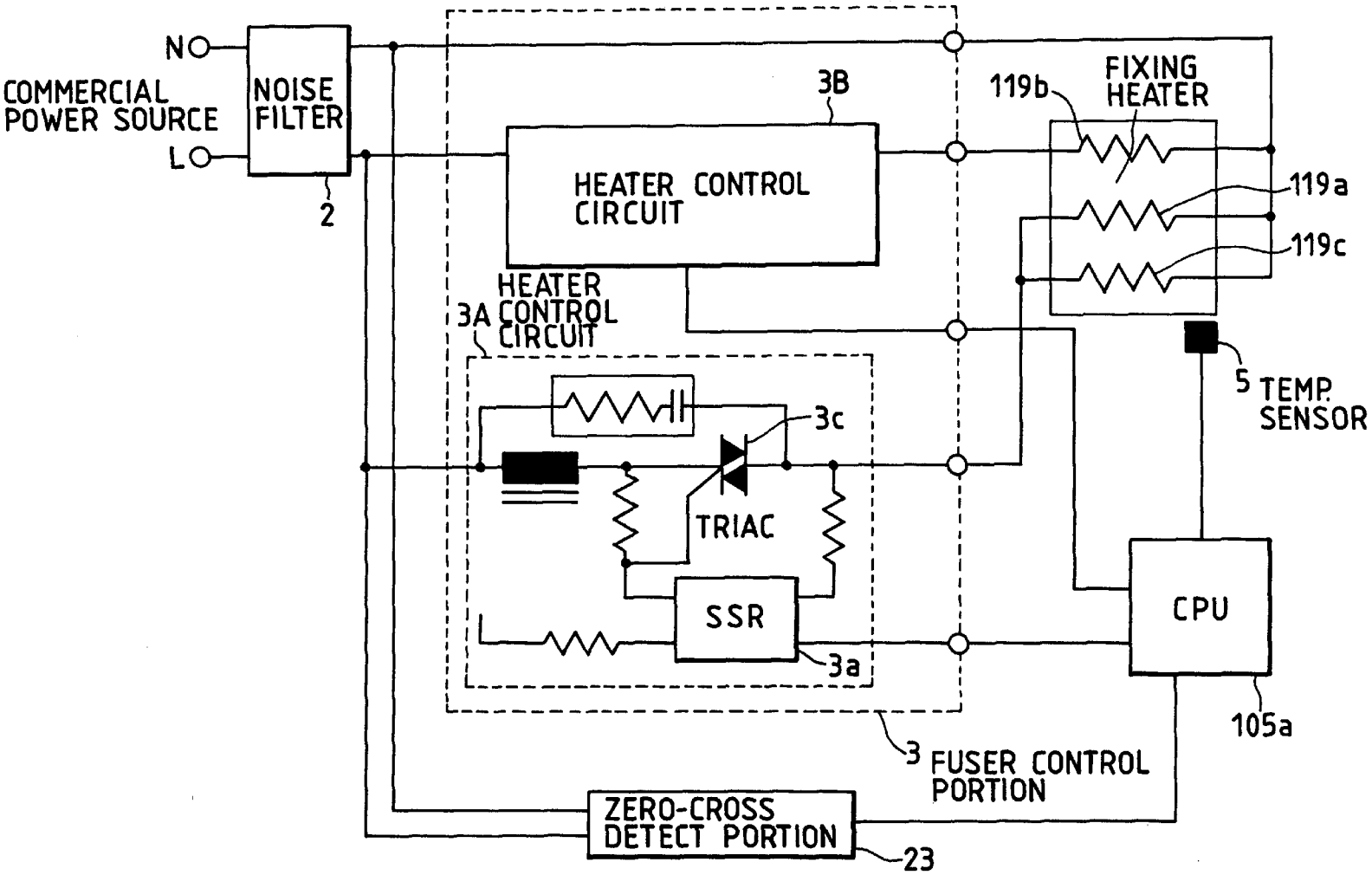
FIG. 31 is an electrical block diagram of a heater control portion, according to an eleventh embodiment of the present invention.

In the tenth embodiment, while an example that the ratio between the resistance values of the fixing heaters is set to 1:2 was explained, as shown in FIG. 31, fixing heaters 119*a*, 119*b* and 119*c* having the same resistance value may be connected in parallel so that the resistance ratio between the fixing heater 119*b* and the fixing heaters 119*a*, 119*c* becomes 1:2, and the fixing heater 119*b* may be controlled by the heater control circuit 3B and the fixing heaters 119*a*, 119*c* may be controlled by the heater control circuit 3A. Incidentally, the current control in this case can be effected in the same manner as the tenth embodiment.

(Twelfth Embodiment)

In the tenth embodiment, an example that the control is effected by using two heater control circuits 3A, 3B and two fixing heaters 119*a*, 119*b* was explained. To the contrary, in a twelfth embodiment of the present invention, as shown in FIG. 32, a heater control circuit 3H is connected to a fixing heater 119*h*, and there is provided a current control circuit (current control means) 123 for controlling current supplied to a resistor (heating element) 122 other than the fixing heater.

Figure 32:
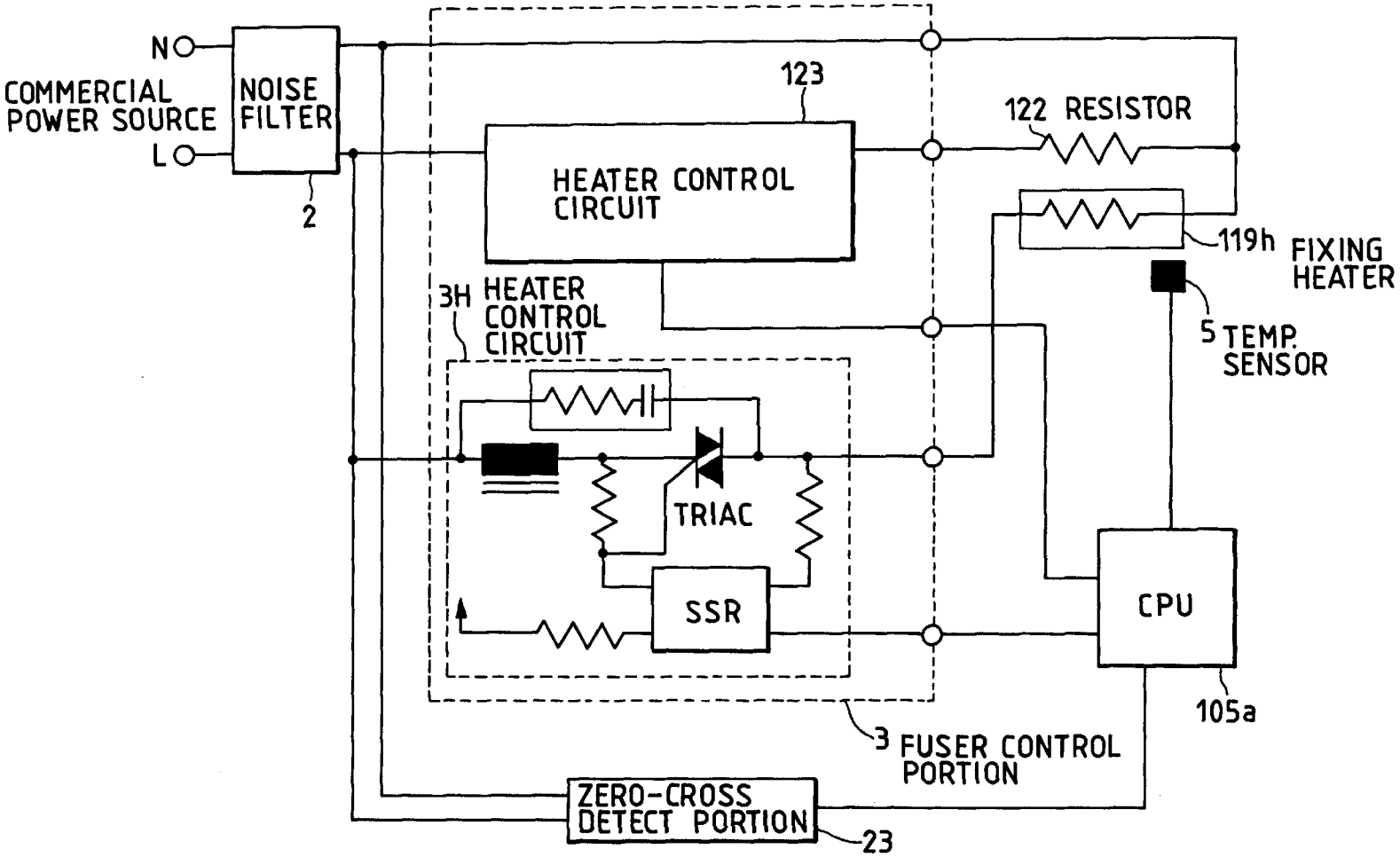
FIG. 32 is an electrical block diagram of a heater control portion, according to a twelfth embodiment of the present invention.
Figure 33:
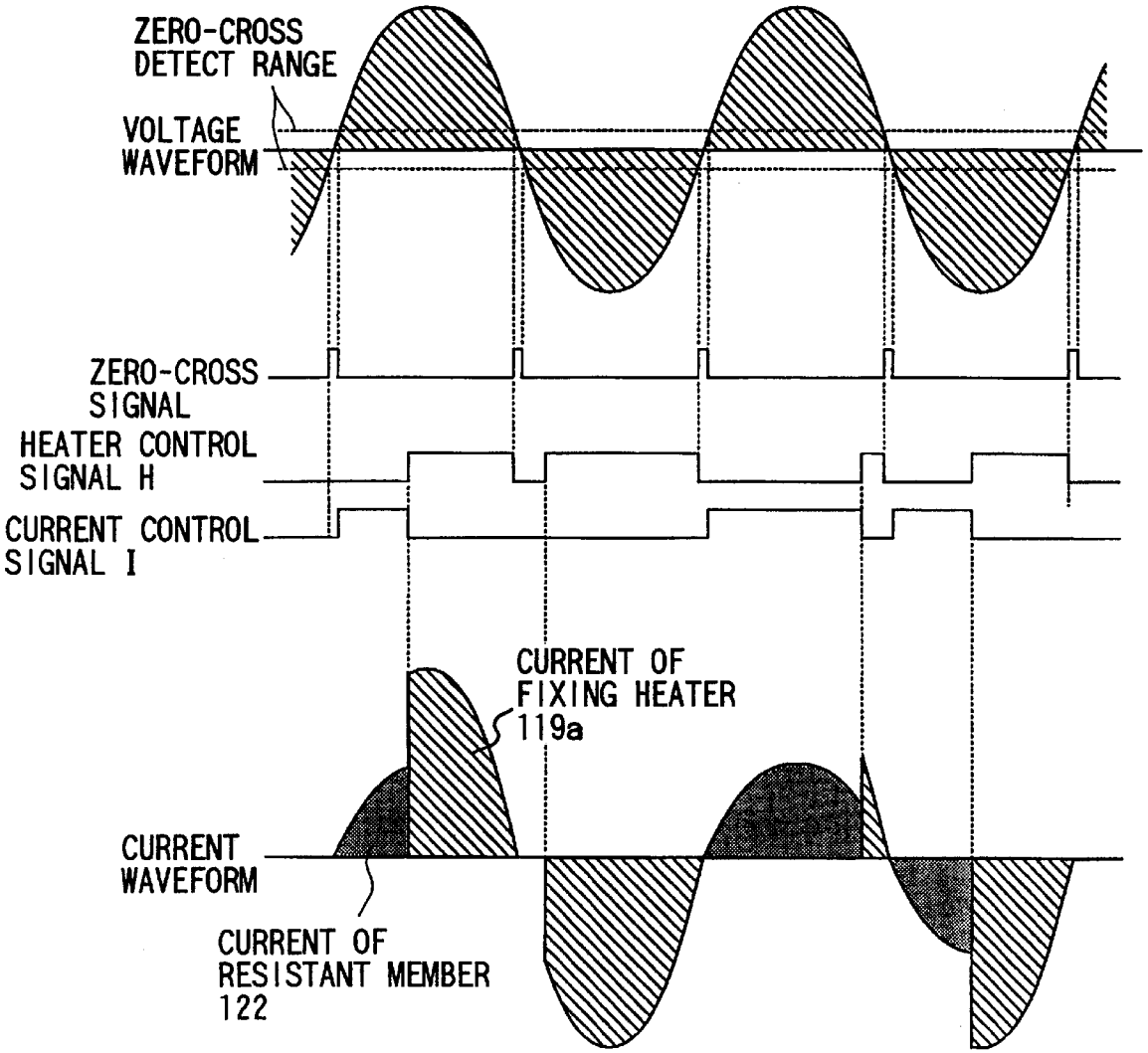
FIG. 33 is a timing chart in which current communication of a fixing heater is phase-controlled, according to the twelfth embodiment.

FIG. 33 is a timing chart for controlling current supplied to the fixing heater 119*h* and the current supplied to the resistor 122 by using the circuit shown in FIG. 32. In FIG. 33, the voltage wave-forms are voltage wave-forms of a commercial power source, and the zero-cross signal is a signal generated near zero voltage, which signal is inputted to the CPU 105*a*. A heater control signal H and a current control signal I are outputted from the CPU 105*a* and are inputted to the heater control circuit 3H and the current control circuit 123, respectively. The heater control circuit 3H serves to control the current supplied to the fixing heater 119*h* when the heater control signal is H (high) level. The current control circuit 123 serves to control the current supplied to the resistor 122 when the current control signal I is H level. In the illustrated embodiment, for simplicity's sake, it is assumed that a resistance value of the fixing heater 119*h* is set to 10 Ω and a resistance value of the resistor 122 is set to 20 Ω so that a ratio between the resistance values of the heater 119*h* and the resistor 122 becomes 1:2.

Explaining a control method with reference to the timing chart shown in FIG. 33, when the zero-cross signal becomes H level, the CPU 105*a* turns ON the current control signal I to supply sign current (as current wave-form) to the resistor 122. Then, the CPU 105*a* turns ON the heater control signal H to supply the current to the fixing heater 119*h* at a certain phase angle. At the same time, the current control signal I is turned OFF. In the current wave-form, the current of the resistor 122 is turned OFF and the current of the fixing heater 119*h* is turned ON. In the illustrated embodiment, an amplitude of the current flowing through the fixing heater 119*h* becomes twice as that of the current flowing through the resistor 122. In the next half wave, only the heater control signal H is turned ON at a certain phase angle (the current control signal I is not turned ON). The reason is that in said next half wave and a further next half wave, although the sequence is the same as the previously explained sequence, the phase angles at which the fixing heater 119*h* is turned ON are different from each other.

In order to reduce the harmonic wave current generated due to the change in current in the current rising-up of the fixing heater 119*h*, since the change in the rising current becomes maximum at the phase angle of 90°, the current is supplied to the resistor 122 to reduce such change to ½. At the phase angles of 30° and 150° in the phase control, the change in the rising current becomes ½ of the change at the phase angle of 90°. Thus, at the phase angle of 0° to 30°, there is no need to supply the current to the resistor 122. However, at the phase angle of 150° to 180°, if the current is supplied to the fixing heater 119*h* alone, since the harmonic wave current generated in the fixing heater 119*h* is included in the class D, the harmonic wave current in the fixing heater 119*h* becomes greater than the maximum allowable harmonic wave current of the class D. Accordingly, by also supplying the current to the resistor 122, the harmonic wave current is controlled not to be included in the harmonic wave current class D. (In the illustrated embodiment, since the resistance value of the fixing heater 119*h* is set to 10 Ω, the consumption electric power at the phase angle of 50° or more becomes 5% or less, and, at the voltage of 100 V, since the electric power is smaller than 50 W, the electric power having the harmonic wave current rating class D below 75 W is not regulated. Accordingly, it is possible to phase-control the fixing heater 119*h* alone without supplying the current to the resistor 122.)

Next, other embodiments for suppressing the flicker will be explained. Incidentally, since the electric circuit of the heater control portion is the same as the block diagram shown in FIG. 21, explanation thereof will be omitted. However, the ratio between the resistance values of the heaters 119*a* and 119*b* is set to 2:1.

(Thirteenth Embodiment)

Figure 35:
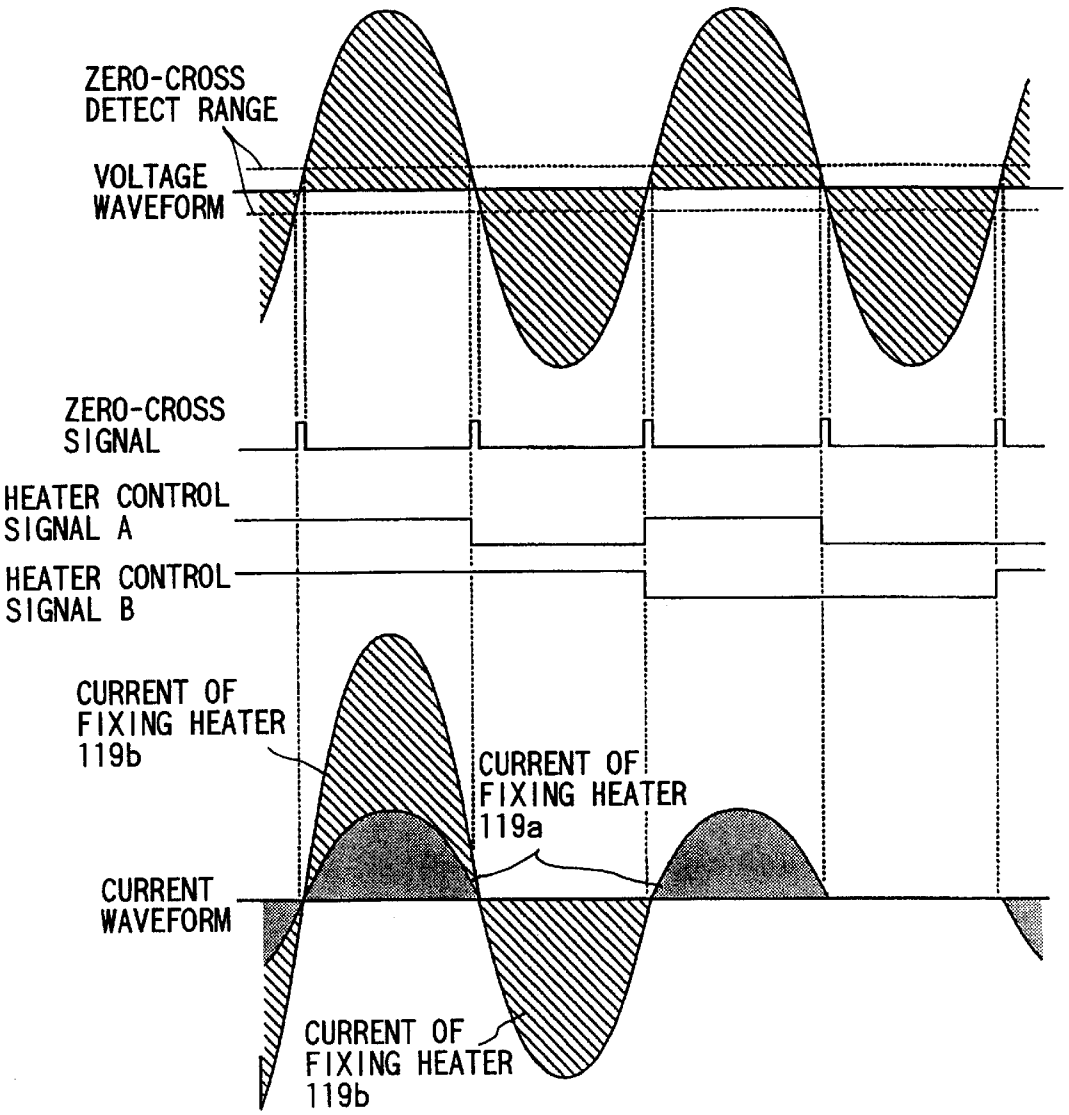
FIG. 35 is a timing chart in which current communication of a fixing heater of an image forming apparatus is controlled under wave number control, according to the present invention.
Figure 36A:
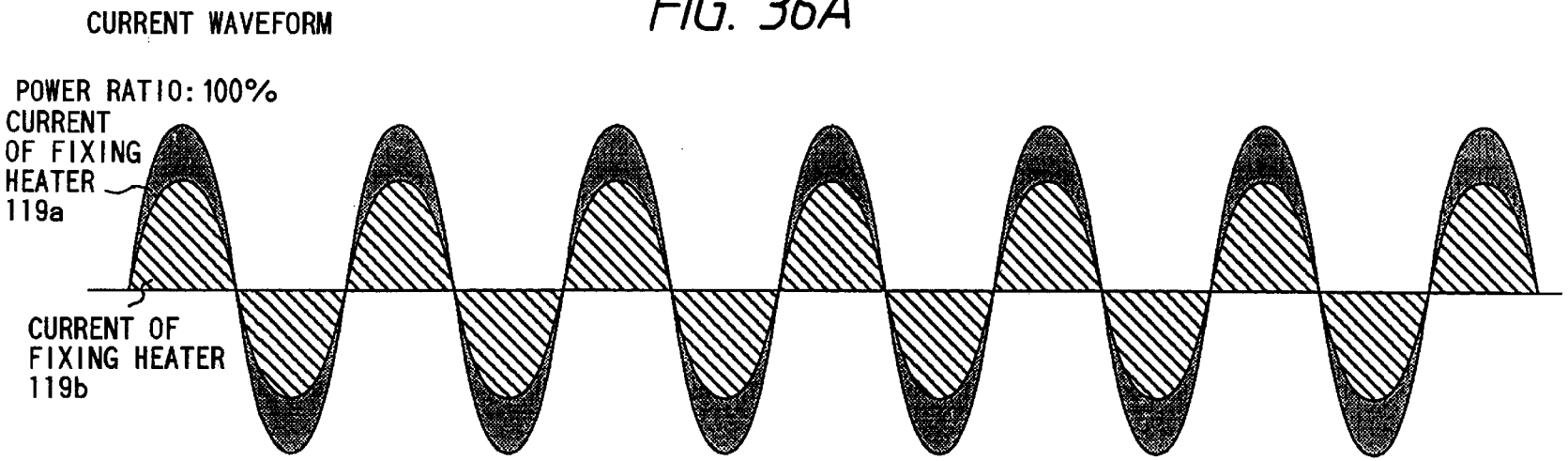
FIGS. 36A and 36B are views showing a relation between a current wave-form and an electric power ratio when the wave number control is effected, according to a thirteenth embodiment of the present invention, where
Figure 36B:
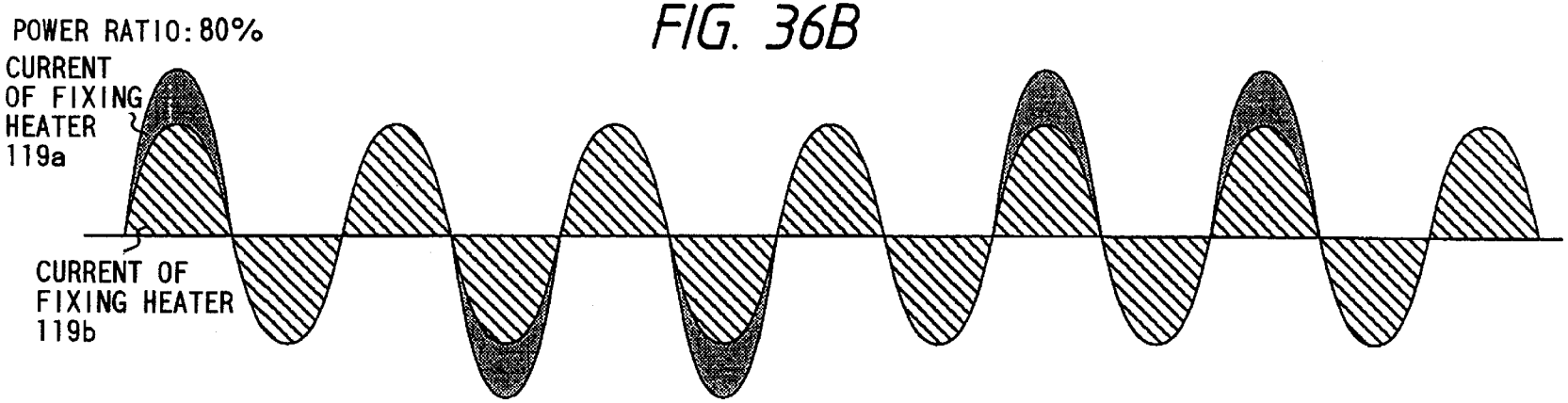

FIG. 35 shows a relation between a voltage wave-form of a commercial power source and current wave-forms of the heaters, according to a thirteenth embodiment of the present invention.

The zero-cross detect portion 23 detects the zero-cross detection range (from several volts above the zero-cross point to several volts below the zero-cross point) and outputs the zero-cross signal in accordance with the zero-cross detection range. The CPU 105*a* calculates the current amounts supplied to the fixing heaters 119*a*, 119*b* to bring the temperature of the fixing roller 117 to a predetermined surface temperature on the basis of the temperature information from the temperature sensor 5 and outputs heater control signals (for wave number control) A, B on the basis of the calculated current amounts and the zero-cross signal. On the basis of the H level heater control signal outputted from the CPU 105*a*, the fuser controller 3 drives the solid state relays 3*a*, 3*b* to trigger the Triacs 3*c*, 3*d*, thereby supplying the current to the fixing heaters 119*a*, 119*b*. The heater control signal A controls the Triac 3*c* to control the current supplied to the fixing heater 119*a* and the heater control signal b controls the Triac 3*d* to control the current supplied to the fixing heater 119*b*. As shown in FIG. 35, the current supplied to both fixing heaters 119*a*, 119*b* has a wave-form obtained by adding the current supplied to the fixing heater 119*a* to the current supplied to the fixing heater 119*b*, and, from the relation between the resistance values of the fixing heaters 119*a* and 119*b*, the current supplied to the fixing heater 119*b* becomes twice as the current supplied to the fixing heater 119*a*. Accordingly, the current supplied from the commercial power source to the image forming apparatus has a current wave-form supplied to both fixing heaters 119*a*, 119*b*.

The CPU 105*a* determines the current amounts supplied to the fixing heaters 119*a*, 119*b* on the basis of the consumption electric powers of the fixing heaters 119*a*, 119*b* in order to control the surface temperature of the fixing roller (fixing means) 117.

Now, when the power ratio is set to, for example, 100%, 80%, 66.7%, 60%, 40%, 33.3%, 20% and 6.7%, the control method for the fixing heaters 119*a*, 119*b* will be explained.

FIGS. 36A, 36B, 37A, 37B, 38A, 38B, 39A and 39B show relations between the current wave-forms supplied to the fixing heaters and various consumption electric powers of the fixing heaters. When the power ratio is 100%, as shown in a timing chart of FIG. 36A, the fixing heater 119*a* and the fixing heater 119*b* are controlled to continuously receive the respective currents. When the power ratio is 80%, as shown in a timing chart of FIG. 36B, the current is continuously supplied to the fixing heater 119*b*, and the current is supplied to the fixing heater 119*a* for two half waves among five half waves. As a result, when the electric power is calculated regarding one cycle of five half waves, since the fixing heater 119*a* consumes 2/15 of the total electric power and the fixing heater 119*b* consumes 2/3 of the total electric power, 4/5 (80%) of electric power is consumed in total.

Figure 37A:
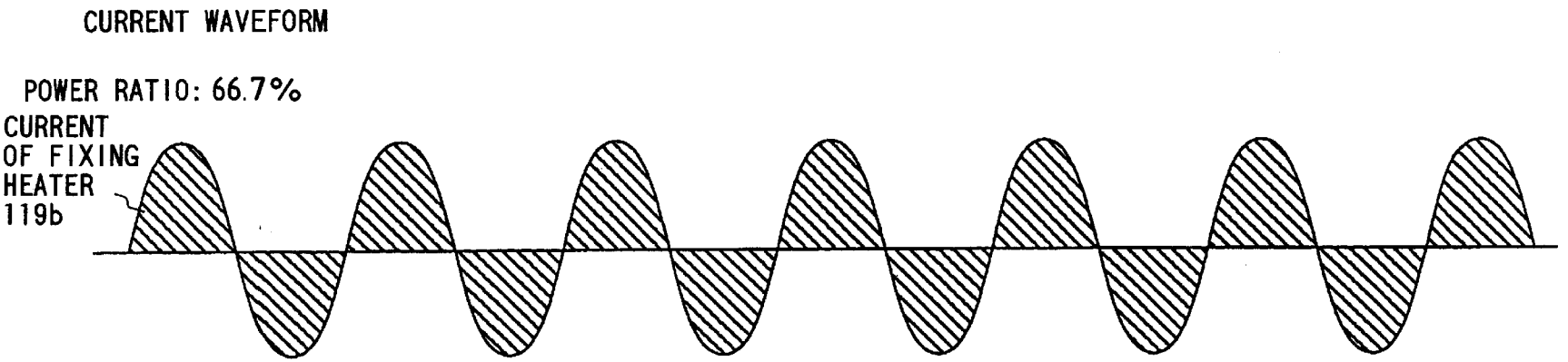
FIGS. 37A and 37B are views showing the relation between the current wave-form and the electric power ratio when the wave number control is effected, according to the thirteenth embodiment, where
Figure 37B:
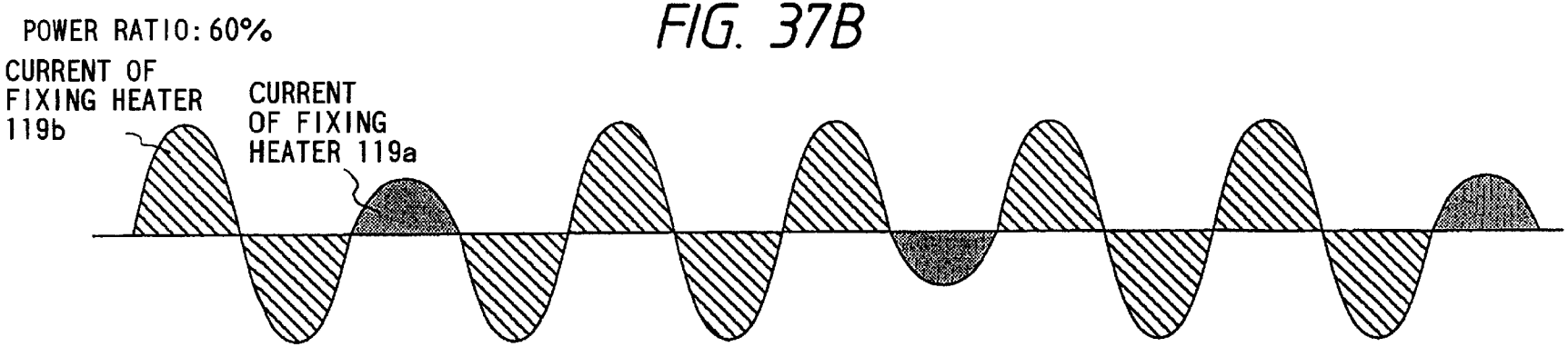

When the power ratio is 66.7%, as shown in a timing chart of FIG. 37A, the current is controlled to be supplied to the fixing heater 119*b* alone. As a result, ⅔ of the total electric power is consumed. When the power ratio is 60%, as shown in a timing chart of FIG. 37B, the control is effected so that the current is supplied to the fixing heater 119*b* for four half waves among five half waves and the current is supplied to the fixing heater 119*a* for one half waves among five half waves. In this case, the control is effected so that the current wave-form of the fixing heater 119*a* is not overlapped with the current wave-form of the fixing heater 119*b* and there is no half wave in which the current is not supplied. As a result, when the electric power is calculated regarding one cycle of five half waves, since the fixing heater 119*a* consumes 1/15 of the total electric power and the fixing heater 119*b* consumes 8/15 of the total electric power, ⅗ (60%) of electric power is consumed in total.

Figure 38A:
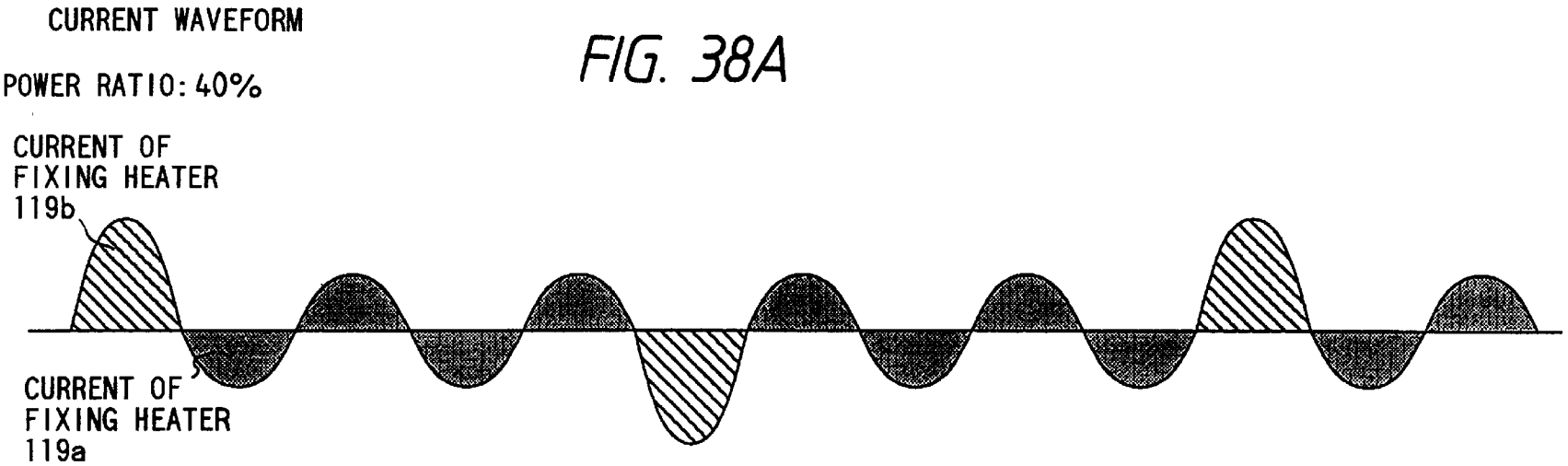
FIGS. 38A and 38B are views showing the relation between the current wave-form and the electric power ratio when the wave number control is effected, according to the thirteenth embodiment, where
Figure 38B:
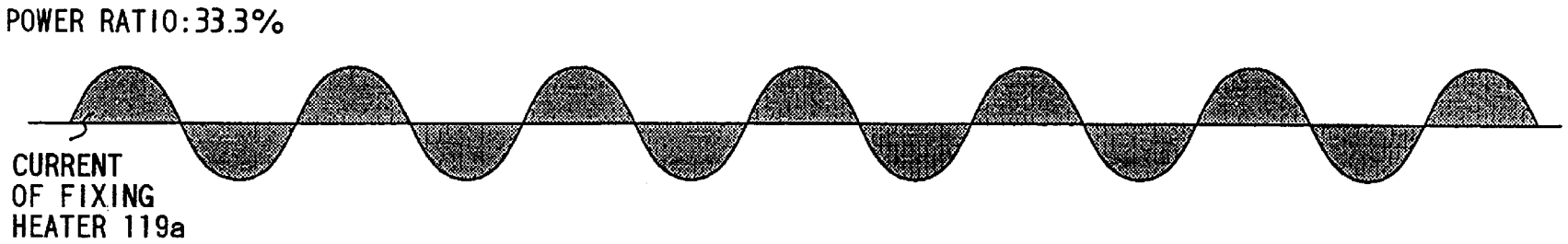

When the power ratio is 40%, as shown in a timing chart of FIG. 38A, the control is effected so that the current is supplied to the fixing heater 119*b* for one half waves among five half waves and the current is supplied to the fixing heater 119*a* for four half waves among five half waves. In this case, the control is effected so that the current wave-form of the fixing heater 119*a* is not overlapped with the current wave-form of the fixing heater 119*b* and there is no half wave in which the current is not supplied. As a result, when the electric power is calculated regarding one cycle of five half waves, since the fixing heater 119*a* consumes 4/15 of the total electric power and the fixing heater 119*b* consumes 2/15 of the total electric power, ⅖ (40%) of electric power is consumed in total. When the power ratio is 33.3%, as shown in a timing chart of FIG. 38B, the control is effected so that the current is supplied to the fixing heater 119*a* alone. As a result, ⅓ of the total electric power is consumed.

Figure 39A:
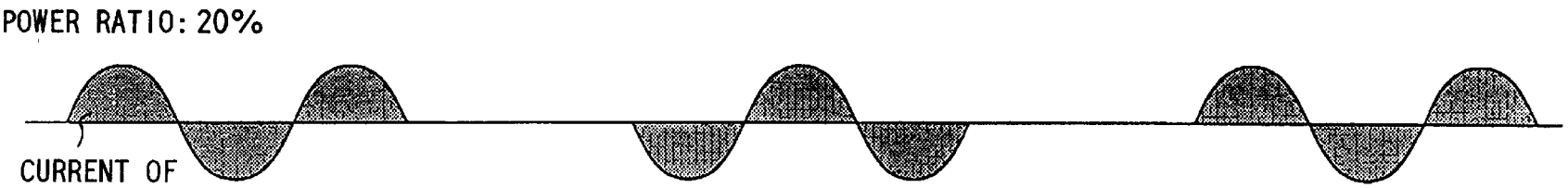
FIGS. 39A and 39B are views showing the relation between the current wave-form and the electric power ratio when the wave number control is effected, according to the thirteenth embodiment, where
Figure 39B:
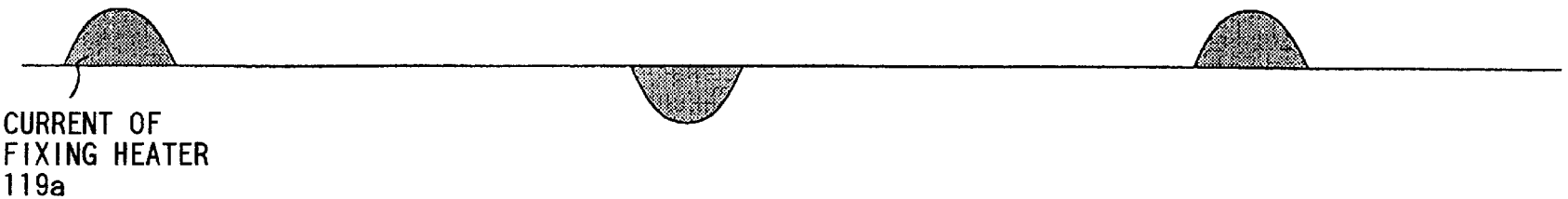
Figure 40A:
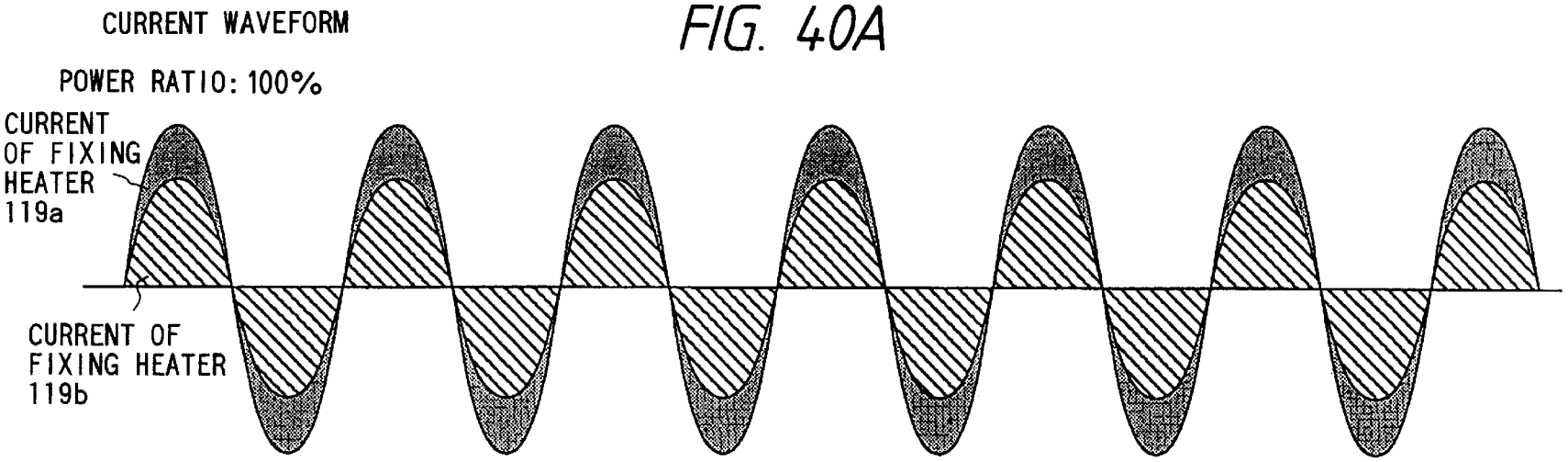
FIGS. 40A and 40B are views showing a relation between a current wave-form and an electric power ratio when the wave number control is effected, according to a fourteenth embodiment of the present invention, where
Figure 40B:
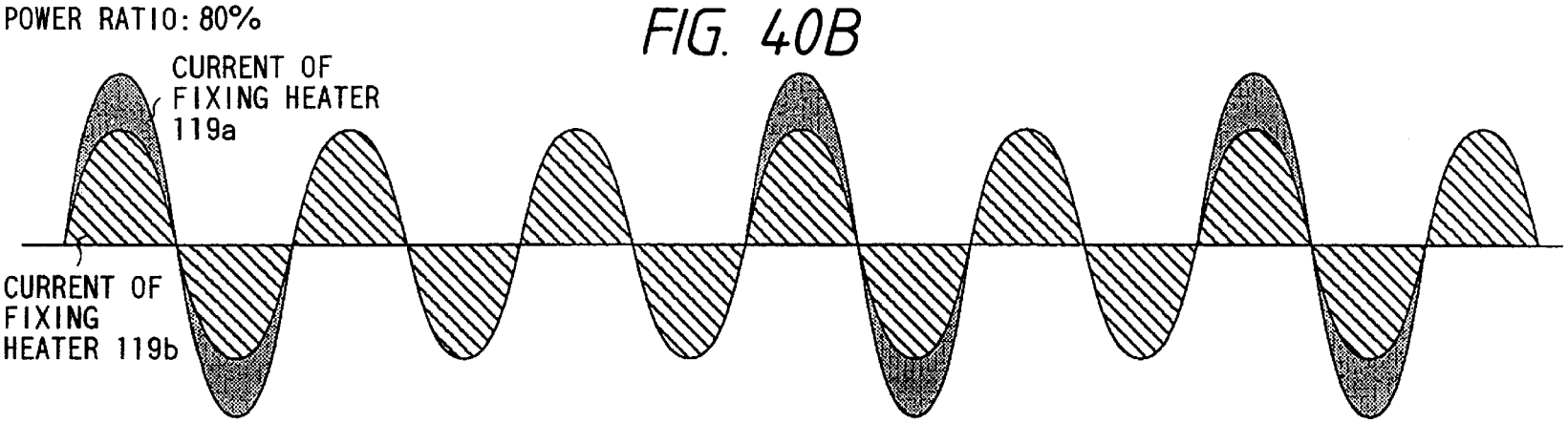

When the power ratio is 20%, as shown in a timing chart of FIG. 39A, the control is effected so that the current is not supplied to the fixing heater 119*b* and the current is supplied to the fixing heater 119*a* for three half waves among five half waves. As a result, when the electric power is calculated regarding one cycle of five half waves, since the fixing heater 119*a* consumes 3/15 of the total electric power and the fixing heater 119*b* does not consume any electric power, ⅕ (20%) of electric power is consumed in total. When the power ratio is 6.7%, as shown in a timing chart of FIG. 39B, the control is effected so that the current is not supplied to the fixing heater 119*b* and the current is supplied to the fixing heater 119*a* for one half waves among five half waves. As a result, when the electric power is calculated regarding one cycle of five half waves, since the fixing heater 119*a* consumes 1/15 of the total electric power and the fixing heater 119*b* does not consume any electric power, 1/15 (6.7%) of electric power is consumed in total.

In summary, up to the power ratio of ⅓, the fixing heater 119*a* is controlled under the wave number control and the current is not supplied to the fixing heater 119*b*. Between the power ratio of 3/1 and the power ratio of 3/2, both fixing heaters 119*a*, 119*b* are controlled under the wave number control, and, when the current is not supplied to the fixing heater 119*a*, the current is supplied to the fixing heater 119*b*. Above the power ratio of 3/2, the current is continuously supplied to the fixing heater 119*b* and the fixing heater 119*a* is controlled under the wave number control.

By effecting the control as mentioned above, the change in current can be reduced to ⅓ of the current change generated in the conventional fixing apparatuses.

(Fourteenth Embodiment)

In the thirteenth embodiment, while an example that the wave number control is effected every half cycle having five half waves was explained, in a fourteenth embodiment of the present invention, as shown in FIGS. 40A, 40B, 41A, 41B, 42A, 42B, 43A and 43B, in order to prevent the inclination or offset of the direction of the currents flowing through the Triacs 3*c*, 3*d*, the wave number control is effected every one cycle.

That is to say, FIGS. 40A, 40B, 41A, 41B, 42A, 42B, 43A and 43B show relations between the current wave-forms supplied to the fixing heaters and various consumption electric powers of the fixing heaters. When the power ratio is 100%, as shown in a timing chart of FIG. 40A, the fixing heater 119*a* and the fixing heater 119*b* are controlled to continuously receive the respective currents without offset of the current direction. When the power ratio is 80%, as shown in a timing chart of FIG. 40B, the current is continuously supplied to the fixing heater 119*b* without offset of the current direction, and the current is supplied to the fixing heater 119*a* for four half waves among ten half waves without offset of the current direction.

Figure 41A:
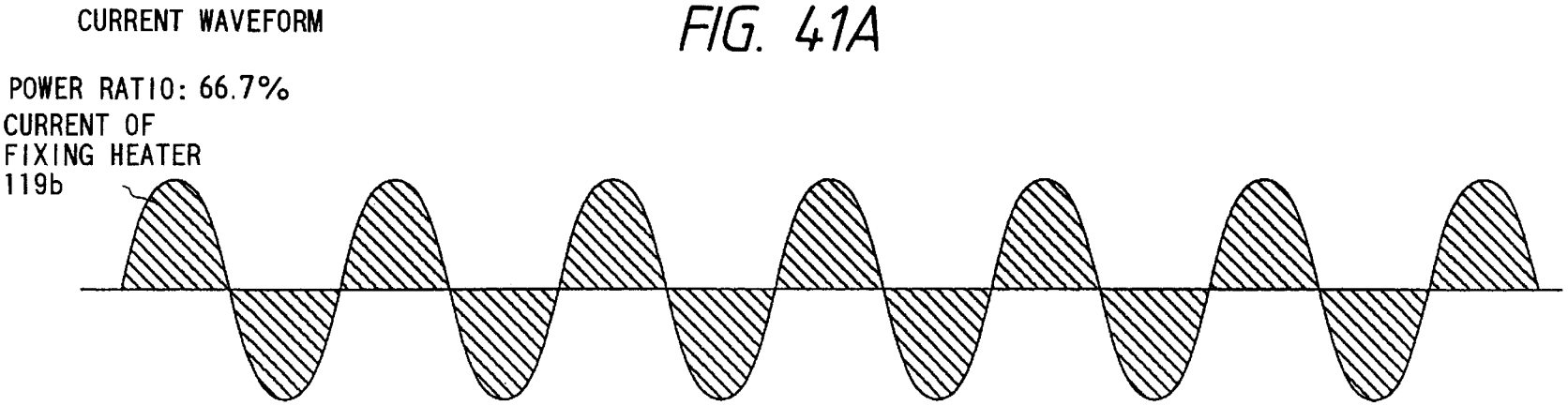
FIGS. 41A and 41B are views showing the relation between the current wave-form and the electric power ratio when the wave number control is effected, according to the fourteenth embodiment, where
Figure 41B:
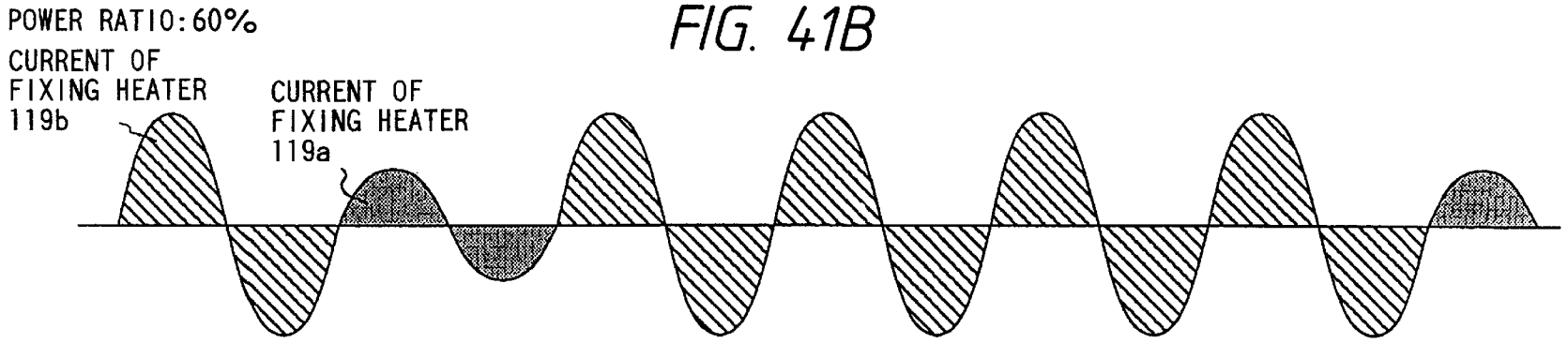

When the power ratio is 66.7%, as shown in a timing chart of FIG. 41A, the control is effected so that the current is supplied alone to the fixing heater 119*b* alone without offset of the current direction. When the power ratio is 60%, as shown in a timing chart of FIG. 41B, the control is effected so that the current is supplied to the fixing heater 119*b* for eight half waves among ten half waves without offset of the current direction and the current is supplied to the fixing heater 119*a* for two half waves among ten half waves without offset of the current direction. In this case, the control is effected so that the current wave-form of the fixing heater 119*a* is not overlapped with the current wave-form of the fixing heater 119*b* and here is no half wave in which the current is not supplied.

Figure 42A:
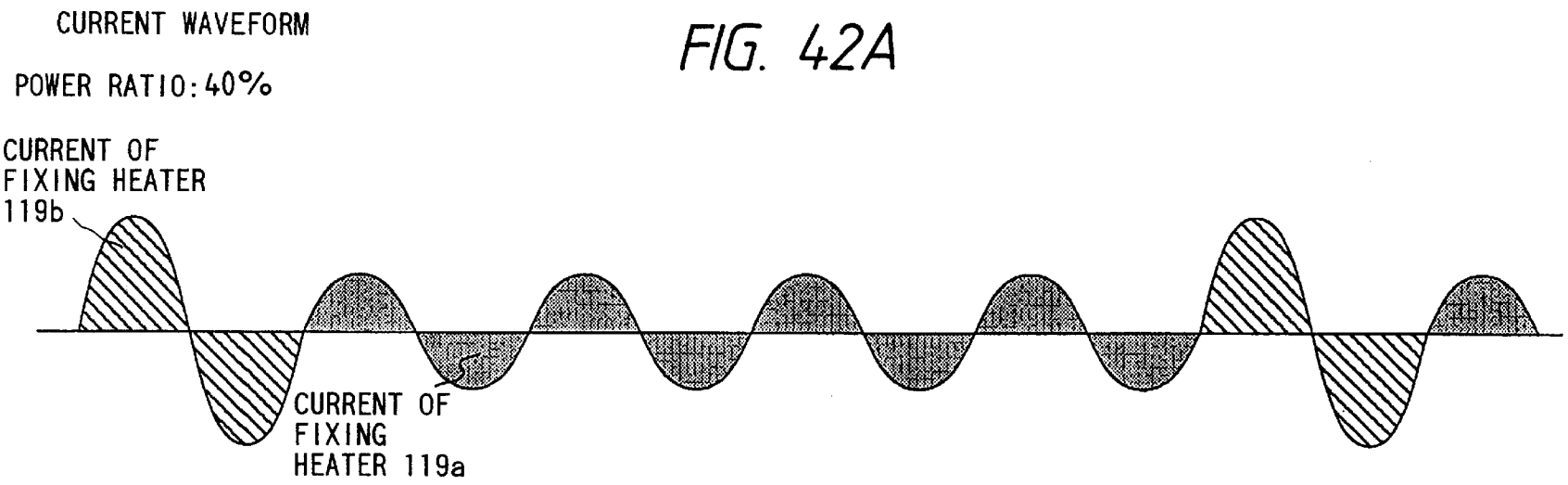
FIGS. 42A and 42B are views showing the relation between the current wave-form and the electric power ratio when the wave number control is effected, according to the fourteenth embodiment, where
Figure 42B:
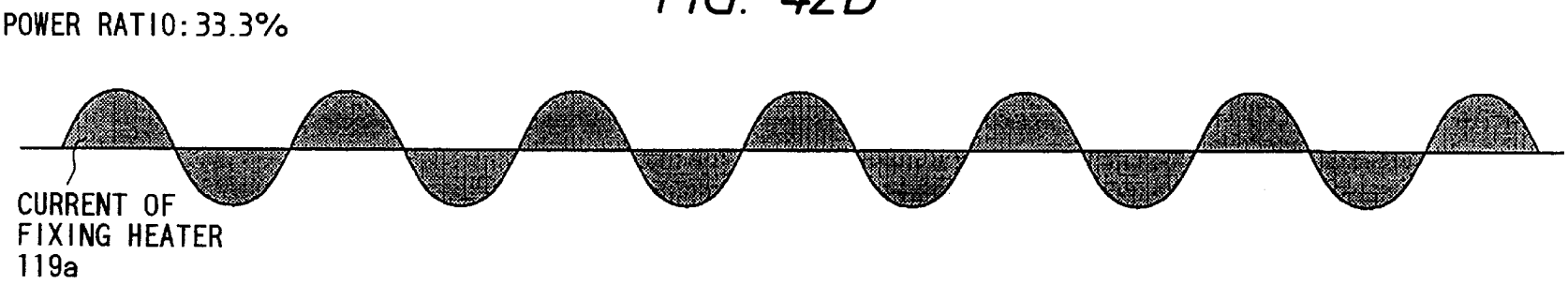

When the power ratio is 40%, as shown in a timing chart of FIG. 42A, the control is effected so that the current is supplied to the fixing heater 119*b* for two half waves among ten half waves without offset of the current direction and the current is supplied to the fixing heater 119*a* for eight half waves among ten half waves without offset of the current direction. In this case, the control is effected so that the current wave-form of the fixing heater 119*a* is not overlapped with the current wave-form of the fixing heater 119*b* and there is no half wave in which the current is not supplied. When the power ratio is 33.3%, as shown in a timing chart of FIG. 42B, the control is effected so that the current is supplied to the fixing heater 119*a* alone.

Figure 43A:
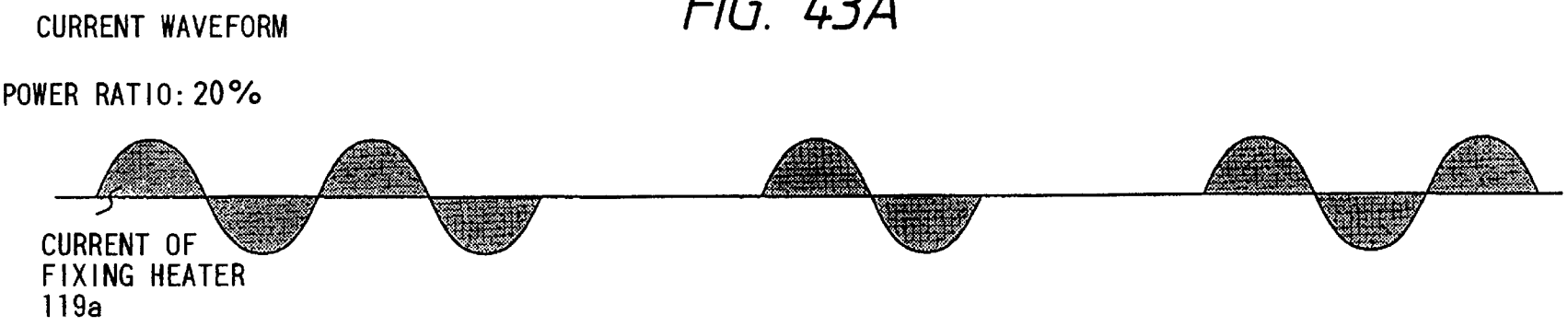
FIGS. 43A and 43B are views showing the relation between the current wave-form and the electric power ratio when the wave number control is effected, according to the fourteenth embodiment, where
Figure 43B:
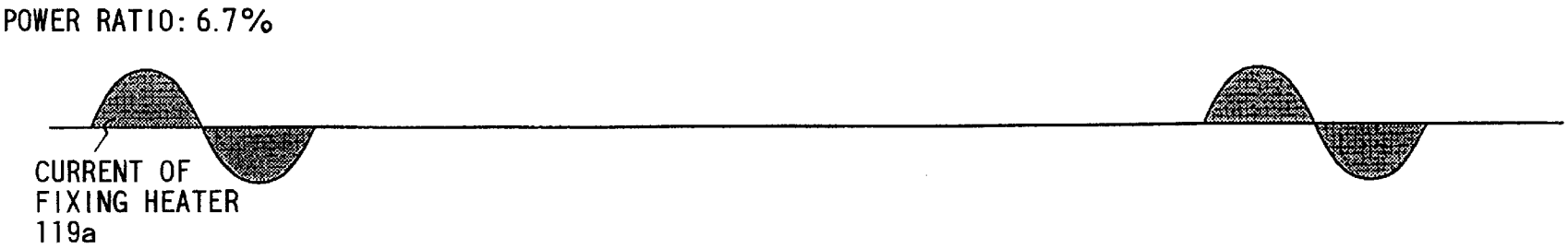
Figure 44:
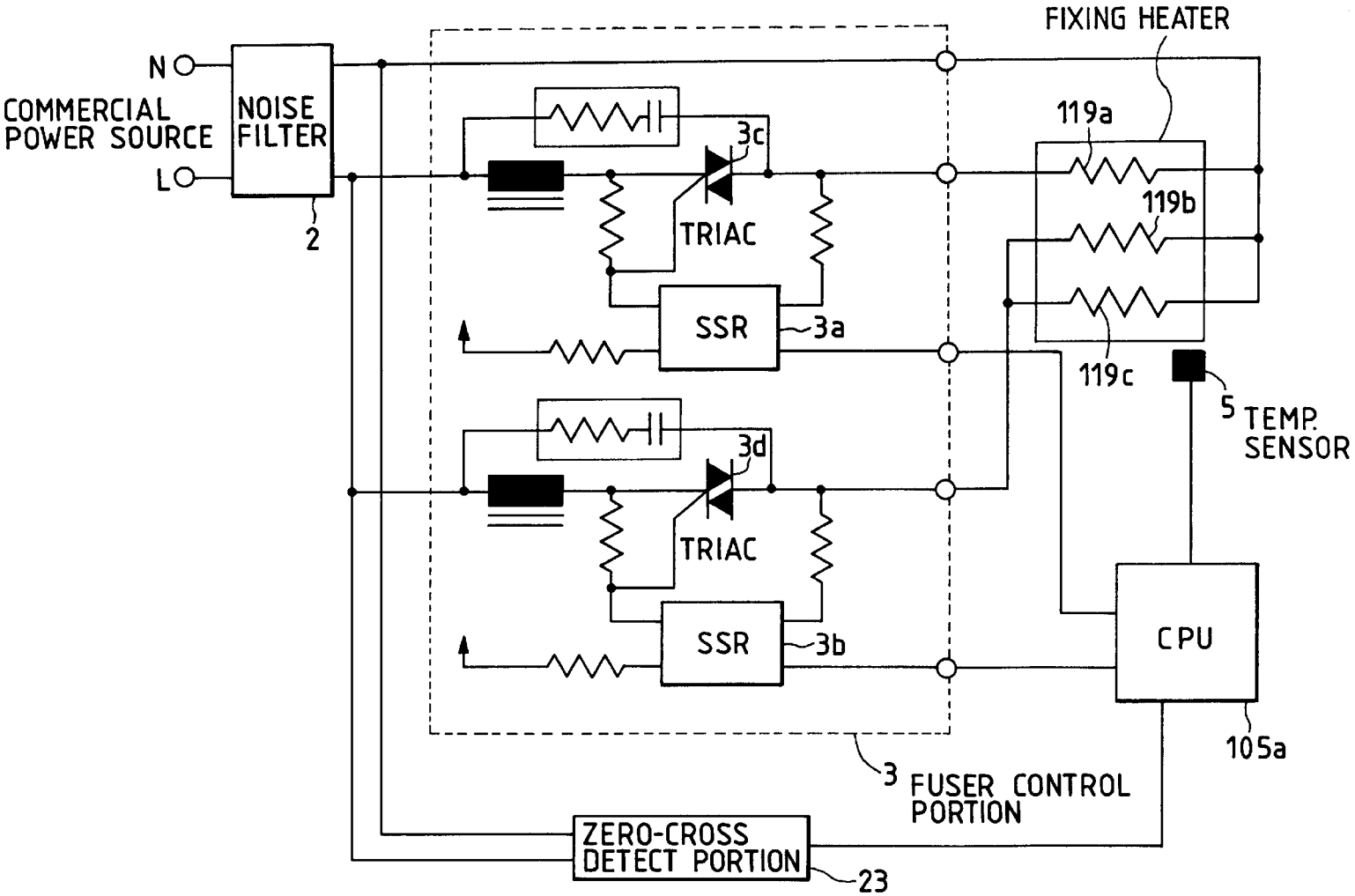
FIG. 44 is an electrical block diagram of a heater control portion, according to a fifteenth embodiment of the present invention.

When the power ratio is 20%, as shown in a timing chart of FIG. 43A, the control is effected so that the current is not supplied to the fixing heater 119*b* and the current is supplied to the fixing heater 119*a* for six half waves among ten half waves without offset of the current direction. When the power ratio is 6.7%, as shown in a timing chart of FIG. 43B, the control is effected so that the current is not supplied to the fixing heater 119*b* and the current is supplied to the fixing heater 119*a* for two half waves among ten half waves without offset of the current direction.

(Fifteenth Embodiment)

In the thirteenth and fourteenth embodiments, while an example that the ratio of the resistance values between the fixing heaters 119*a* and 119*b* is set to 2:1 was explained, in a fifteenth embodiment of the present invention, fixing heaters 119*a*, 119*b*, 119*c* having the same resistance value are connected in parallel and the fixing heater 119*a* is controlled by a heater control portion 30*a* and the fixing heaters 119*b*, 119*c* are simultaneously controlled by a heater control portion 30*b*. Also, in this case, the ratio between the resistance values can be 2:1. With this arrangement, the heater control signal A controls the Triac 3*c* to control the current supplied to the fixing heater 119*a* and the heater control signal B controls the Triac 3*d* to control the currents supplied to the fixing heaters 119*b*, 119*c*. The current supplied to the fixing heaters 119*a*, 119*b* and 119*c* has a wave-form obtained by adding the current supplied to the fixing heater 119*a* and the current supplied to the fixing heater 119*b* and the current supplied to the fixing heater 119*c*, and, from the relation between the resistance values of the fixing heater 119*a* and the fixing heaters 119*b*, 119*c*, the current supplied to the fixing heaters 119*b*, 119*c* becomes twice as the current supplied to the fixing heater 119*a*.

In summary, up to the power ratio of ⅓, the fixing heater 119*a* is controlled under the wave number control and the current is not supplied to the fixing heaters 119*b*, 119*c*. Between the power ratio of ⅓ and the power ratio of ⅔, the fixing heaters 119*a*, 119*b* and 119*c* are controlled under the wave number control, and, when the current is not supplied to the fixing heater 119*a*, the current is supplied to the fixing heaters 119*b*, 119*c*. Above the power ratio of ⅔, the current is continuously supplied to the fixing heaters 119*b*, 119*c* and the fixing heater 119*a* is controlled under the wave number control.

Incidentally, in the thirteenth and fifteenth embodiments, while an example that the ratio between the resistance value of the fixing heater 119*a* and the total resistance value of the fixing heaters 119*b*, 119*c* connected in parallel is set to 2:1 was explained, the present invention is not limited to such a ratio, but, so long as the fixing heaters are connected in parallel, even when the ratio is changed appropriately, the flicker can be suppressed.

Further, in the above-mentioned embodiments, while an example that two or three fixing heaters are used was explained, by increasing the number of fixing heaters connected in parallel and the number of heater control portions, the harmonic wave current can be reduced.

The present invention is not limited to the above-mentioned embodiments, various alterations and modifications can be made within the scope of the present invention.

What is claimed is:

1. An image heating apparatus comprising:

a heating member having a first heating resistor and a second heating resistor;

a temperature detecting element for detecting a temperature of said heating member; and power supply control means for controlling power supply to said first and second heating resistors so that the detected temperature of said temperature detecting element is maintained a set temperature, wherein said power supply control means sends the power supply to said first heating resistor in a first power supply pattern, and sends the power supply to said second heating resistor in a second power supply pattern different from the first power supply pattern, and a total supplying of power to said first heating resistor and said second heating resistor differs in accordance with the detected temperature.

2. An image heating apparatus according to claim 1, wherein said heating member further includes a third heating resistor to which said power supply control means sends the power supply in the same power supply pattern as the first power supply pattern.

3. An image heating apparatus according to claim 1, wherein said first heating resistor has a resistance value same as a resistance value of said second heating resistor.

4. An image heating apparatus according to claim 1, wherein said first heating resistor has a resistance value different from a resistance value of said second heating resistor.

5. An image heating apparatus according to claim 1, wherein said power supply control means always controls said first heating resistor under phase-control always controls said second heating resistor under ON-control or OFF-control.

6. An image heating apparatus according to claim 1, wherein said power supply control means exchanges input voltage wave-forms to said first and second heating resistors periodically, with periods equal to a predetermined number of cycles of an AC wave-form.

7. An image heating apparatus according to claim 1, wherein said power supply control means always controls said first heating resistor under wave number control and always controls said second heating resistor under ON-control or OFF-control.

8. An image heating apparatus according to claim 1, wherein said power supply control means controls said first heating resistor under phase-control and controls said second heating resistor under wave number control.

9. An image heating apparatus according to claim 8, wherein said power supply control means controls said first heating resistor under phase-control periodically, with periods equal to a predetermined number of cycles of an AC wave-form.

10. An image heating apparatus according to claim 1, further comprising a film in sliding contact with said heating member, and a back-up member cooperating with said heating member to form a nip therebetween with the interposition of said film.

11. An image heating apparatus according to claim 1, wherein said power supply control means always controls said first heating resistor under phase-control and wave number control, and always controls said second heating resistor under wave number control.

12. An image heating apparatus comprising:

a heating member having a heating resistor;

a temperature detecting element for detecting a temperature of said heating member;

power supply control means for phase-controlling power supply to said heating resistor so that the detected temperature of said temperature detecting element is maintained a set temperature;

wherein a phase angle and wave number of an electric current supplied to said heating resistor are controlled, and the phase angle is set within a predetermined angle.

13. An image heating apparatus according to claim 12, wherein the predetermined angle is set from 0 degrees to 120 degrees both inclusive.

* * * * *

UNITED STATES PATENT AND TRADEMARK OFFICE

CERTIFICATE OF CORRECTION

PATENT NO. : 5,994,671

DATED : November 30, 1999

INVENTOR(S): HIDEKI SUZUKI, ET AL.

It is certified that error appears in the above-identified patent and that said Letters Patent is hereby corrected as shown below:

COLUMN 5,
Line 41, "80+;" should read --80%;--.

COLUMN 6,
Line 12, "ipower" should read --power--; and
Line 62, "recording.sheet" should read --recording sheet--.

COLUMN 7,
Line 42, "U, 15" should be deleted.

COLUMN 10,
Line 64, "twice" should read --twice the--.

COLUMN 15,
Line 54, "the" (2nd occurrence) should be deleted.

COLUMN 23,
Line 49, "maintained" should read --maintained at--.

UNITED STATES PATENT AND TRADEMARK OFFICE

CERTIFICATE OF CORRECTION

PATENT NO. : 5,994,671

DATED : November 30, 1999

INVENTOR(S): HIDEKI SUZUKI, ET AL.

It is certified that error appears in the above-identified patent and that said Letters Patent is hereby corrected as shown below:

COLUMN 24,
Line 12, "always" should read --and always--; and
Line 53, "maintained" should read --maintained at--.

Signed and Sealed this

Twenty-first Day of November, 2000

*Attest:*

Q. TODD DICKINSON

*Attesting Officer*

*Director of Patents and Trademarks*